US006945642B2

(12) United States Patent
Yamamoto et al.

(10) Patent No.: US 6,945,642 B2
(45) Date of Patent: Sep. 20, 2005

(54) LIQUID CONTAINER

(75) Inventors: Hajime Yamamoto, Fuchu (JP); Eiichiro Shimizu, Hong-Kong (HK); Shinichi Miyauchi, Kawasaki (JP); Yoshihiko Sugimura, Fukushima (JP)

(73) Assignee: Canon Kabushiki Kaisha, Tokyo (JP)

( * ) Notice: Subject to any disclaimer, the term of this patent is extended or adjusted under 35 U.S.C. 154(b) by 113 days.

(21) Appl. No.: 10/348,983

(22) Filed: Jan. 23, 2003

(65) Prior Publication Data

US 2003/0234844 A1 Dec. 25, 2003

(30) Foreign Application Priority Data

Jan. 25, 2002 (JP) ..... 2002-016953

(51) Int. Cl.[7] ..... B41J 2/175
(52) U.S. Cl. ..... 347/86
(58) Field of Search ..... 347/84–87, 49–50; D7/392, 321, 629

(56) References Cited

U.S. PATENT DOCUMENTS

| | | | | |
|---|---|---|---|---|
| D284,728 | S | * 7/1986 | Trivison | D7/629 |
| D286,367 | S | * 10/1986 | Murphy | D7/321 |
| D411,408 | S | * 6/1999 | Ahern et al. | D7/392 |
| 6,250,750 | B1 | * 6/2001 | Miyazawa et al. | 347/87 |
| 6,382,783 | B1 | 5/2002 | Hayashi et al. | 347/85 |
| 6,402,298 | B1 | 6/2002 | Nanjo et al. | 347/49 |
| 6,443,567 | B1 | 9/2002 | Hayashi et al. | 347/85 |
| 6,450,631 | B1 | 9/2002 | Hayashi et al. | 347/86 |
| 6,505,923 | B1 | 1/2003 | Yamamoto et al. | 347/85 |
| 6,511,167 | B1 | 1/2003 | Kitabatake et al. | 347/86 |
| 6,543,886 | B1 | 4/2003 | Hattori et al. | 347/85 |
| 6,598,963 | B1 | * 7/2003 | Yamamoto et al. | 347/85 |
| 6,702,427 | B2 | * 3/2004 | Shimizu et al. | 347/50 |
| 6,709,092 | B2 | 3/2004 | Hayashi et al. | 347/86 |
| 6,719,415 | B1 | 4/2004 | Hattori et al. | 347/86 |
| 2002/0051045 | A1 | 5/2002 | Koshikawa et al. | 347/86 |
| 2002/0109761 | A1 | * 8/2002 | Shimizu et al. | 347/86 |
| 2002/0122103 | A1 | 9/2002 | Yamamoto et al. | 347/85 |
| 2002/0167571 | A1 | 11/2002 | Hayashi et al. | 347/85 |
| 2003/0001934 | A1 | 1/2003 | Kitabatake et al. | 347/86 |
| 2003/0085968 | A1 | * 5/2003 | Shimizu et al. | 347/86 |

FOREIGN PATENT DOCUMENTS

| | | |
|---|---|---|
| JP | 7-52399 | 2/1995 |
| JP | 11-310234 | 11/1999 |
| JP | 2001-1545 | 1/2001 |

* cited by examiner

*Primary Examiner*—K. Feggins
(74) *Attorney, Agent, or Firm*—Fitzpatrick, Cella, Harper & Scinto

(57) ABSTRACT

A liquid container having a generally flat rectangular parallelepiped shape includes opposite major sides; an elongated bottom side connecting the opposite major sides; a port, formed adjacent a longitudinal end portion of the bottom side, for fluid communication between an inside and an outside of the liquid container, the port being eleongated in a longitudinal direction of the bottom side and having a width which is larger adjacent a longitudinally central portion of the bottom side than adjacent the longitudinal end portion.

20 Claims, 33 Drawing Sheets

(a)

(b)

(a)

(b)

(a)

(b)

(a)

(b)

(a)

(b)

LIQUID CONTAINER

FIELD OF THE INVENTION AND RELATED ART

The present invention relates to a liquid container having an ink supply portion improved so that the liquid container can be used as an ink container or the like.

The most widely used method for forming a three dimensional object, for example, a rigid and hollow container, is a combination of a synthetic resin and injection molding. This method uses a set of male- and female-type molds. More specifically, it is a method in which melted synthetic resin is ejected into the gap between the two molds, and then, is cooled to allow the resin to solidify, in order to obtain a container having a desired shape. However, it is difficult to use injection molding to form a hollow container, more specifically, a liquid container such as an ink container, which is narrow at its opening (mouth portion) for connecting the inside and outside of the liquid container, and the internal space of the container proper (liquid storage portion) of which is substantially larger than that of the opening. Thus, in many cases, the manufacture of a container such as the above described one relied upon a complicated process; the main structure (liquid storage portion), and the cover portion were separately manufactured, and then were solidly connected to each other by adhesive or welding. Further, it was difficult to obtain a reliable container with a large capacity, because it was difficult to form a reliable seam between the main portion and cover portion.

As for a method for dealing with the above described problem, there is another method for forming a hollow container, which also has been widely used, more specifically, a molding method called blow molding. With the use of this method, a hollow container can be easily molded. According to blow molding, a piece of tube or the like formed of resin is softened, and is placed in a mold. Then, air is blown into the softened resin tube or the like to apply air pressure outward from inside the resin tube or the like to press the tube or the like against the internal surface of the mold. As a result, the internal contour of the mold is transferred onto the expanded resin tube or the like, forming a hollow container having a desired shape. In other words, this blow molding is a molding method well suited for manufacturing a hollow container, such as a PET bottle for drinking water or a ketchup tube, which is small at the opening, and the internal space of the main section of which is substantially larger than the opening portion.

However, there remained various technical problems which could not be solved even with the use of blow molding. That is, even through a hollow container is easily formed by blow molding, the air pressure applied by blow molding is in the range of no more than 5–10 kg/cm$^2$. The prior art was not good enough to produce a liquid container, which is not only precise and reliable, but also is required to be rigid.

On the other hand, in the case of injection molding, melted resin is injected into the cavity between the set of molds, which is virtually sealed, except for the gap or the like provided between the molds for gas release. Thus, the pressure applied for the injection of the melted resin is greater two decimal places than the pressure applied by blow molding.

Therefore, in terms of the transferability of the internal contour of the mold to the external surface of a container to be formed, that is, the accuracy of the measurement of the external contour of the container, a hollow container formed by blow molding is similar at best in practical function, or substantially inferior in the absolute value of dimensional accuracy, to a hollow container formed by injection molding. Further, blow molding lacks a metallic mold which directly contacts the internal surface of a hollow container, being therefore a cleaner manufacturing method, that is, a method in which a product is not contaminated by releasing agent or the like. On the other hand, not only does the usage of blow molding make it impossible to directly control the internal dimension of a hollow container, but also it makes it impossible to control the wall thickness of the container. In other words, blow molding is substantially different in terms of the above described aspects from injection molding. Therefore, in order to efficiently manufacture a hollow container with the use of blow molding, a hollow container must be designed in consideration of the characteristics of blow molding.

It should be noted here that, in addition to the direct blow molding used for manufacturing the aforementioned ketchup container, there are many molding methods simply referred to as "blow molding". For example, there is another widely used molding method called the sheet blow molding method. According to this molding method, a pair of parisons 1001 in sheet form, shown in FIG. 40(*a*), or a single parison shown in FIG. 40(*b*), is sandwiched between a set of metallic molds, to be molded into a hollow container. There is another blow molding method called the stretch blow molding method (which sometimes is called an injection blow molding method or injection blow molding), in combination with a preparatory process. According to this blow molding method, a parison 1003, such as those shown in FIGS. 41(*a*) and 41(*b*), called preform, which has a thick wall, is formed by injection molding, and does not have an undercut portion, is formed into a hollow container with the use of blow molding.

Sheet blow molding is suitable for forming a large hollow container in the form of a flat pouch with a thin wall (pouch-like flat container with thin wall) 1004. However, it is difficult to form by sheet blow molding, a hollow container, the mouth portion of which is satisfactory in terms of wall thickness, although the container proper of a hollow container formed by sheet blow molding is relatively uniform in wall thickness. In other words, when the sheet blow molding method is used to form a hollow container, it is difficult to precisely and solidly fix, or hold in the compressed state, the sealing member (for example, rubbery elastic members, which will be described later), which seals the mouth portion of the container, and through which the liquid in the container is drawn, to the mouth portion.

In comparison, stretch blow molding allows the mouth portion 1005 to be formed by injection molding during the formation of the preform 1003, making it easier to form a container, the wall of which hag a predetermined thickness and is uniform in thickness. However, stretch blow molding requires two formation steps. In other words, stretch blow molding has a weakness in that it is inconvenient to use, in particular, when forming a flat container (flat and rectangular container) such as the container 1006 shown in FIG. 41(*d*), the mouth portion 1007 of which is offset. More specifically, in this case, when forming the preform by blow molding, the variance in blow ratio is large across the preform. As a result, the portions with a thicker wall are insufficiently blown, or holes are created through the portions with a thinner wall. In other words, when stretch molding is used for forming a hollow container having the above described structure, there is the possibility that serious problems will occur during the formation of the container. Moreover, a hollow container formed by stretch blow molding has a relatively large variance in wall thickness, being therefore weaker. Thus, it sometimes caused problems while it was in use.

A liquid container, in particular, a liquid container for holding the liquid (ink) for an ink jet recording apparatus, is required to be capable of being precisely connected to the connective portion of a recording apparatus to prevent the ambient air from accidentally entering the container, and also, to prevent the liquid in the container from leaking or evaporating. In the past, therefore, when a liquid container (ink container) in accordance with the prior art was formed, injection molding was used in spite of the fact that the employment of injection molding made the manufacturing process complicated. Further, it was a common practice to design a liquid container in accordance with the prior art to accommodate injection molding.

There have been proposed several solutions to the above described problems of the prior art. Next, these proposals will be described. Referring to FIGS. 43(*a*) and 43(*b*), when a cylindrical container (container proper of which has cross section 1012) is formed using a cylindrical parison 1011 (having donut-shaped cross section), a parison is uniformly blown in its radius direction by compressed air. Therefore, preparing the parison so that its becomes uniform in wall thickness makes it possible to relatively easily form a hollow container excellent in terms of wall thickness. In comparison, referring to FIGS. 43(*a*) and 43(*c*), when a hollow container (container proper of which has cross section shown in FIG. 43(*c*)), which is approximately in the form of a flat, rectangular, parallelepiped, is formed using the cylindrical parison 1011, the blow ratio is not uniform across the parison 1011. In other words, a container having thinner portions 1013, that is, portions having stretched more, and thicker portions 1014, that is, portions having stretched less, is formed; a container greater in wall thickness variation is formed.

Thus, technologies for dealing with these problems have been tried. For example, in order to form a hollow container, the wall of which is uniform in blow ratio, a parison 1015, the cross section of which is elongated (or elliptical), as shown in FIG. 43(*d*), was prepared, or a parison 1016, the wall of which was uneven in wall thickness, as shown in FIG. 43(*e*), was prepared so that the wall thickness variance was inversely corrected. In either case, it was difficult to reliably prepare the above described parisons. Therefore, these technologies have not been put to practical use.

Further, there is a method called "post molding", according to which the measurements of a liquid container being molded are controlled, in coordination with the internal contour of the main portion of the mold set, by inserting a metallic mold (internal mold formed to be fitted in only mouth portion) into the mouth portion of the container, while blowing a parison after the clamping of the mold set. The selection of this method definitely raises the level of accuracy, but requires a complicated set of molds, making it sometimes difficult to practice the process in which a desired number of (multiple) containers are continuously outputted in the parison extrusion direction, and which characterizes direct blow molding.

Moreover, as blow molding is used to form a flat liquid container, which has such a mouth portion that comprises a neck portion 1022 with the end surface 1023, and the mouth portion of which is offset, instead of being on the center portion of the bottom surface of the liquid storage portion as shown in FIG. 44(*a*), not only does the wall of the main portion of the resultant flat liquid container turn out to be nonuniform in thickness, but also the wall of the mouth portion (neck portion 1022 with end surface 1023) turns out to be problematically nonuniform in thickness. When it is possible to make the wall of the mouth portion of a liquid container sufficiently thick, or when the mouth portion of a liquid container is sufficiently smaller than the container itself, the wall of the mouth portion can be easily made satisfactorily uniform in thickness, whether the mouth portion is positioned in the center of the bottom wall of the liquid storage portion, or offset. However, when blow molding is used to form a flat container, the wall of which is thin, and the diameter of the mouth portion of which is approximately the same as the length of the shorter edge of the bottom wall of the flat container, it is impossible for the liquid container to be outputted as a liquid container, the thickness of the wall of which is sufficient and uniform; it is outputted as a container such as the one shown in FIG. 44(*b*).

More specifically, referring to FIG. 44(*b*), in which the plane horizontally halving the mouth portion 1025 of a flat liquid container 1024 in terms of the widthwise direction of the bottom wall of the container virtually coincides with the center line 1600 (parallel to the direction indicated by arrow mark X) of the bottom wall, the portion of the wall of the mouth portion, on the center line 1000 (parallel to the direction indicated by arrow mark Z, and connecting the centers of the top and bottom walls of the liquid storage portion) side, becomes thicker across the center portion 1028 than across the portions next to the corners 1029; the wall portion of the mouth portion, on the shorter edge (at the lengthwise end of bottom wall) of the bottom wall 1030, also becomes thicker across the center portion 1026 than across the portions next to the corners; and the wall portions 1027 contiguous to the preceding two wall portions also become thicker across the center portion than across the portions next to the corners. Further, the wall portion 1026, which is on the short edge side becomes thinner than the wall portion 1028 on the center line 1000 side. Further, the wall portions 1027 and 1027 become thickest at points which are offset from the center plane 1200 (parallel to the direction indicated by arrow mark Y) horizontally halving the mouth portion in terms of the lengthwise direction of the bottom wall, toward the center line 1000.

Next, the configuration and position of the mouth portion of a liquid container based on the prior art will be described. Generally, a hollow container formed by direct blow molding is in the form of a cylinder, or flat pillar (flat, rectangular, and parallelepiped). A typical example of the former is a shampoo bottle (FIG. 40(*b*)), and a typical example of the latter is a blood transportation bag (FIG. 40(*c*)). In both cases, the container proper is virtually symmetrical, and the axial line of its mouth portion coincides with the plane halving the container proper into two virtually symmetrical portions. However, the structural arrangement in accordance with the prior art that the mouth portion is placed intentionally offset on the top or bottom wall of the container proper of a hollow container, and the technical problems resulting from such a structural arrangement, were not recognized initially.

Referring to FIG. 42, in the past, a screw plug (FIG. 42(*a*)), a bayonet plug, thermal welding (FIG. 42(*b*), a simple sealing plug (FIG. 42(*c*)), etc., have been used as a means for sealing the mouth portion of a hollow container formed by direct blow molding. However, there were virtually no patents or the like disclosing a structural arrangement which ensures that the mouth portion of a hollow container is sealed with the use of ultrasonic welding, which is very simple and convenient. Further, there have been absolutely no patents or the like disclosing a means for reliably welding connective members to the end surface of the mouth portion of a hollow container formed by blow molding, more specifically, the end surface effected by the cutting or the molded precursor of a hollow container, without providing the mouth portion with a flange (flange 14*d* in FIG. 45(*b*)). Further, reliable technologies for manufacturing a flat container having a mouth portion, which is offset and has an elongated cross section, and solidly attaching two or more components in layers by ultrasonic welding to the mouth portion, while controlling the thickness of the wall of the mouth portion, have not been disclosed. Incidentally, referential numerals 1033, 1042, and 1052 designate the lines along which molded precursors of a hollow container are cut.

On the other hand, technologies for welding the above described mouth portion to the above described container with the use of heat plate welding are available as alternative means for sealing the mouth portion. In the case of these technologies, it is impossible to prevent the container proper and mouth portion from being thermally deformed. Thus, they were unsuitable for forming a liquid container for an ink jet recording apparatus, from the standpoint of the accuracy regarding the position of the flat surface in terms of both the horizontal and vertical directions.

Further, a blood transportation bag or the like, the joint portion (portion connecting inside and outside of container) of which does not need to be very strictly regulated in size, does not need to be concerned with these technical problems. However, a liquid container, which needs to be compactly mounted in alignment by two or more in a device or apparatus, more specifically, an ink container, which needs to be removably mounted by the number corresponding to the number of recording liquids different in color, in the mounting portion of an ink jet recording apparatus, requires a simple, reliable, and compact joint structure (structure for connective portion).

SUMMARY OF THE INVENTION

The present invention was made in consideration of the above described technical problems. Its primary object is to provide a liquid container which comprises: a liquid storage portion, that is, a flat and hollow container proper formed of direct blow molding; and a mouth portion which is for connecting the inside and outside of the liquid storage portion, and which is superior in rigidity, precise in dimension, and is uniform in wall thickness, wherein the liquid storage portion and mouth portion can be integrally molded, and also, to provide an ink jet recording apparatus compatible with such a liquid container.

According to a first aspect of the present invention, there is provided a liquid container having a generally flat rectangular parallelepiped shape, comprising opposite major sides; an elongated bottom side connecting said opposite major sides; a port, formed adjacent a longitudinal end portion of the bottom side, for fluid communication between an inside and an outside of said liquid container, the being eleongated in a longitudinal direction of the bottom side and having a width which is larger adjacent a longitudinally central portion of the bottom side than adjacent the longitudinal end portion.

According to a second aspect of the present invention, there is provided a liquid container according to aspect 1, wherein said port is only one port for communication between the inside and outside.

According to a third aspect of the present invention, there is provided a liquid container according to aspect 1, wherein said port is produced by blow molding of a synthetic resin material.

According to a fourth aspect of the present invention, there is provided a liquid container according to aspect 1, wherein said port includes a connecting portion for air venting and a connecting portion for supplying liquid out of said container.

According to a fifth aspect of the present invention, there is provided a liquid container according to aspect 4, wherein said connecting portions are arranged in a longitudinal line substantially at a widthwise center of said bottom side.

According to a sixth aspect of the present invention, there is provided a liquid container according to aspect 4, wherein said liquid supply connecting portion is disposed adjacent said one end portion and adjacent a widthwise end of said bottom side.

According to a seventh aspect of the present invention, there is provided a liquid container according to aspect 1, wherein said port is provided with a neck portion projecting from said bottom side toward the outside and a flange extending from said neck portion in substantially parallel with said bottom side.

According to a eighth aspect of the present invention, there is provided a liquid container according to aspect 1, wherein said port is formed by laminated structure.

According to a nineth aspect of the present invention, there is provided a liquid container according to aspect 1, wherein said laminated structure supports an elastic member to be pierced by a connection needle.

According to a tenth aspect of the present invention, there is provided a liquid container according to aspect 8, wherein said laminated structure is welded at said port.

According to a eleventh aspect of the present invention, there is provided a liquid container according to aspect 10, wherein said laminated structure includes laminated material s having thicknesses which gradually decreases.

According to a twelfth aspect of the present invention, there is provided a liquid container according to aspect 8, further comprising a cylindrical member extended into said container to retain a shape of said port.

According to a 13th aspect of the present invention, there is provided a liquid container according to aspect 9, wherein said needle is a hollow needle.

According to a 14th aspect of the present invention, there is provided a liquid container according to aspect 1, further comprising a bottom cover for covering said port.

According to a 15th aspect of the present invention, there is provided a liquid container according to aspect 14, wherein said bottom cover is provided with a recess for engagement with a member for constituting said port.

According to a 16th aspect of the present invention, there is provided a liquid container according to aspect 1, wherein said bottom cover is provided with an identifying portion for preventing erroneous connection.

According to a 17th aspect of the present invention, there is provided a liquid container according to aspect 14, wherein said identifying portion includes a storing member for storing a kind and/or a remaining amount of the liquid in said container by electric, magnetic or optical or memory by combination thereof.

According to a 18th aspect of the present invention, there is provided a liquid container according to aspect 1, wherein said container is disconnectably connected with an ink jet recroding apparatus for effecting recording on a recording material by ejection of the liquid.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 3(*b*), bottom view of an embodiment of a small liquid container, which is in accordance with the present invention, and which employs the first ID pattern; FIG. 3(*c*), bottom view of an embodiment of a small liquid container, which is in accordance with the present invention, and which employs the second ID pattern; and FIG. 3(*d*) is a bottom view of an embodiment of a small liquid container, which is in accordance with the present invention, and which employs the third ID pattern.

DESCRIPTION OF THE PREFERRED EMBODIMENTS

Hereinafter, the preferred embodiments of the present invention will be concretely described with reference to the appended drawings, in which if two or more components are the same in referential numerals, they are the same or equivalent.

Figure 1:
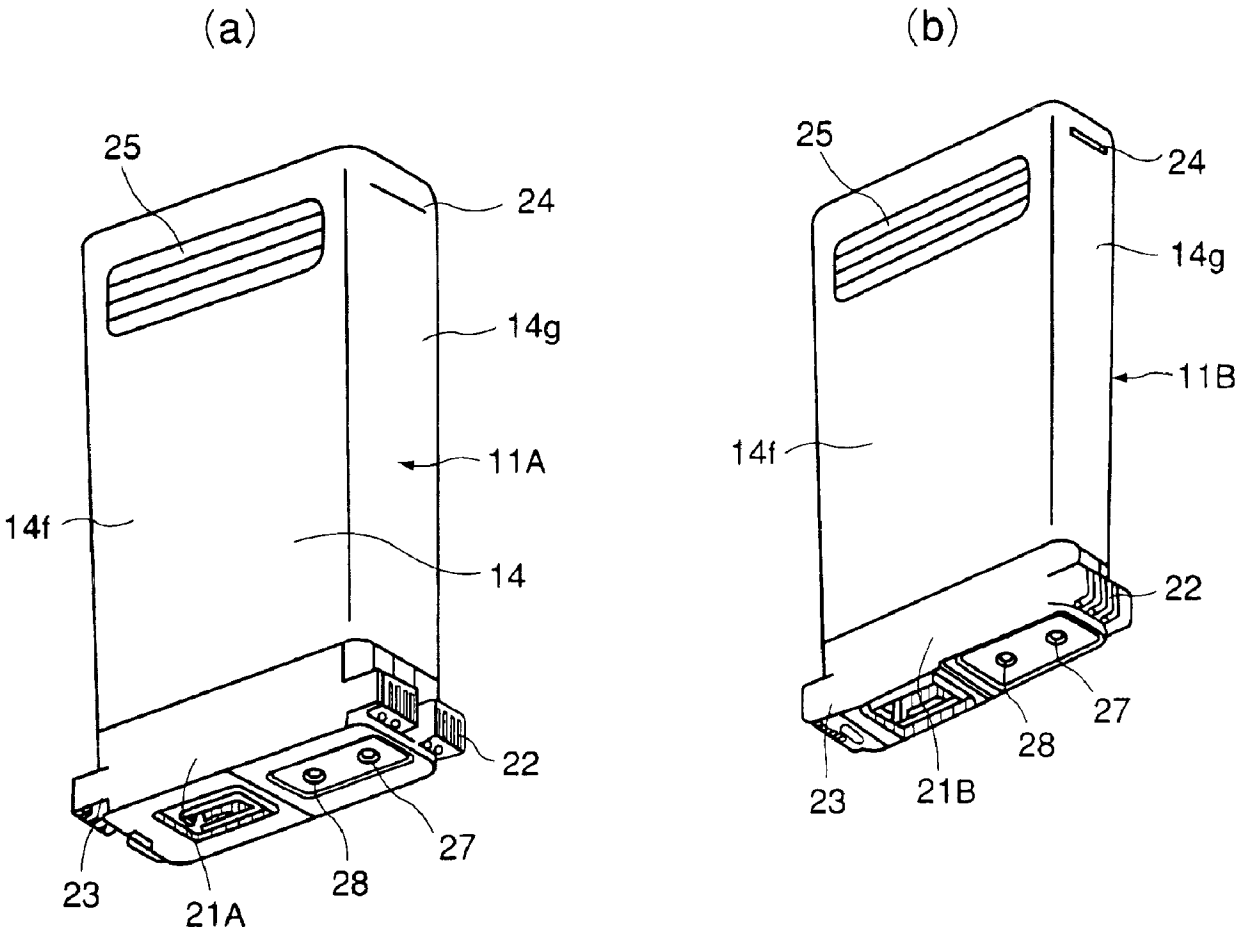
FIG. 1 is a schematic perspective view of an example of a liquid container in accordance with the present invention, FIGS. 1(*a*) and 1(*b*) showing larger and small containers, respectively, as seen from diagonally below.

FIG. 1(*a*) is a schematic perspective view of an embodiment of a large liquid container in accordance with the present invention, as seen from diagonally below the container, and FIG. 1(*b*) is a schematic perspective view of an embodiment of a small liquid container in accordance with the present invention, as seen from diagonally below the container. In terms of the shape (projected area) of the largest wall 14*f*, the large liquid container shown in FIG. 1(*a*) is the same as the small liquid container shown in FIG. 1(*b*). However, in terms of the thickness (distance between two largest walls of container, which oppose each other), the former is greater than the latter, being therefore greater in liquid capacity.

Figure 2:
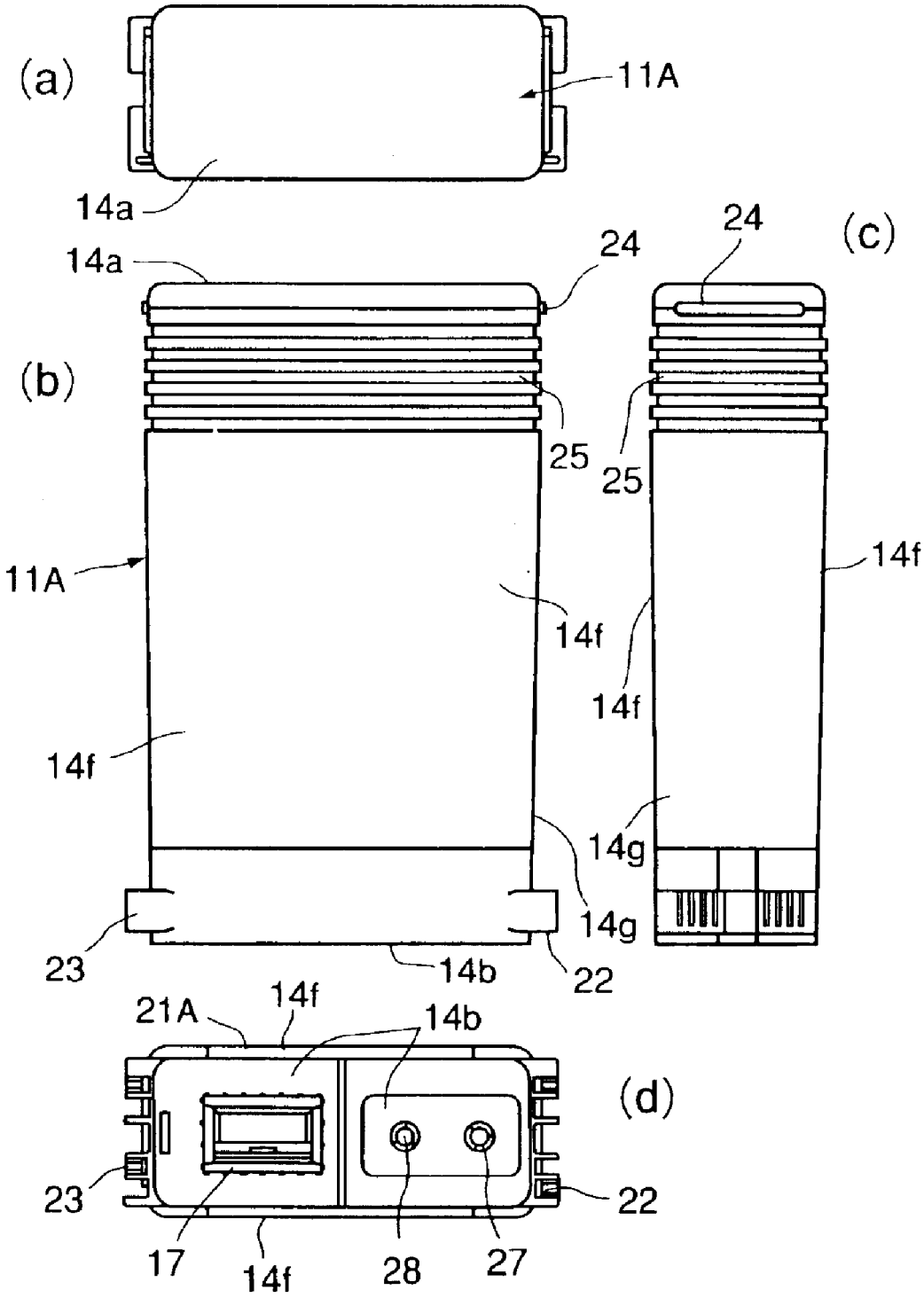
FIGS. 2(*a*), 2(*b*), and 2(*c*) are top, front, side, and bottom views of the larger liquid container shown in FIG. 1(*a*).

FIGS. 2(*a*), 2(*b*), 2(*c*), and 2(*d*) are top, front, side, and bottom views of the larger liquid container, respectively.

Figure 3:
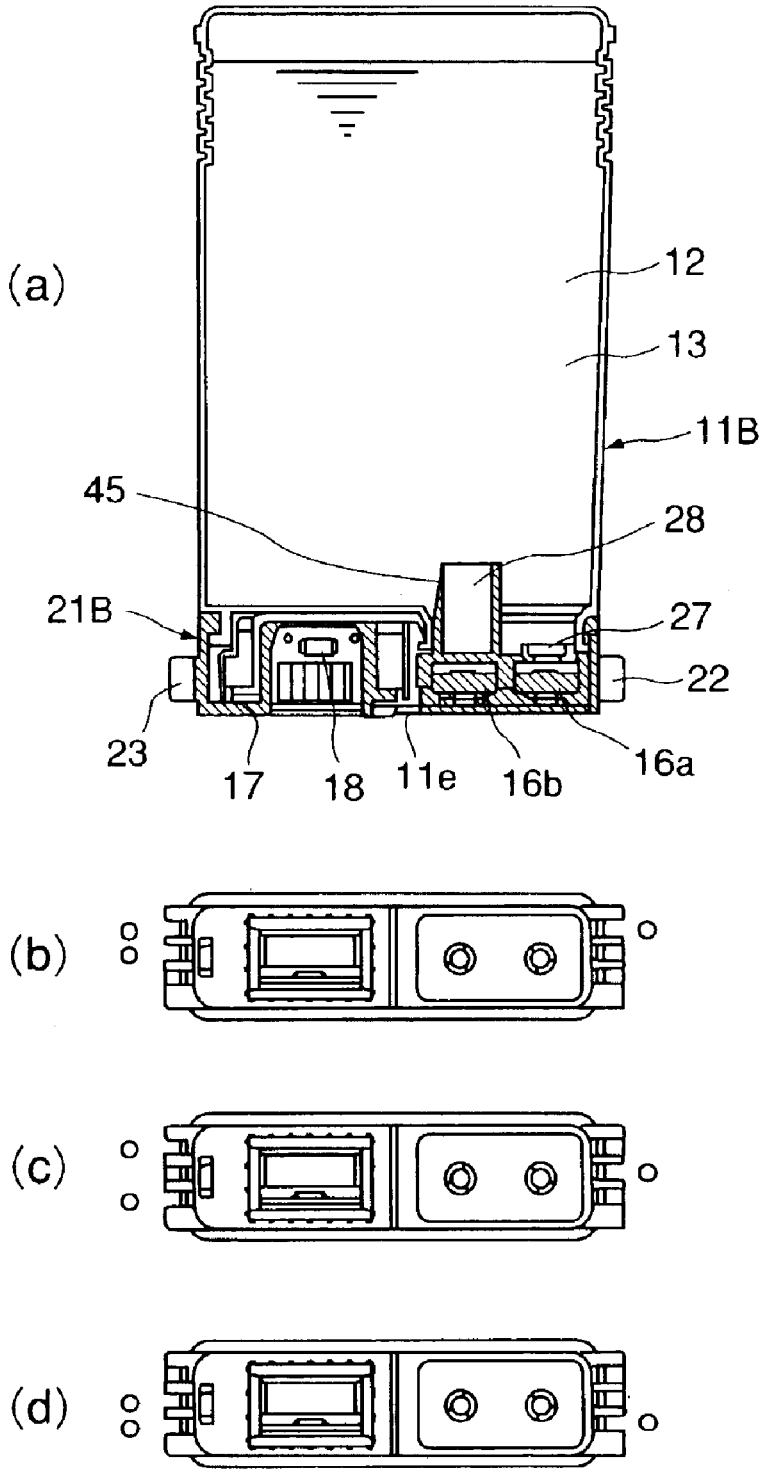
FIG. 3(*a*) is a vertical sectional view of the small liquid container shown in FIG. 1(*b*), at a plane parallel to the largest walls of the small container.

FIG. 3(*a*) is a vertical sectional view of the small liquid container in FIG. 1(*b*), at a plane parallel to the largest walls of the liquid container; FIG. 3(*b*), a bottom view of an embodiment of a small liquid container, in accordance with the present invention, having the first ID pattern; FIG. 3(*c*), a bottom view of an embodiment of the small liquid container, in accordance with the present invention, having the second ID pattern; and FIG. 3(*d*) is a bottom view of an embodiment of the small liquid container, in accordance with the present invention, having the third ID pattern.

Figure 4:
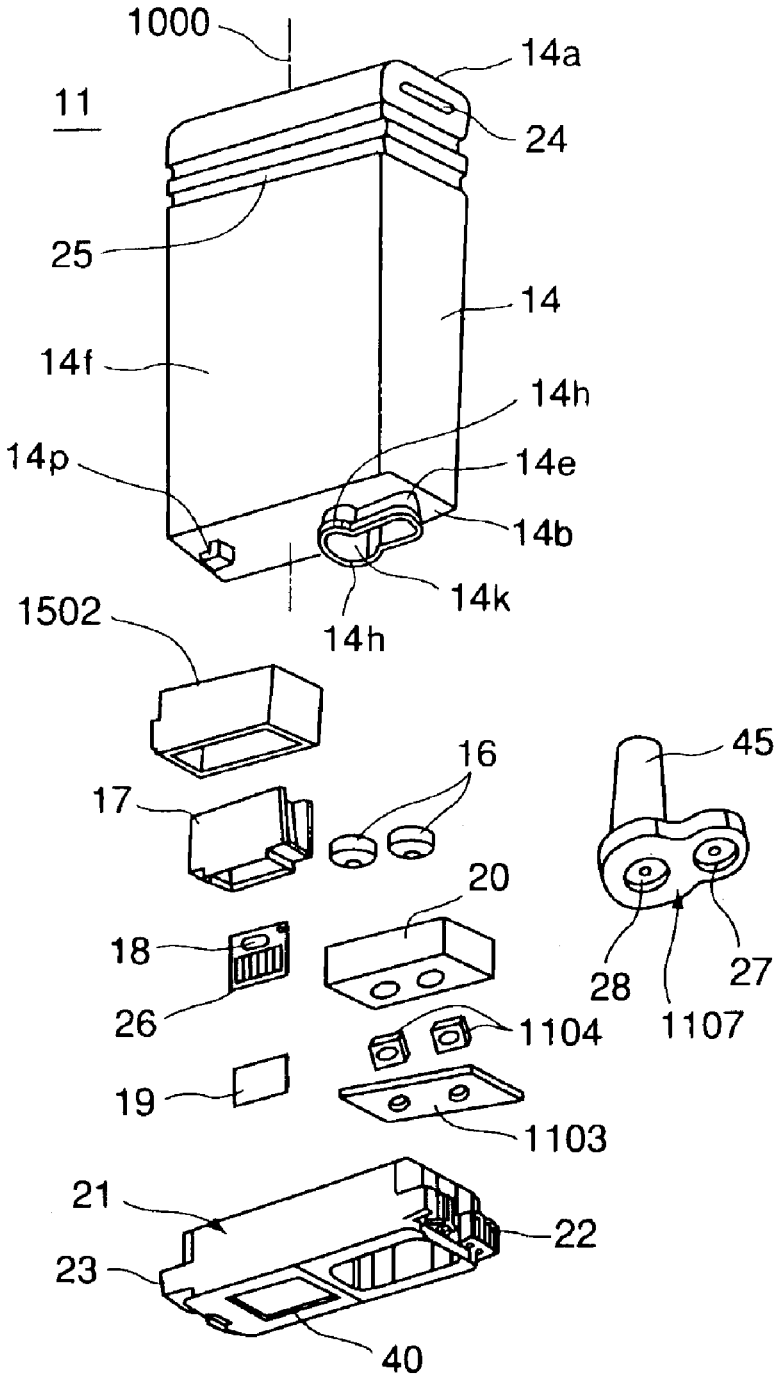
FIG. 4 is a schematic, exploded, perspective view of an example (inclusive of both large and small liquid containers) of a liquid container in accordance with the present invention.
Figure 5:
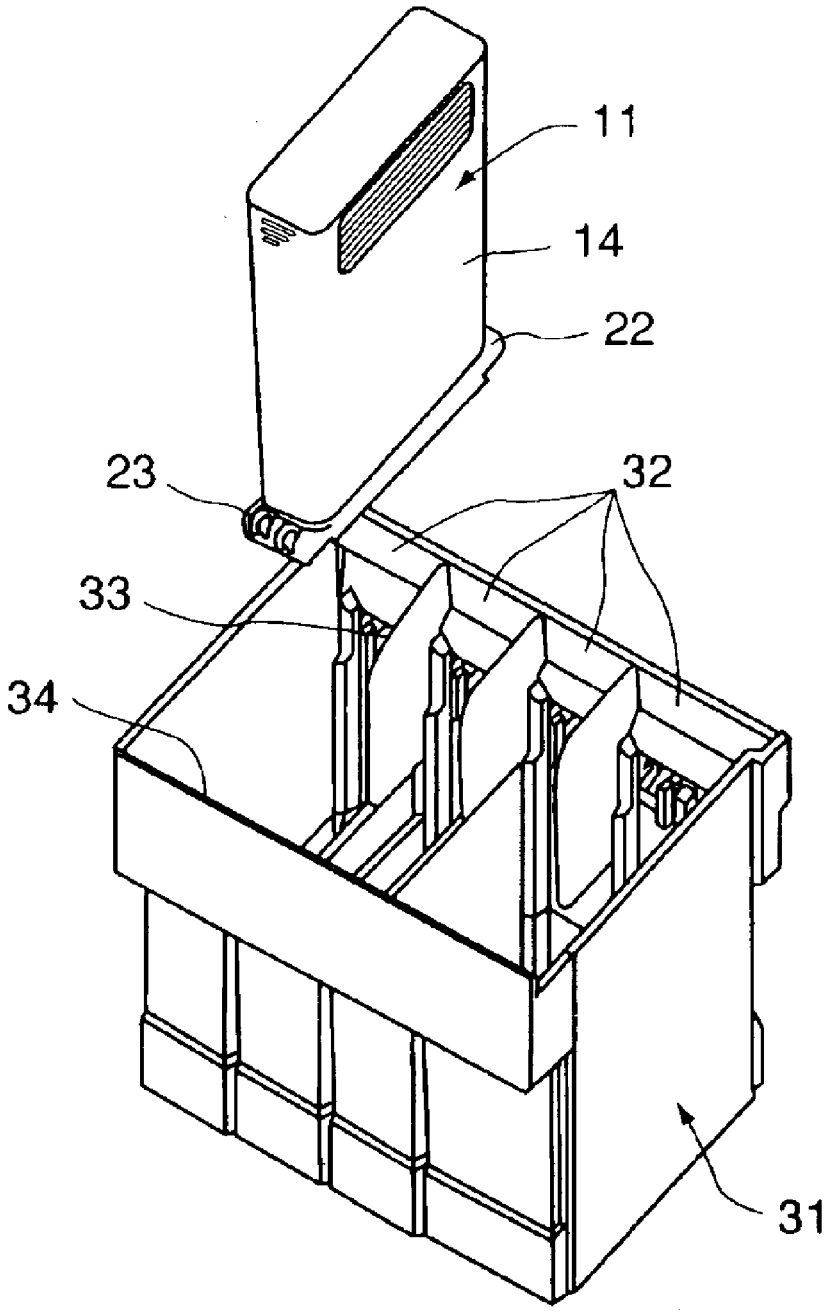
FIG. 5 is a schematic perspective view of the station base, into which a liquid container in accordance with the present invention is removably mountable.

FIG. 4 is an exploded schematic perspective view of an embodiment of a liquid container (inclusive of larger and smaller containers) in accordance with the present invention, and FIG. 5 is a schematic perspective view of the station base in which a liquid container in accordance with the present invention is removably mountable.

Referring to FIGS. 1–5, a liquid container in accordance with the present invention (larger container 11A, smaller container 11B) is approximately in the form of a flat rectangular parallelepiped (which hereinafter may be referred to simply as flat container), making it possible for two or more liquid containers to be mounted side by side. The liquid storage portion 14 of the liquid container 11A or 11B is a molded single-piece container comprising a top wall 14*a* (ceiling portion, FIG. 2), a bottom wall 14*b* (FIG. 4), a mouth portion 14*k* (FIG. 4), a flange portion 14*d* (FIG. 4), a neck portion 14*e* (FIG. 4), etc., and is manufactured by direct blow molding.

Referring to FIG. 2, the bottom portion 14*b* of the larger liquid container 11A has a connective portion through which the inside and outside of the liquid container 11A are connectable. The structural design depicted in FIG. 2 is the same as the structural design of the corresponding portions of the small liquid container 11B; the large and small containers 11A and 11B are the same in structure. Referring to FIG. 3(*a*) which is a vertical sectional view of the small liquid container 11B, at a plane which is parallel to the largest walls of the container and approximately halves the container in terms of the horizontal direction, the structural design depicted by this drawing is the same as the structural design of the corresponding portions of the large container 11A.

The present invention is applicable to both the large liquid container 11A and small container 11B, and the effects of the present invention upon the former are the same as those upon the latter. Thus, in the following description of the present invention, all liquid containers will be referred to as "liquid container 11" unless it is necessary to specify the liquid container size. In other words, the term "liquid container 11" is inclusive of both the large and small containers mentioned above.

Referring to FIGS. 1–5, the liquid container 11 in accordance with the present invention has a bottom cover 21 which is solidly fixed to the bottom portion 14*b* of the liquid storage portion 14. The liquid container 11 has a pair of ID portions 22 and 23 (ID patterns), which are attached one for one to the lengthwise ends of the bottom cover 21. In this embodiment, the liquid container 11 has two ID patterns: a first container ID pattern located at one of the lengthwise ends of the bottom cover 21, and a second container ID pattern located at the other lengthwise end of the bottom cover 21. These two ID portions are used for identifying various liquid containers in terms of liquid type (color, etc.); several patterns are prepared to make it possible to identify the liquid in each liquid container (FIGS. 2 and 3).

Referring to FIG. 4, the liquid storage portion 14 of the liquid container 11 (11A or 11B) is flat (approximately in the form of a flat rectangular parallelepiped), and has six walls: a pair of opposing walls 14*f*, the largest walls; a top wall 14*a* (ceiling portion); a pair of opposing connective walls 14*g*, which are connected to the largest walls 14*f* and top wall 14*a*; and bottom portion 14*b*, which opposes the top wall 14*a* and constitutes the bottom wall of the liquid container. The bottom portion 14*b* has a mouth portion 14*k* which leads to the interior of the liquid storage portion 14. The mouth portion 14*k* has a connective portion through which the inside and outside of the liquid storage portion 14 are connected, and which is structured as will be described later.

Figure 6:
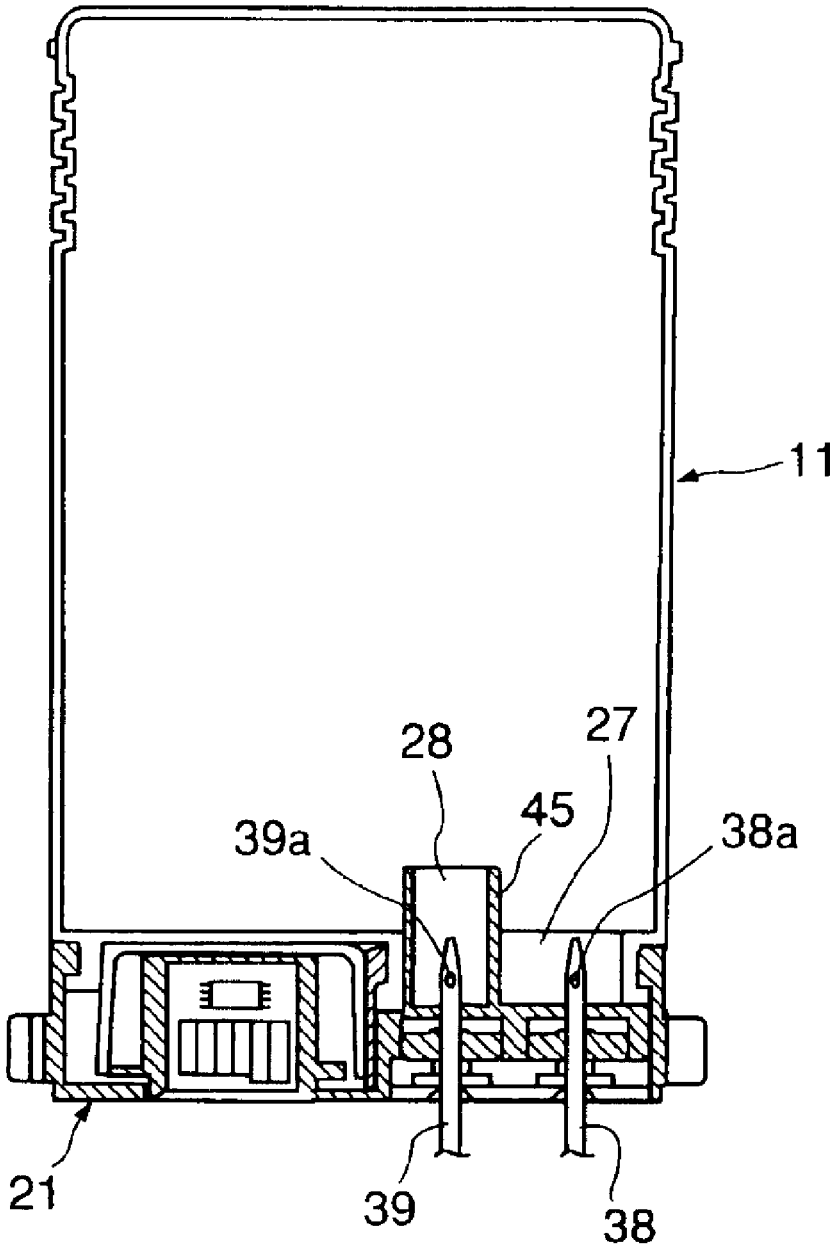
FIG. 6 is a schematic vertical sectional view of an embodiment of a liquid container (inclusive of both large and small containers) in accordance with the present invention, which has been penetrated by a pair of connecting needles.
Figure 7:
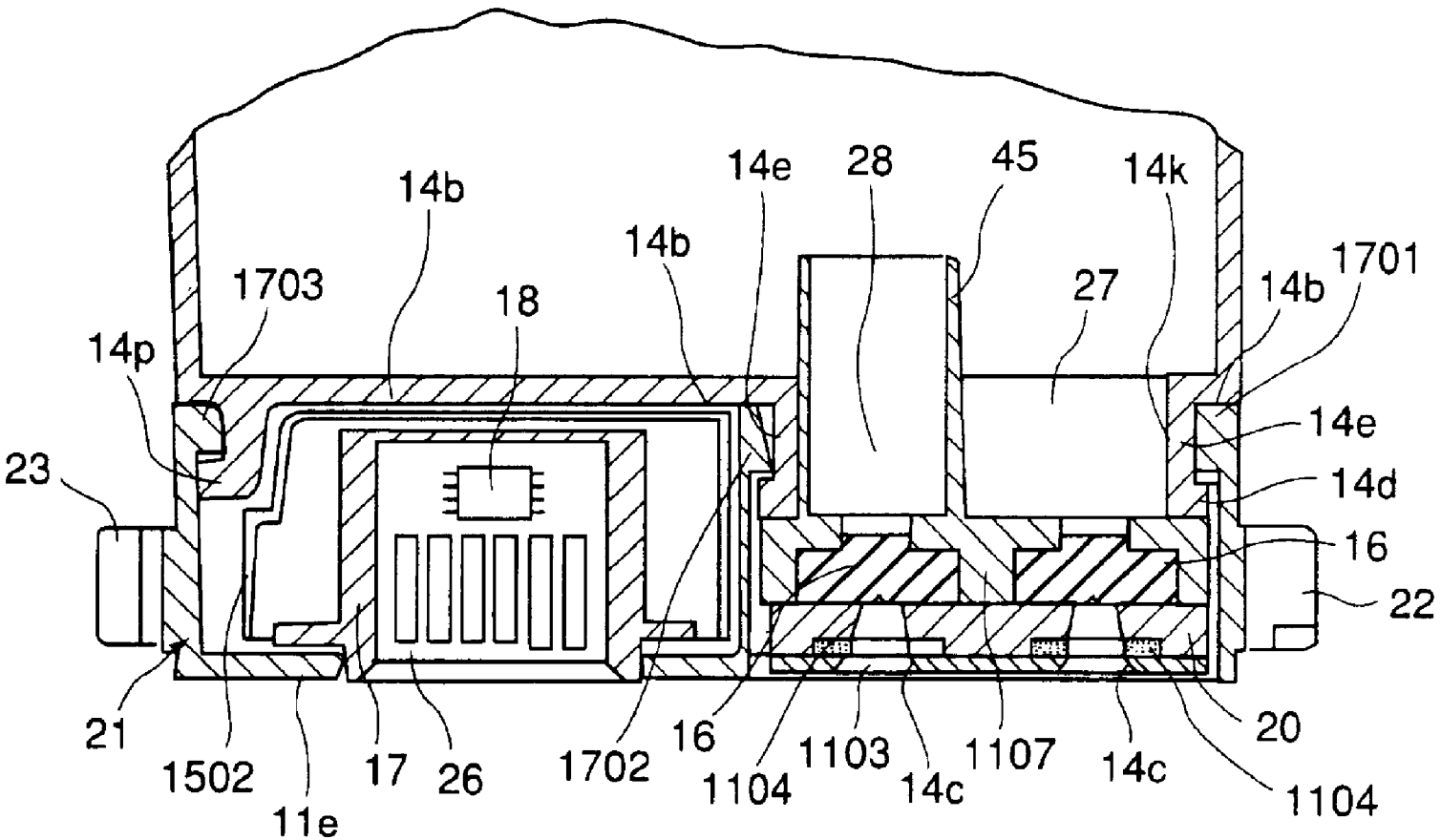
FIG. 7 is an enlarged, schematic, vertical, sectional view of the mouth portion of an embodiment of a liquid container (inclusive of both large and small containers) in accordance with the present invention, and the adjacencies of the mouth portion.
Figure 28:
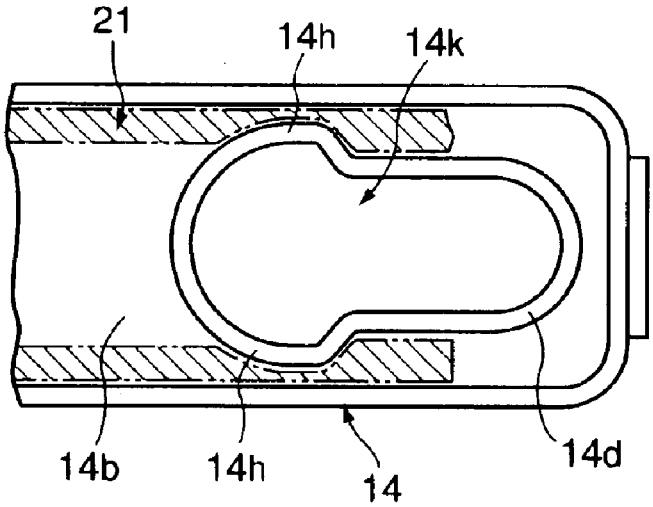
FIG. 28 is a schematic drawing for depicting the shape of the flat end surface of the mouth portion of the bottom portion of the liquid storage portion of another embodiment of a liquid container in accordance with the present invention.
Figure 29:
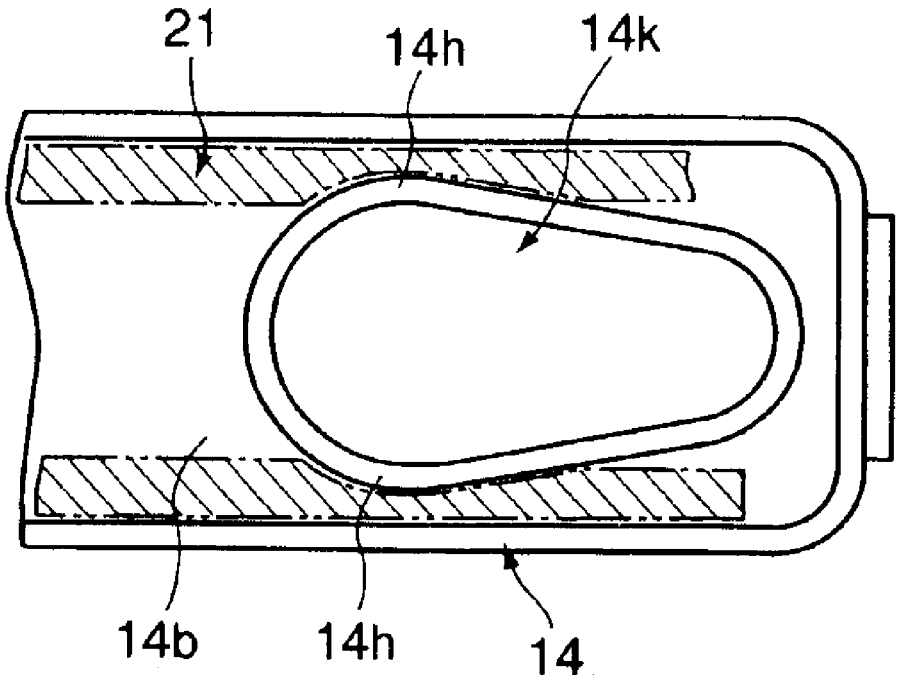
FIG. 29 is a schematic drawing for depicting the shape of the flat end surface of the mouth portion of the bottom portion of the liquid storage portion of another embodiment of a liquid container in accordance with the present invention.

FIG. 6 is a schematic vertical sectional view of an embodiment of a liquid container (inclusive of large and small container) in accordance with the present invention, after the insertion of a pair of connective needles 38 and 39 into the liquid container. FIG. 7 is an enlarged schematic sectional view of the mouth portion, and its adjacencies, of the embodiment of a liquid container (inclusive of both large and small containers) in accordance with the present invention. FIG. 28 is a plan view of the mouth portion 14*k* of the bottom portion 14*k* of the liquid storage portion 14 of another embodiment of a liquid container in accordance with the present invention, and shows the shape of the opening of the mouth portion 14*k*. FIG. 29 is a plan view of the mouth portion 14*k* of another embodiment of a liquid container in accordance with the present invention, and shows the shape of the opening of the mouth portion 14*k*.

Referring to FIGS. 4–7, 28, and 29, the mouth portion 14*k* is a part of the bottom wall 14*b* (bottom portion). The mouth portion 14*k* is offset from a vertical plane 1000 (FIG. 4) which is perpendicular to the largest walls 14*f* of the liquid storage portion 14 and horizontally halves the liquid storage portion 14, as shown in FIGS. 4, 28, and 29; it is located close to one end (right-hand end in this embodiment) of the bottom wall 14*b*. The opening of the mouth portion 14*k* is elongated in the direction parallel to the lengthwise direction of the bottom portion 14*b* (direction parallel to long edges of virtually flat parallelepiped form of bottom portion 14*b*); it is long and narrow.

Referring also to FIGS. 4, 28, and 29, the mouth portion 14*k* is shaped so that its opening is narrower on the side closer to the shorter edge of the bottom wall 14*b* than on the side closer to the aforementioned plane 1000; it is wider on the side closer to the plane 1000. Further, the mouth portion 14*k* has a flange portion 14*k*, which completely surrounds the opening of the mouth portion 14*k*. Because of the above described shape of the mouth portion 14*k*, the portion 14*h* (overhang portion) of the flange portion 14*d*, that is, the portion of the flange portion 14*d* on the central plane 1000 side, which is parallel to the lengthwise edges of the bottom wall, projects in the direction parallel to the short edges of the bottom wall 14*b* (in the thickness direction of liquid storage portion 14).

Regarding the shape of the opening of the mouth portion 14*k*, the opening may be optimally rounded at four corners as shown in FIG. 4, or may be rounded at both lengthwise ends as shown in FIGS. 28 and 29. Further, instead of shaping the mouth portion 14*k* so that the opening will have two portions distinctively different in width (dimension in terms of direction perpendicular to largest walls of liquid storage portion), the mouth portion 14*k* may be shaped so that the width of its opening gradually reduces toward the short edge of the bottom portion 14*b*, as shown in FIG. 29.

Figure 8:
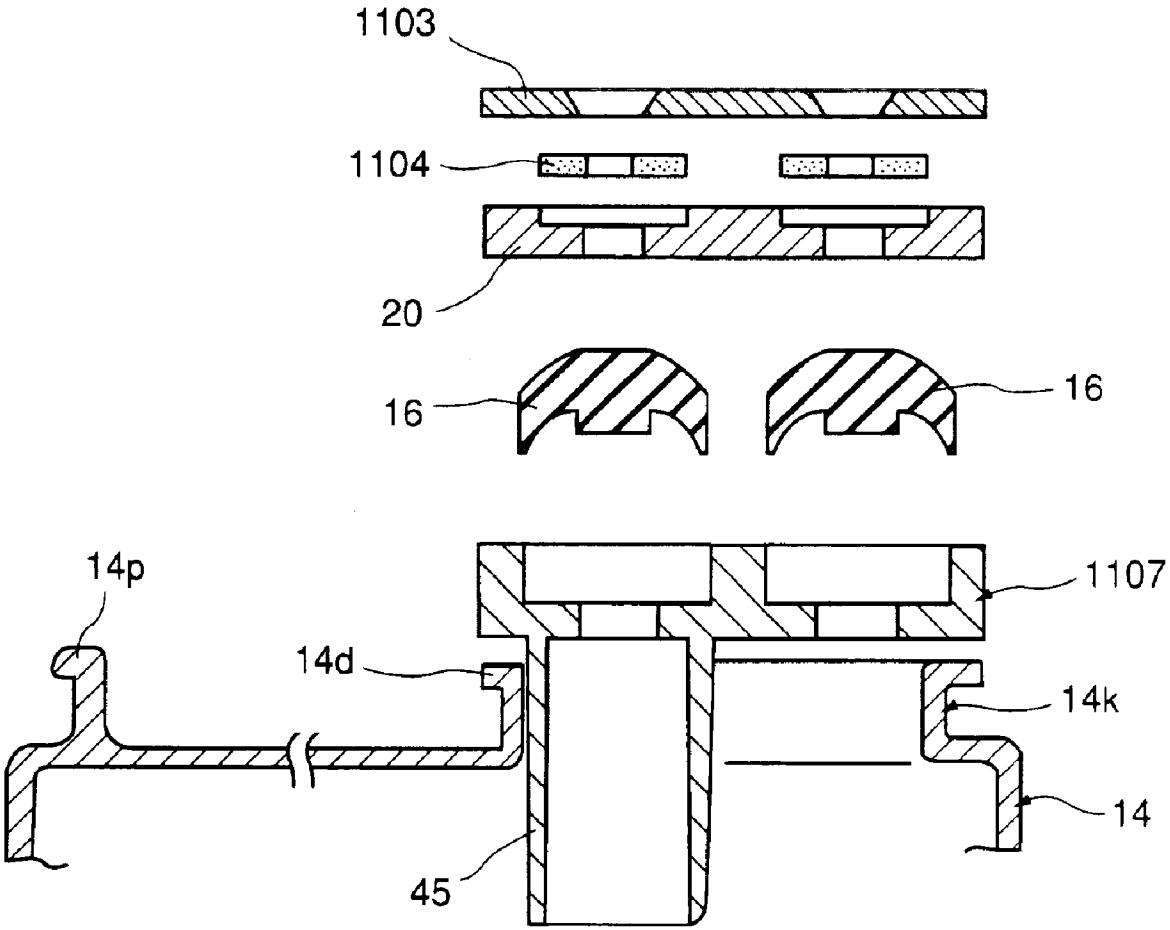
FIG. 8 is an enlarged, schematic, exploded, vertical, sectional view of the components of the mouth portion of the embodiment of the liquid container in accordance with the present invention, and the adjacencies of the mouth portion.

FIG. 8 is an enlarged, exploded, vertical sectional view of the mouth portion, and its adjacencies, of an embodiment of a liquid container in accordance with the present invention, which is positioned upside down so that the bottom wall 14*b* of the liquid storage portion 14 faces upward. It shows the various components of the mouth portion 14*k* and its adjacencies. These components are assembled in layers and are solidly attached to each other. The order in which these components are layered is virtually the same as the order in which they appear layered in FIG. 7, which is a vertical sectional view of the mouth portion 14*k* and its adjacencies after the assembly thereof. Next, the mouth portion 14*k* will be described in more detail with reference to FIG. 8.

Referring to FIGS. 4, 7, and 8, the problem that when a liquid container similar in design to the above described one is manufactured with the use of an ordinary blow molding method, the wall of the mouth portion 14*k* becomes thinner on the side close to the lengthwise end (close to short edge of bottom portion), can be drastically reduced by designing the mouth portion 14*k* so that its opening becomes narrower on the side close to the short edge of the bottom wall 14*b* (bottom portion) (FIG. 4).

Figure 44:
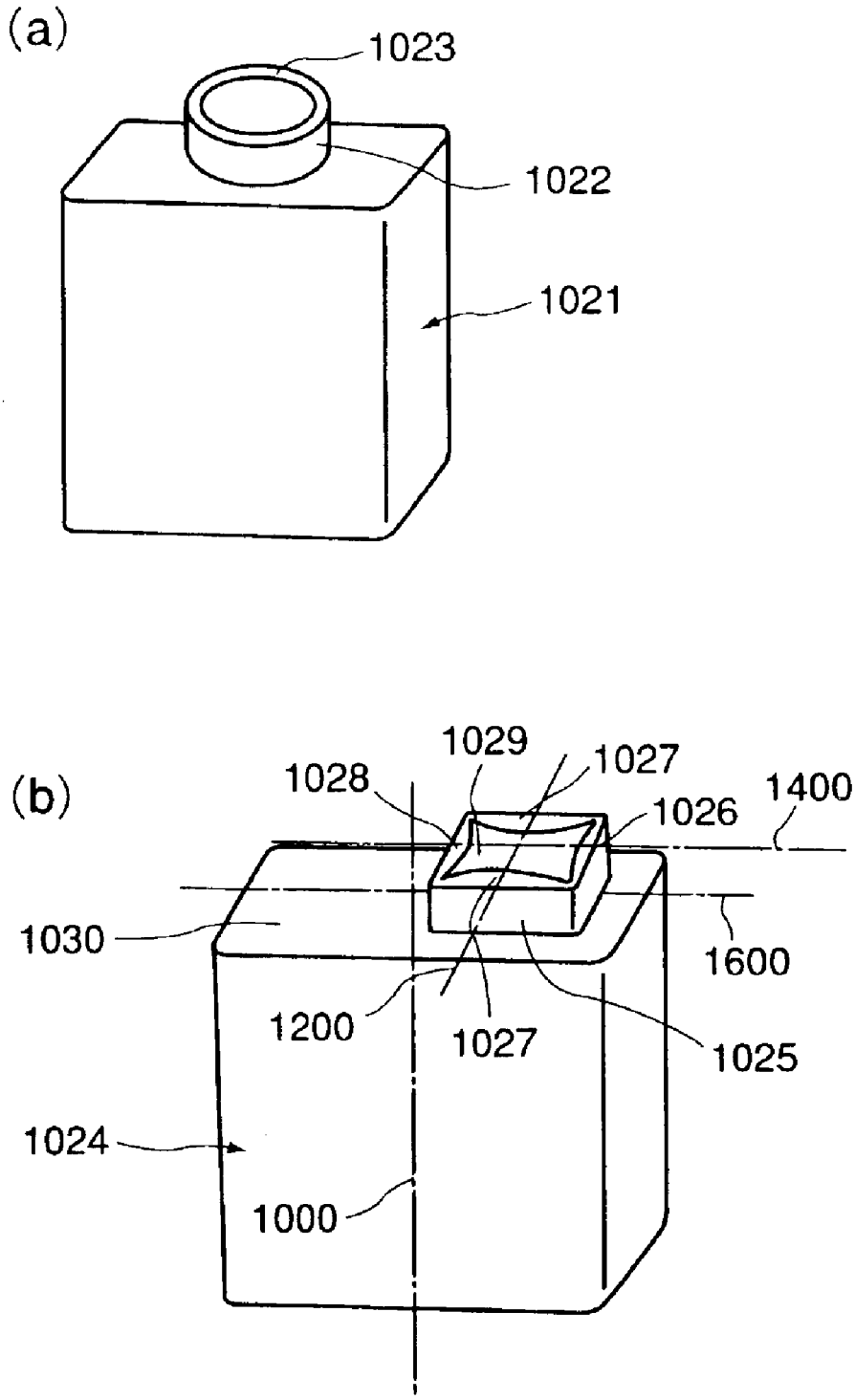
FIG. 44 is a schematic perspective view of two liquid containers different in the mouth portion, for describing the technical problems of a blow molded flat liquid container in accordance with the prior art.

With the prevention of the above described problem that the portion of the mouth portion 14*k* close to the short edge of the bottom wall 14*b* of the liquid storage portion 14 turns out to be thinner, the portion of the mouth portion 14*k* close to the short edge of the bottom wall 14*b* becomes equal in thickness to the portion of the mouth portion 14*k* on the plane 1000 side of the liquid storage portion 14; the mouth portion 14*k* becomes uniform in thickness in terms of circumferential direction. Further, designing the mouth portion 14*k* so that its opening becomes rounded (sufficiently large in radius) at four corners can prevent the problem that when the liquid container is manufactured with the use of an ordinary blow molding method, the mouth portion 14*k* becomes nonuniform in blow ratio. The prevention of this problem can eliminates the problem that when manufacturing the liquid container with the use of an ordinary blow molding method, the mouth portion 14*k* becomes constricted at the corners of its opening (for example, corner 1029 in FIG. 44(*b*)). Therefore, it is possible to assure that the liquid storage portion 14 of a liquid container manufactured with the use of an ordinary blow molding method has predetermined levels of strength and rigidity.

When the liquid storage portion 14 having the mouth portion 14*k* was structured as described above, the positional relationship between a parison and a metallic mold, and the uniformity of the thickness of each parison, did not have much effect on liquid container quality. In other words, it was possible to use an ordinary blow molding method to successfully manufacture a liquid container, the liquid storage portion 14 of which was uniform in terms of wall thickness, and the deviation of the liquid storage portion 14 of which in terms of internal dimension was negligible. More specifically, a predetermined number of single-piece flat parallelepipedic large liquid containers 11A, the size of which was approximately 40×70×100 mm, and a predetermined number of single-piece flat parallelepipedic small containers 11B, the size of which was approximately 20×70×100 mm, were manufactured by blow molding. The size of the opening of the mouth portion 14*k* of each liquid container was approximately 10×20 mm. The material for the liquid container was polypropylene of a blow grade (MFR=0.2 g/10 min). The molding cycle was 30 seconds, and the rate of extrusion was 20 kg/h. The resultant liquid containers were no more than 0.2 mm in terms of the variance in the wall thickness. In comparison, a liquid container in accordance with the prior art, the mouth portion of which was located in the middle of the bottom portion, was no less than 1.0 mm in terms of the wall thickness variance.

Further, this embodiment of a liquid container in accordance with the present invention (FIGS. 1–7) has the flange 14*k* which perpendicularly projects outward from the edge of the opening of the mouth portion 14. This flange 14*k* was provided for the following reason: If the liquid container 14 which is to be manufactured by direct blow molding, is designed so that the neck portion 14*e* (FIGS. 4 and 7) of the mouth portion 14*k* extends from the bottom wall 14*b* (bottom portion) to the plane of the opening of the mouth portion 14*k*, the neck portion 14*e* and/or bottom portion 14*b* of the liquid storage portion 14 sometimes collapses (caves in) due to the load generated during ultrasonic welding. Not only does this collapsing (designated by referential numerals 335, 337, and 339 in FIG. 45(*a*), for example) of the neck portion 14*e* and/or bottom portion 14*b* of the liquid storage portion 14 increases the amount by which ultrasonic energy is lost, but also, makes it impossible to precisely attach, by welding, the various components which will be described later.

As described above, according to this embodiment, it is possible to construct a compact mouth opening sealing mechanism, which does not require the container mounting portion (station base 31 in FIG. 5) to be widened in order to mount two or more liquid containers 11 side by side. More specifically, the provision of the flange 14*d*, which is similar in thickness to the neck portion 14*e* of the mouth portion 14*k*, increases the rigidity of the neck portion 14*e*, preventing therefore the problem that when attaching the members of the connective mechanism, which will be described later, to the liquid storage portion 14 and mouth portion 14*k* by ultrasonic welding, the liquid storage portion 14 and/or mouth portion 14*k* collapses. In other words, it is assured that these members can be easily welded by simply backing the liquid container by the back surface of the flange 14*d*, and also that during the welding process, power is not wasted and the liquid container does not deform.

Further, in this embodiment, the connective portion is welded to the mouth portion 14*k* in a manner of forming a butt joint, for the following reason. Even though the present invention improves the mouth portion 14*k* in terms of the accuracy of its internal dimension, it still leaves a slight error in the internal dimension of the mouth portion 14*k*. Therefore, in order to weld the connective portion to the mouth portion 14*k* in a manner to form a share joint so that the two sides are reliably welded to each other at the internal edges, it becomes necessary to correct the shapes of the corresponding components.

Figure 45:
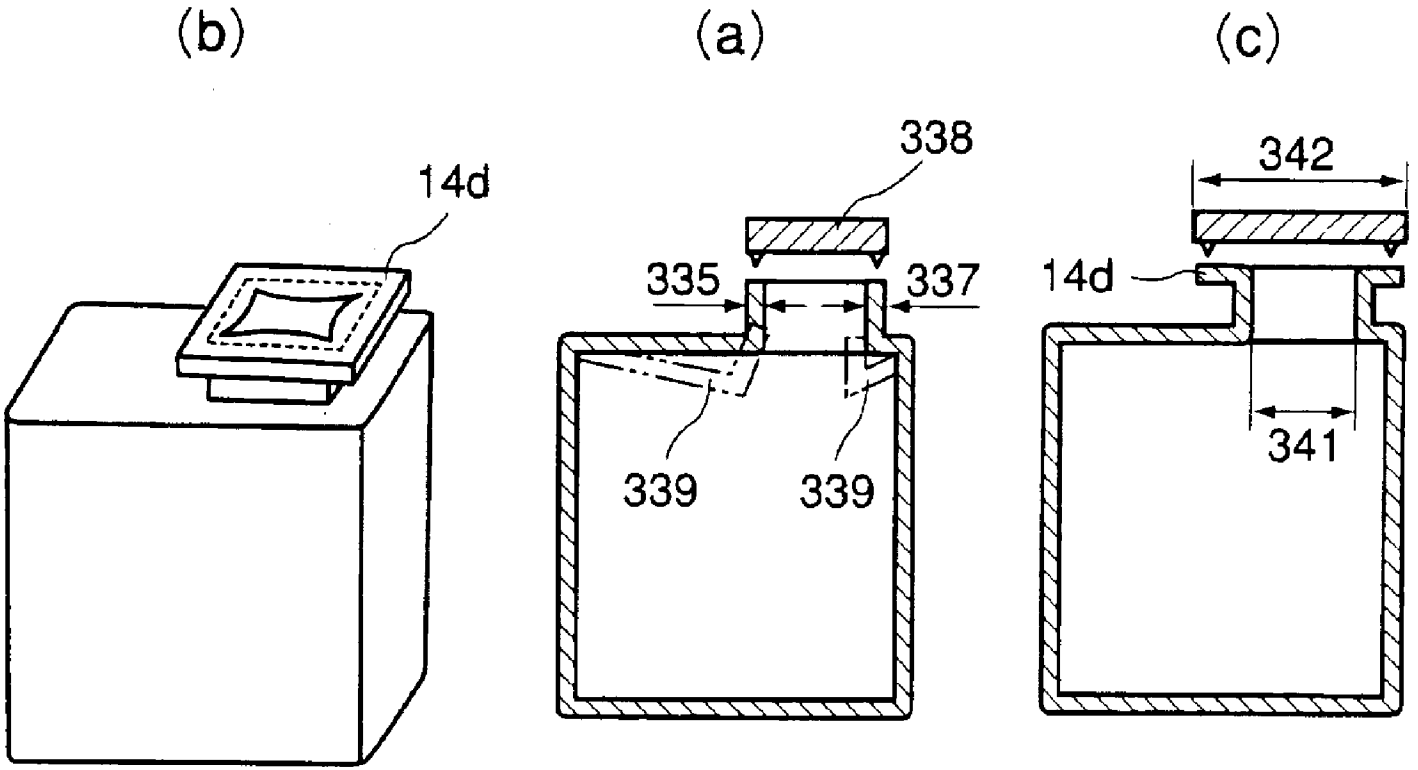
FIG. 45 is a schematic drawing of liquid containers, for describing the difference, in the manner in which layerable members are solidly fixed in layers using ultrasonic welding or the like, between a flat liquid container, the mouth portion of which has a flange, and a flat liquid container, the mouth portion of which does not have a flange, FIGS. 45(*a*), 45(*b*), and 45(*c*) being a schematic vertical sectional view of the center portion of the flat liquid container the mouth portion of which does not have a flange, a schematic perspective view of a problematic flat liquid container, and a schematic vertical sectional view of the center portion of the flat liquid container the mouth portion of which has a flange.

It has been a common practice to secure a welding overlap by folding the mouth portion 14*k* outward as the flanges 14*d* in FIGS. 45(*b*) and 45(*c*) have been folded. However, this method increases the size of the opening of the mouth portion 14*k* by the amount equal to the size of the folded portion of the mouth portion 14*k*, as described before regarding the prior art. As a result, the opening portion of the mouth portion 14*k* becomes too large for mounting two or more liquid containers side by side in the thickness direction of the flat liquid container (book-shaped rectangular parallelepipedic container); it becomes impossible to satisfactorily mount two or more liquid containers in an ink jet recording apparatus or the like, in a compact fashion.

Heretofore, the mouth portion 14*k* of the liquid container 11 in accordance with the present invention was described in detail. Hereinafter, the portions of the liquid container 11, other than the mouth portion 14*k*, will be described in detail.

Referring to FIG. 4, the liquid container 11 comprises: the liquid storage portion 14; bottom cover 21; and various members which make up the connective portion by being placed in the mouth portion 14*k* of the liquid storage portion 14. These various members which make up the connective portion attached to the mouth portion 14*k* are a housing 1107, a pair of elastic members 16, a first retaining member 20, a pair of absorbent members 1104, a second fixing member 1103, a storage medium holder case 1502, a storage medium holder 17, a storage medium 18, a two-sided adhesive tape 19, etc. The absorbent members 1104 is a member through which connective members (hollow needles or the like) are put from the outside.

Figure 9:
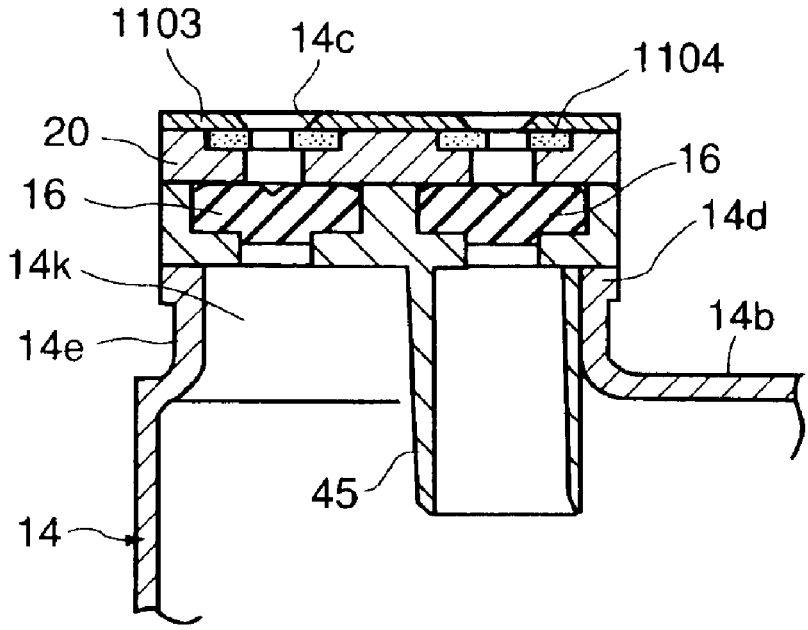
FIG. 9 is a schematic, vertical, sectional view of the mouth portion of the first embodiment of a liquid container in accordance with the present invention.
Figure 10:
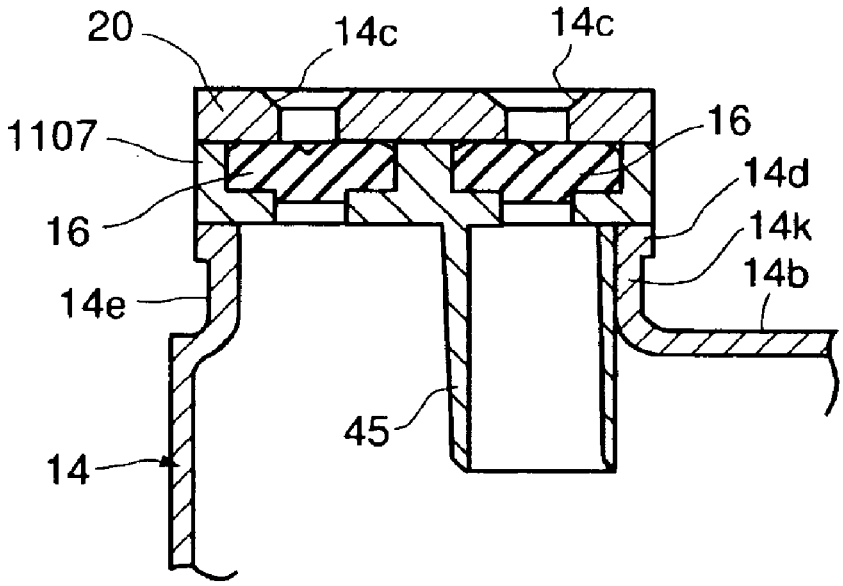
FIG. 10 is a schematic, vertical, sectional view of the mouth portion of the second embodiment of a liquid container in accordance with the present invention.
Figure 11:
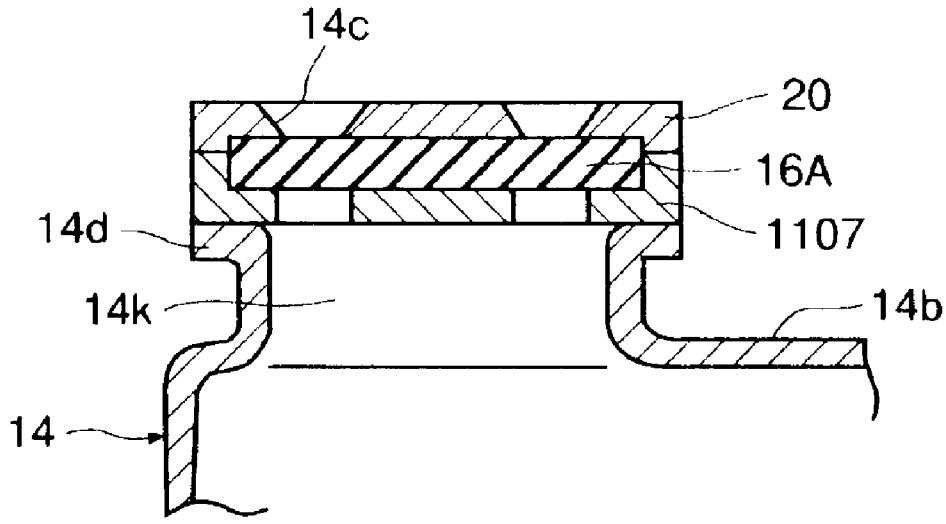
FIG. 11 is a schematic, vertical, sectional view of the mouth portion of the third embodiment of a liquid container in accordance with the present invention.
Figure 12:
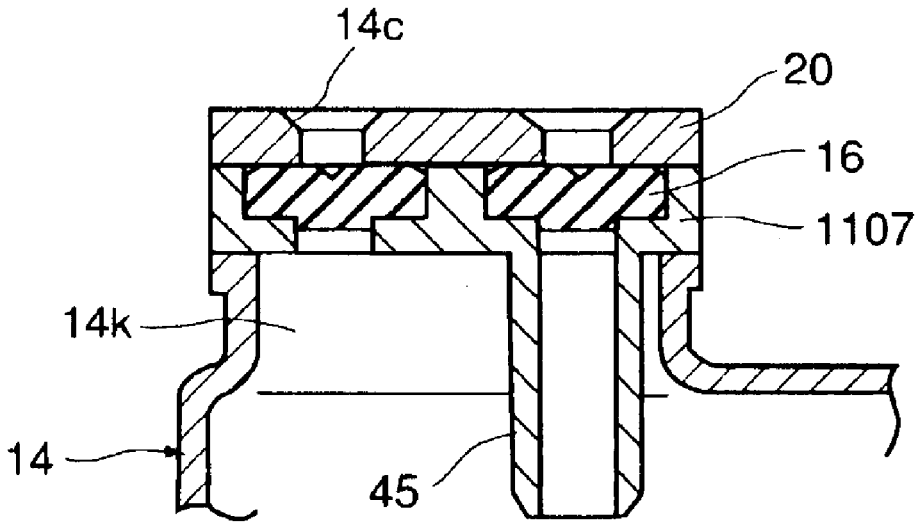
FIG. 12 is a schematic, vertical, sectional view of the mouth portion of the fourth embodiment of a liquid container in accordance with the present invention.
Figure 13:
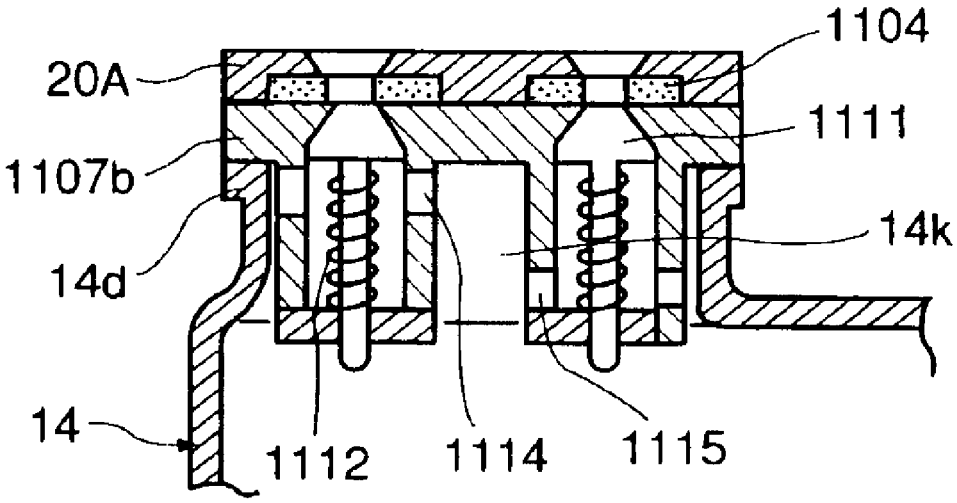
FIG. 13 is a schematic, vertical, sectional view of the mouth portion of the fifth embodiment of a liquid container in accordance with the present invention.
Figure 14:
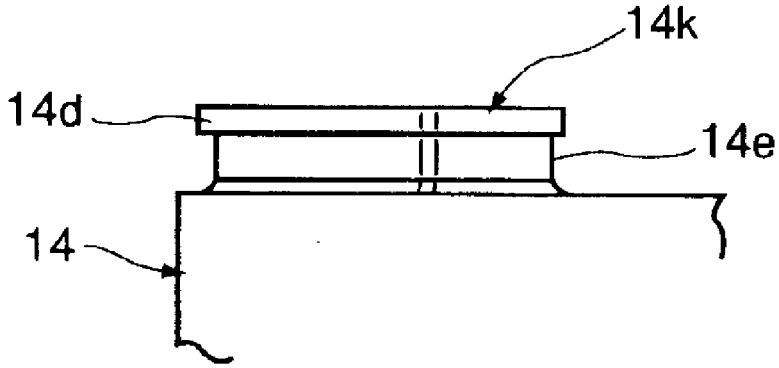
FIG. 14 is a schematic side view of the mouth portion of the liquid storage portion of the liquid container in accordance with the present invention, prior to the laminar attachment of the layerable members to the mouth portion.

FIGS. 9–13 show various structures for the mouth portion 14*k*, and its adjacencies, of the liquid container 11 in accordance with the present invention (connective portion attached to mouth portion 14*k*). FIG. 10 is a vertical sectional view of the mouth portion, and its adjacencies, of the first embodiment of a liquid container in accordance with the present invention, and FIG. 11 is a vertical sectional view of the mouth portion, and its adjacencies, of the second embodiment of a liquid container in accordance with the present invention. FIG. 12 is a vertical sectional view of the mouth portion, and its adjacencies, of the third embodiment of a liquid container in accordance with the present invention, and FIG. 13 is a vertical sectional view of the mouth portion, and its adjacencies, of the fourth embodiment of a liquid container in accordance with the present invention. FIG. 14 is a vertical sectional view of the mouth portion, and its adjacencies, of the fifth embodiment of a liquid container in accordance with the present invention.

Next, referring to FIGS. 9–13, various examples of the structure of the adjacencies (connective portion attached to mouth portion 14*k*) of the liquid container 11 in accordance with the present invention, which connects the internal space of the liquid container 11 to the outside, will be described. The mouth portion 14*k* in first embodiment shown in FIG. 9 is virtually identical in structure to the mouth portion 14*k* of above described example (FIGS. 1–8) of a liquid container 11 in accordance with the present invention.

Referring to FIG. 9, the liquid storage portion 14 has a neck portion 14*e*, which projects from the bottom portion 14*b* of the liquid storage portion 14. The neck portion 14*e* is provided with a flange 14*d*, which is attached to the end of the neck portion 14*e* to make the neck portion 14*e* more rigid. The flange 14*d* slightly projects outward from the neck portion 14*e* in parallel to the bottom wall 14*b*. To this flange 14*d*, various members, which make up the connective portion (which opens or shuts liquid container), are attached in layers by ultrasonic welding. More specifically, the housing 1107 as the first layer is directly fixed to the surface of the flange 14*d* by ultrasonic welding. Then, a pair of elastic members 16 (rubbery elastic members) are fitted into a pair of the recesses of the housing 1107, one for one. Then, the first retaining member 20 as the second layer is fixed to the surface of the housing 1107 by ultrasonic welding. With the fixing of the first retaining member 20, the elastic members 16 are retained in the housing 1107, being slightly compressed.

Next, a pair of the absorbent members 1104 (members capable of absorbing leaked liquid or adhered liquid) are placed one for one in a pair of the recesses of the first retaining member 20. Then, the second retaining member 1103 as the third layerable member is fixed to the surface of the first retaining member 20 (second layerable layer). The second retaining member 1103 has a pair of guiding portions 14*c* (portions for guiding needles to openings) for guiding a pair of hollow connective needles 38 and 39 (FIG. 6). The positions of the pair of guiding portions 14*c* correspond one for one to those of the pair of absorbent members 1104. Further, the housing 1107 has a tubular member 45, which projects inward of the liquid storage portion 14 from the back surface of the housing 1107.

The second embodiment of the connective portion shown in FIG. 10 is what will result as the second retaining member 1103 (third layerable member) and absorbent members 1104 are eliminated and the first retaining member 20 (second layerable member) is modified in structure (shape) (in particular, needle path location). More specifically, the first retaining member 20 has the connective needle paths with the needle guiding portion 14*c*. Otherwise, the structure of the second embodiment is practically the same as that of the first embodiment. Compared to the structural arrangement in the first embodiment, the structural arrangement in this embodiment makes it possible to eliminate the absorbent members 1104 and second retaining member 1103, which in turn makes it possible to eliminate the process for fixing the second retaining member 1103 by ultrasonic welding.

The third embodiment of the connective portion shown in FIG. 11 is a modification of the second embodiment shown in FIG. 10. More specifically, the tubular portion 45 of the housing 1107 of the second embodiment was eliminated, and the pair of elastic members 16 were replaced with a single large elastic member 16A. Further, the connective needle insertion holes of the first retaining member 20 (second layerable member) was changed in shape. Otherwise, the structural arrangement of the third embodiment is practically the same as that of the second embodiment. The third embodiment makes it possible to further reduce component count.

The fourth embodiment of the connective portion shown in FIG. 12 is practically the same as the second embodiment shown in FIG. 10, except that there is a relatively large gap between the internal surface of the mouth portion 14*k* and the peripheral surface of the tubular member of the housing 1107. This gap was created by changing the shape of the tubular portion 45 (reducing external diameter). Otherwise, the structural arrangement of this embodiment is practically the same as that of the second embodiment.

The fifth embodiment of the connective portion shown in FIG. 13 is a modification of the first embodiment shown in FIG. 9; the elastic members 16 shown in FIG. 9 were replaced with a pair of rubbery valves.

Referring to FIG. 13, the neck portion 14*e* projects from the bottom portion 14*b* of the liquid storage portion 14, and the flange 14*d* perpendicularly projects outward from the lip portion of the neck portion 14*e*. The connective portion has a housing 1107*b* (valve box) as the first layerable member, which is fixed to the surface of the flange 14*d* by ultrasonic welding. The housing 1107*b* has a pair of valve chambers, each of which contains a mushroom-shaped valve 1111, which is kept pressed by a coil spring 1112 in the opening direction. The valve chamber for drawing liquid has a liquid path 1114 (ink path), whereas the valve chamber for introducing the ambient air has an ambient air path 1115. The connective portion further comprises a pair of absorbent members 1104, and a first retaining member 20A (second layerable member) having a pair of recesses for accurately positioning the pair of absorbent members 1104. The pair of absorbent members 1104 are placed in the recesses of the first retaining member 20A, which is fixed to the surface of the housing 1107*a* by ultrasonic welding, holding the absorbent members to the surface of the housing 1107*b* so that the positions of the absorbent members correspond one for one to those of the liquid and ambient air paths.

According to the structural arrangements for the connective portion described with reference to FIGS. 9–13, the housing 1107 (1107*b*) having the pair of through holes, and the first retaining member 20 having the pair of through holes, and the second retaining member 1108, are fixed in layers to the surface of the mouth portion 14*k* to retain the elastic members 16, which are formed of rubbery elastic substance to allow the two connective needles 38 and 39 to penetrate the elastic members 16, as well as the absorbent members 1104 if necessary, by sandwiching them. Therefore, the internal space of the liquid container 11 can be connected to the outside (to enable liquid therein to be drawn from liquid container, and ambient air to be introduced into liquid container) simply by penetrating (stabbing through) the two elastic members 16 of the connective portion by the two connective needles 38 and 39, one for one.

Further, the first retaining member 20 is fixed to the housing 1107 by ultrasonic welding in such a manner that the elastic members 16 are compressed by the back surface of the first retaining member. Similarly, the donut-shaped absorbent members 1104 are disposed so that their positions correspond one for one to those of the elastic members 16, and the second retaining member 1103 is fixed to the first retaining member by ultrasonic welding so that the second retaining member 1103 functions as a retainer lid for the absorbent members 1104. Further, the second retaining member 1103 (or first retaining member 20) has the pair of guiding portions 14*c* (connective needle guiding portions) for guiding the connective needles 38 and 39 when the needles 38 and 39 are inserted to extract the liquid in the liquid container, and to allow the ambient air to enter the liquid container 11.

Next, referring to FIGS. 14–18, a method for fixing in layers the structural components of the connective portion by ultrasonic welding, without expanding the liquid container 11 in the direction (thickness direction) in which it is stacked, when assembling in layers (manufacturing) the components of the connective portion.

Figure 15:
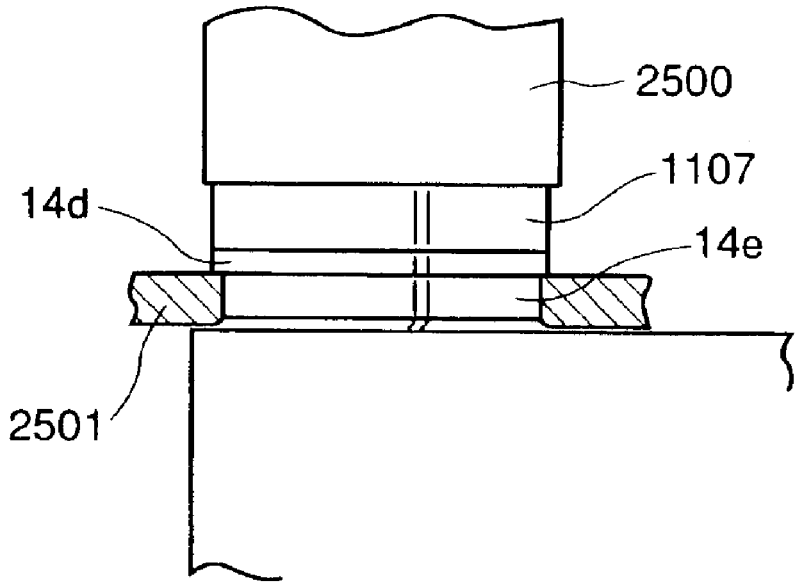
FIG. 15 is a schematic side view of the mouth portion of the liquid storage portion shown in FIG. 14, while the housing as the first layerable member is welded to the flange of the mouth portion.

FIG. 14 is a schematic side view of the mouth portion 14*k* before the fixing of the components of the connective portion to the mouth portion 14*k*, and FIG. 15 is a schematic side view of the mouth portion 14*k*, and the housing 1107 as the first layerable member, while the housing member 1107 is welded to the flange 14*d* of the mouth portion 14*k* with the use of an ultrasonic welding horn 2500. During this ultrasonic welding process, the pressure generated by ultrasonic welding is borne through the flange 14*d* of the mouth portion 14 by a flange backing jig 2501 placed in contact with the back surface of the flange 14*d*.

Figure 16:
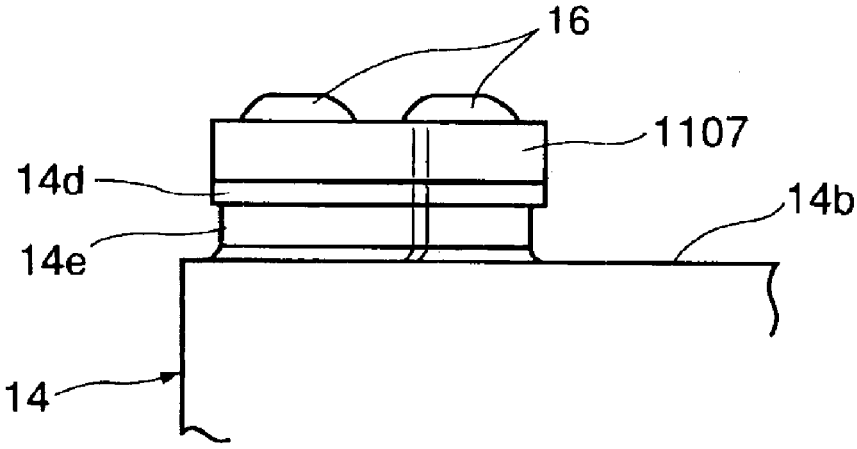
FIG. 16 is a schematic side view of the mouth portion of the liquid storage portion shown in FIG. 14, after the placement of the elastic members in the housing welded to the mouth portion.
Figure 17:
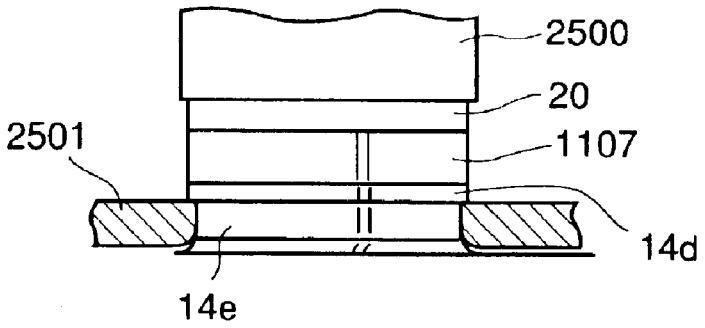
FIG. 17 is a schematic side view of the mouth portion of the liquid storage portion, while the first retaining member is welded to the surface of the housing by ultrasonic welding after the placement of the elastic members shown in FIG. 16.

FIG. 16 is a schematic side view of the welded housing 1107, and the elastic member 16, after the mounting of the elastic member 16 into the housing 1107 (recess of housing), and FIG. 17 is a schematic side view of the welded housing 1107, elastic member 16, and first retaining member 20 (second layerable member), while the first retaining member 20 is welded to the surface of the housing in the state shown in FIG. 16, with the use of the ultrasonic welding horn 2500. Also during this ultrasonic welding process, the pressure from ultrasonic welding is borne by the flange backing jig 2501, which is placed in contact with the back side of the flange 14*d* of the mouth portion 14*k*.

Figure 18:
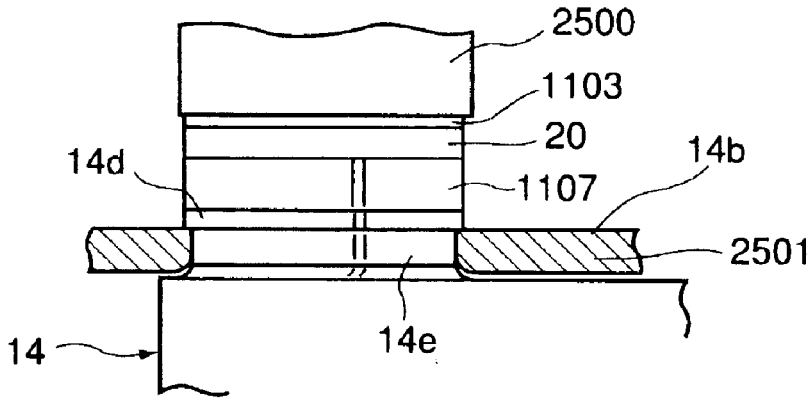
FIG. 18 is a schematic side view of the mouth portion of the liquid storage portion, while the second retaining member is welded to the surface of the first retaining member by ultrasonic welding after the fixation of the first retaining member.

FIG. 18 is a schematic side view of the partially assembled portion of the connective portion, while the second retaining member (third layerable member) is welded to the surface of the first retaining member 20 with the use of the ultrasonic welding horn 2500 after the first retaining member 20 (second layerable member) was solidly fixed to the surface of the welded housing 1107 (first layerable member) by welding. Also during this process for attaching this second retaining member 1103 by ultrasonic welding, the pressure from ultrasonic welding is borne by the flange backing jig 2501 placed in contact with the back side of the flange 14*d* of the mouth portion 14*k*.

In the case of the embodiments depicted in FIGS. 14–18, the height (thickness) of the first layerable member 1107 (member for housing elastic members 16) directly fixed to the flange 14*d* integrally molded with the liquid storage portion 14, was 4 mm. The height (thickness) of the second layerable member 20 (first retaining member) fixed to the surface of the housing 1107 solidly fixed by welding was 3 mm. This second layerable member 20 is a member which functions as a lid for encapsulating the elastic members 16.

The height (thickness) of the second retaining member 1103 as the third layerable member to be attached last of the layers was 1 mm. This third layerable member 1103 is a member which functions as a lid for retaining the absorbent members 1104.

The layerable members 1107, 20, and 1103 are directly or indirectly attached in layers to the surface of the flange 14*d* of the mouth portion 14, with the elastic members 16 placed between the first and second layerable members 1107 and 20, and the absorbent members 1104 placed between the second and third layerable members 20 and 1103.

More specifically, in the connective portion assembled on the surface of the flange 14*d* of the liquid container 11 in accordance with the present invention, the housing 1107 as the first layerable member was rendered thicker than the flange 14*d*, and the first retaining member 20 as the second layerable member was rendered thinner than the first layerable member 1107. Further, the second retaining member 1103 as the third layerable member was rendered thinner than the second layerable member 20. In other words, the layerable layers 1107, 20, and 1103 were made so that the farther from the surface of the flange 14*d*, the thinner they were. With the provision of this structural arrangement, it became possible to reliably attach in layers to the flange 14*d* of the mouth portion 14, the housing 1107 as the first layerable member, the second layerable member 20 (first retaining member) to be placed straight above the welding seam between the mouth portion 14*k* of the blow-molded liquid storage portion 14 and the housing 1107, and the third layerable member 1103 (second retaining member) to be placed straight above the second layerable member 20, by ultrasonic welding, without damaging the welding seam between the mouth portion 14 and housing 1107.

In the case of this embodiment of a liquid container in accordance with the present invention, polypropylene was used as the material for the liquid storage portion 14 and various layerable members. Thus, the various layerable members were reliably welded with the use of 200–400 J of energy generated by an ultrasonic welding machine, which was 20 kHz in frequency and 1 kW in ultrasonic wave output. In other words, it was possible to reliably prevent the problem of the prior art, that is, the problem that the liquid storage portion of a liquid container failed to be satisfactorily sealed or remain sealed, in spite of the application of the maximum output of an ultrasonic welding machine, changes in load, changes in the ultrasonic wave duration, etc.

The studies made under various conditions revealed that as long as the various layerable members are formed of the resinous substances of the same type, all that is necessary is to assure that the distance (which hereinafter may be referred to as welding distance) from the ultrasonic welding horn 2500 to the welding seams formed during the preceding welding processes is no less than twice the distance from the ultrasonic horn 2500 to the welding seam to be formed next. According to this embodiment, the later a member is placed in the order in which the various members are solidly fixed in layers, the thinner the member, and therefore, the smaller the amount of the ultrasonic energy required to weld the member. For example, the welding distance of the second layerable member (first retaining member 20) is 3 mm, and the distance between the second layerable member 20 to the welding seam, which was formed during the immediately preceding welding process, and which must not be damaged by the following welding process, is: $(3+4)$ mm$>(3\times2)$ mm, which is sufficient to prevent damage to the preceding welding seams. In other words, it is essential to divide the connective portions into such layerable components that do not damage the welding seam formed in the preceding ultrasonic welding processes while the donut-shaped retaining members (layerable components) are sequentially attached in layers by welding. With the provision of this structural arrangement, it is assured that all the layerable components of the connective portion are solidly and sequentially fixed by ultrasonic welding, by backing the partially assembled portion of the connective portion by the back side of the flange 14*d* projecting slightly from the lip portion of the neck portion 14*e*, no matter which layerable component is to be solidly fixed in layers by ultrasonic welding.

In other words, when the layerable members are designed so that the closer to the mouth portion 14*k* the thicker the layerable members, not only is it assured that energy is concentrated to a sharp horn (which is called energy director) placed in contact with the seam at which layerable components are to be welded, but also, the ultrasonic welding energy attenuates as it propagates through the resin. Therefore, as long as the distance to the welding seams formed by the preceding welding processes is no less than twice the welding distance, the welding seams formed by the preceding welding processes are not damaged even if layerable members are attached in layers by ultrasonic welding.

If ultrasonic welding energy is applied by an amount greater than necessary, the amount of the energy unconsumed by welding propagates to the welded seams formed by the preceding welding processes, and damages them. Therefore, this problem should be considered seriously.

In other words, the layerable members can be reliably and accurately attached in layers with the use of ultrasonic welding, by designing the liquid container 11 so that the distance from the ultrasonic welding horn 2500 to the welding seam, and the distance from the ultrasonic welding horn 2500 to the welding seams formed by the preceding welding processes, fall within predetermined ranges, respectively, in consideration of the facts described with reference to FIGS. 14–18.

With regard to the various structural arrangements of connective portion placed in the adjacencies of the mouth portion 14*k*, which were described with reference to FIGS. 9–13, the third embodiment of the liquid container 11 comprises two layerable members: the housing 1107 and a single retaining member 20 (first retaining member); the structural arrangement shown in FIG. 11 does not necessarily require the neck portion 14*e* to be supported from the internal wall side.

Similarly, the fourth embodiment of the liquid container shown in FIG. 12 does not require the internal wall support for the neck portion 14*e*. However, the liquid container 11 is structured so that a gap is provided between the tubular portions for detecting that the amount of the liquid remaining in the liquid storage portion 14 has become very small, and the internal wall of the neck portion 14*e*. In comparison, the second embodiment shown in FIG. 10 is structured so that the tubular portion 45 of the housing 1107 supports the neck portion 14*e* from inward side of the neck portion 14*e*.

Further, the fifth embodiment of the liquid container shown in FIG. 13 is substantially different from the various preceding embodiments in that it has such a connective portion that comprises the valves 1111 formed of elastic substance, and the housing 1107*b*, the portions of which function as valve seats.

Referring to FIGS. 4, 6, and 7, the hollow liquid drawing connective needle 38 and hollow air introducing connective needles 39 are inserted into the liquid storage portion 14 of the thus structured liquid container, through the first connective opening 27, the hole closer to the short edge of the bottom portion 14*b*, and the second connective opening 28, the hole closer to the center of the bottom portion 14*b*, respectively, and corresponding absorbent members 1104 and elastic members 16, one for one. The connective needles 38 and 39 have holes 38*a* and 39*a*, respectively, which are located close to their tips to connect the hollows of the needles 38 and 39 to the liquid storage portion 14. With the penetration of the connective portion of the liquid container by the needles 38 and 39, it becomes possible for the liquid (ink or the like) to be drawn out of the liquid storage portion 14, while introducing the ambient air into the liquid storage portion 14.

Heretofore, the adjacencies of the mouth portion 14*k* of the liquid storage portion 14 were described in detail regarding their structures. In the case of the first embodiment of the present invention shown by FIGS. 1–7, the bottom side (bottom portion 14*b*) of the liquid storage portion 14 has a bottom cover 21, which is removably attached to the liquid storage portion 14 with the use of three retaining portions (coupling mechanisms) 1701, 1702, and 1703 (FIG. 7) in the form of a snap. More specifically, this bottom cover 21 has three retaining portions 1701, 1702, and 1703 in the form of a snap, which are engaged with the catches 14P (two) of the flange 14*d* of the mouth portion 14*k* of the bottom portion 14*b* of the liquid storage portion 14 and the catch 14P (one) of the bottom portion 14*b*, to fasten the bottom cover 21 to the liquid storage portion 14, as shown in FIGS. 4 and 7.

The bottom cover 21 is for covering the adjacencies of the mouth portion 14*k*, which make up the above described connective portion, and also, for holding a storage medium 18 for electrically storing and identifying the chemical properties, such as surface tension, of the liquid in the liquid container, the physical data, such as amount, of the liquid in the liquid container, etc.

Further, the bottom cover 21 has a pair of liquid container ID portions 22 and 23 for mechanically identifying the type of the liquid container 11, which are at the lengthwise ends, one for one. As this bottom cover 21 is engaged with the liquid storage portion 14, the aforementioned connective portion, and the structural members for holding the storage medium 18, are held to the bottom portion 14*b* of the liquid storage portion 14. Referring again to FIGS. 4 and 7, the storage medium 18 is solidly fixed to an electrical wiring substrate 26 by soldering or the like, and the electrical wiring substrate 26 is solidly fixed to a storage medium holder 17 with the use of a two-sided adhesive tape 19. The storage medium holder 17 is held within the storage medium holder case 1502, which is held in the aforementioned bottom cover 21.

Figure 40:
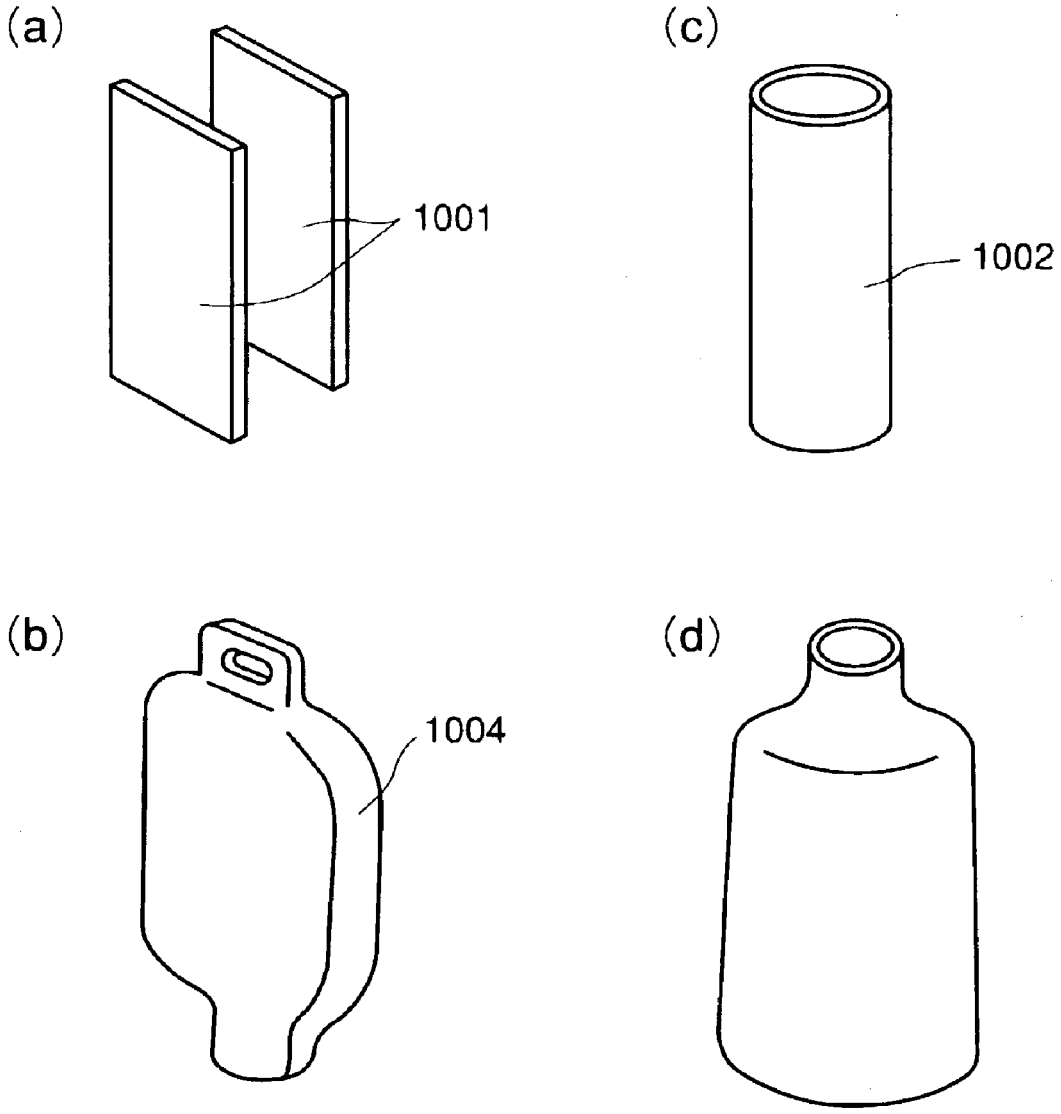
FIG. 40 is a schematic perspective drawing of the flat parison and cylindrical parison, for describing the technical problems from which a liquid container based on the prior art suffers.
Figure 41:
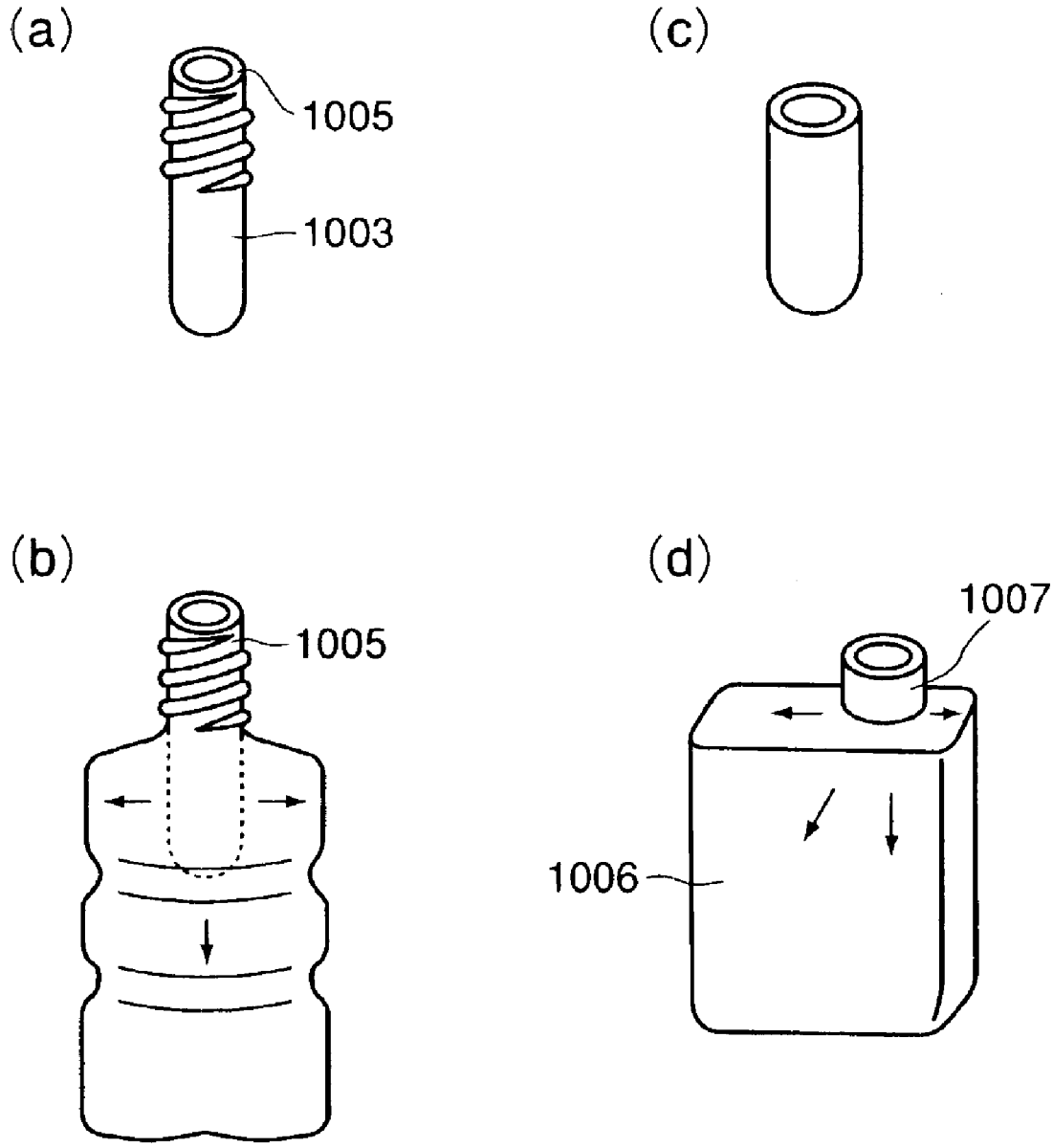
FIG. 41 is a schematic perspective drawing for describing the technical problems which occur when attaching the preform of the mouth portion to the liquid storage portion.
Figure 42:
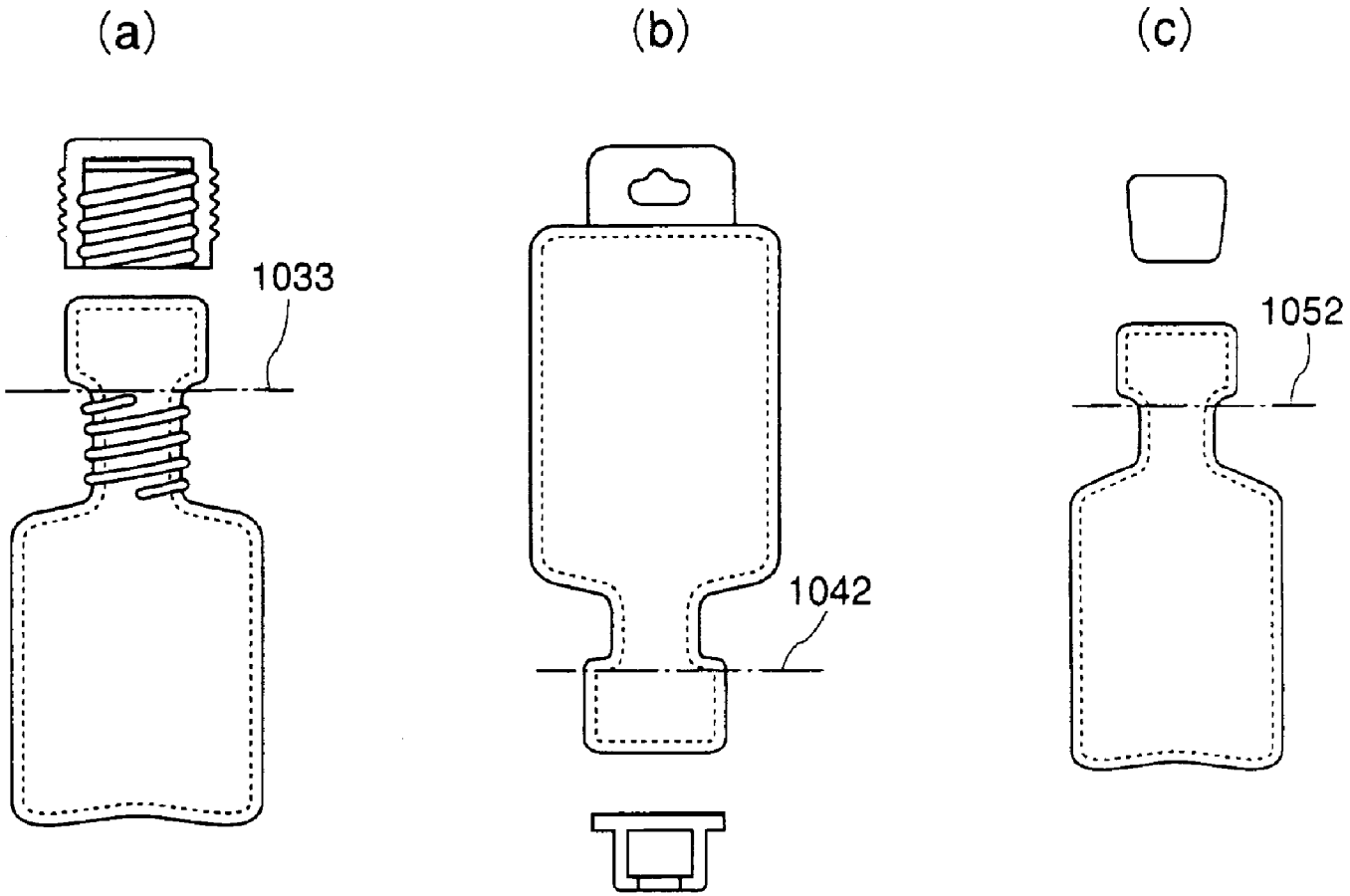
FIGS. 42(*a*), 42(*b*), and 42(*c*) are partially broken and partially sectional views of three liquid containers, one for one, for describing the technical problems which occur when processing the mouth portion of a liquid container based on the prior art.
Figure 43:
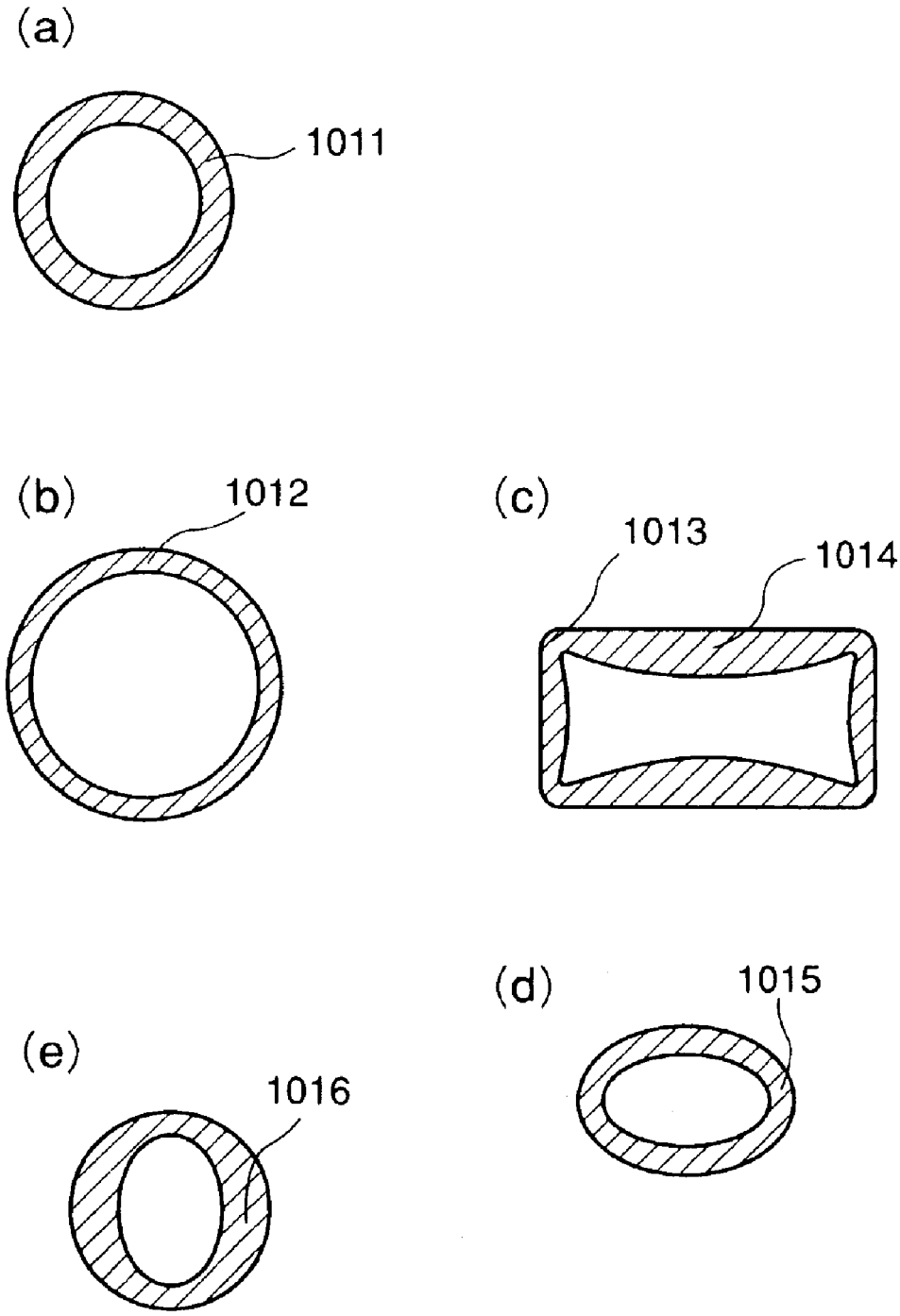
FIGS. 43(*a*), 43(*b*), and 43(*c*) are cross sectional drawings for describing the technical problems, that is, the nonuniformity in the wall thickness, of a blow molded flat liquid container in accordance with the prior art, and FIGS. 43(*d*) and 43(*e*) depict early attempts at solving those technical problems.

The bottom cover 21 has capillary grooves 40 (FIG. 40), which are cut in the internal surface of the storage medium holder case 1502, for the following reason. That is, there is a possibility that liquid travels from the bottom portion 14*b* of the liquid container 11, by way of the external surface of the liquid container, and enters the storage medium holder 17. Thus, the storage medium holder 17 is stored in the storage medium holder case 1502; in other words, the means for holding the storage medium 18 is structured in two layers. With the provision of this two-layer structure, the liquid, which has traveled to the edge of the opening of the storage medium holder case 1502, is guided by the capillary grooves 40 into the space between the storage medium holder 17 and the internal surface of the storage medium holder case 1502, being thereby prevented from entering the storage medium holder 17.

While liquid containers are distributed to customers after their manufacture, while they are displayed in stores, or while they are mounted in such apparatuses as ink jet recording apparatuses after being taken out of their sealed packages, they are sometimes dropped or subjected to shocks, which sometimes results in damage to the welding seams in the adjacencies of the mouth portion 14*k*, and/or deformation of the adjacencies of the welding seams. This damage to the welding seams allows the ink to leak, and the deformation of the adjacencies of the welding seams makes it difficult or virtually impossible for the liquid containers to be mounted into the apparatuses. In order to prevent this kind of problem, an embodiment of a liquid container in accordance with the present invention is structured in the following fashion.

Figure 23:
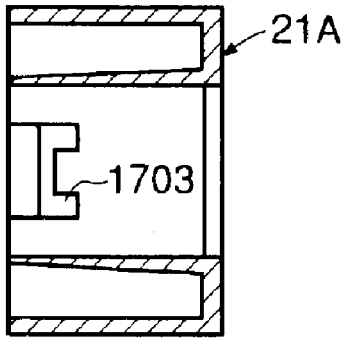
FIG. 23 is a schematic vertical sectional view of the bottom cover of the liquid container shown in FIG. 2, at the plane represented by Line 23—23 in FIG. 19.
Figure 24:
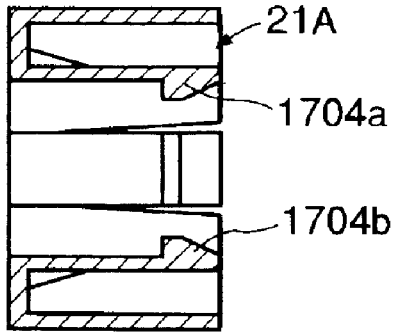
FIG. 24 is a schematic vertical sectional view of the bottom cover of the liquid container shown in FIG. 2, at the plane represented by Line 24—24 in FIG. 19.
Figure 25:
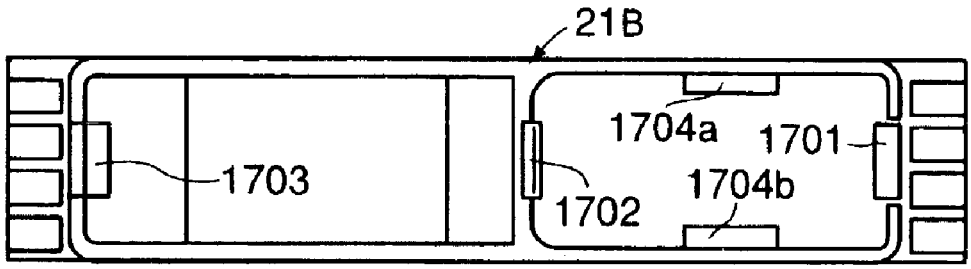
FIG. 25 is a schematic plan view of the bottom cover of the liquid container shown in FIG. 3.
Figure 26:
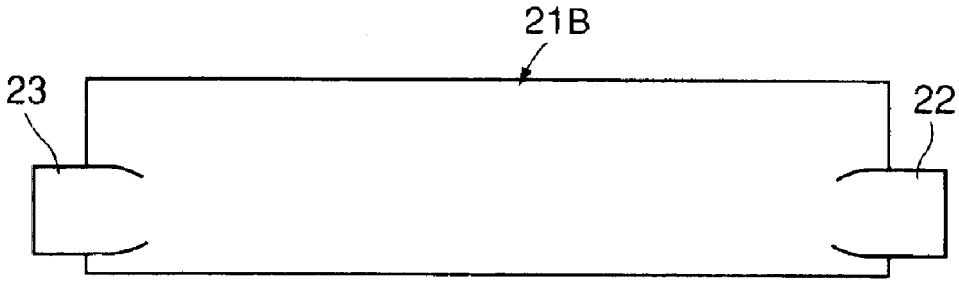
FIG. 26 is a schematic side view of the bottom cover of the liquid container shown in FIG. 3.
Figure 27:
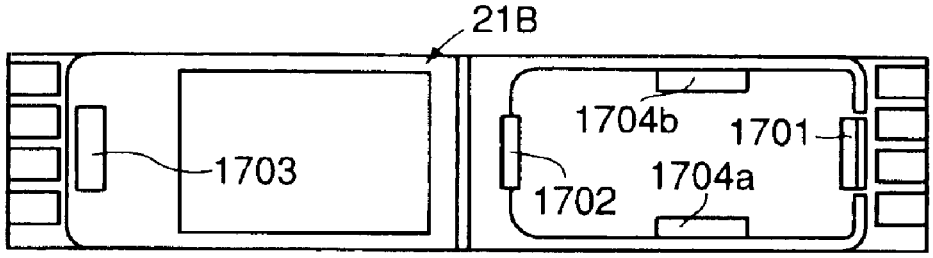
FIG. 27 is a schematic bottom view of the bottom cover of the liquid container shown in FIG. 3.

FIGS. 19–27 are schematic drawings of the bottom cover 21 of the liquid container 11. FIGS. 19–24 show the bottom cover 21A of the large liquid container 11A, and FIGS. 25–27 show the bottom cover 21B of the small liquid container 11B.

Figure 19:
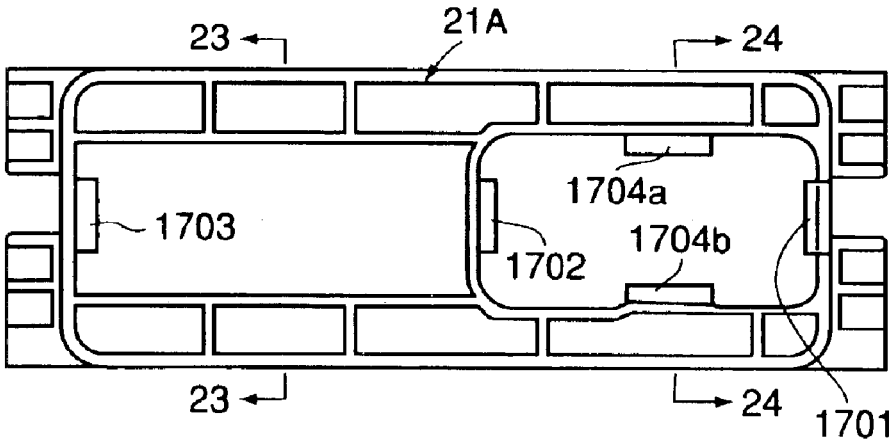
FIG. 19 is a schematic plan view of the bottom cover of the liquid container shown in FIG. 2.
Figure 20:
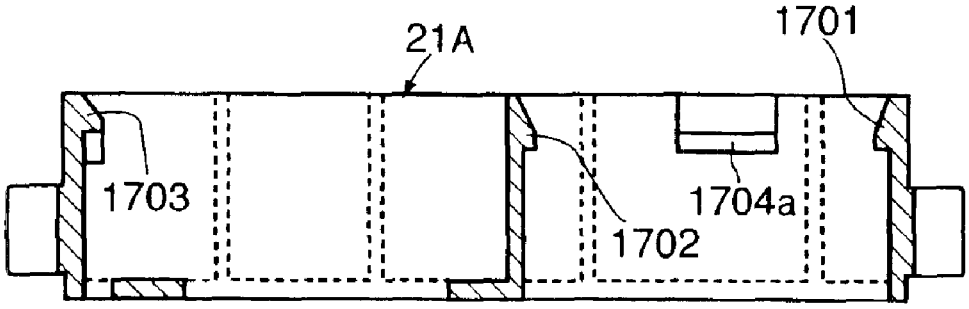
FIG. 20 is a schematic vertical section of the center portion of the bottom cover of the liquid container shown in FIG. 2.
Figure 21:
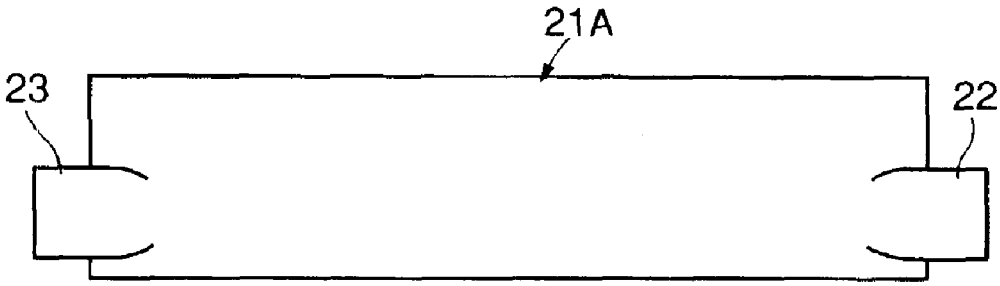
FIG. 21 is a schematic side view of the bottom cover of the liquid container shown in FIG. 2.
Figure 22:
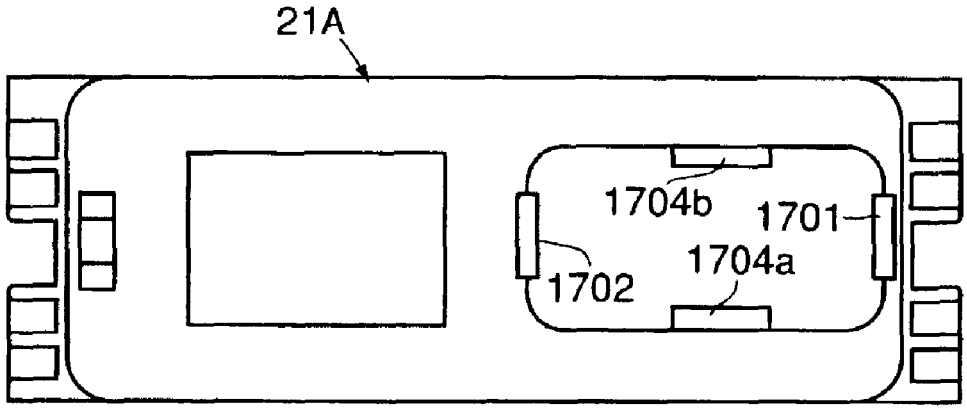
FIG. 22 is a schematic bottom view of the bottom cover of the liquid container shown in FIG. 2.

FIG. 19 is a plan view of the bottom cover 21A, and FIG. 20 is a vertical sectional view of the bottom cover 21A, at the plane which is parallel to the largest walls of the liquid container 11A, and which horizontally halves the bottom cover 21A. FIG. 21 is a side view of the bottom cover 21A, and FIG. 22 is a bottom view of the bottom cover 21A. FIG. 23 is a vertical, cross sectional view of the bottom cover 21A, at Line 23—23 in FIG. 19, and FIG. 24 is a vertical, cross sectional view of the bottom cover 21A, at Line 24—24 in FIG. 19. FIG. 25 is a plan view of the bottom cover 21B, and FIG. 26 is a side view of the bottom cover 21B. FIG. 27 is a bottom view of the bottom cover 21B.

Referring to FIGS. 19–27, the bottom cover 21 (21A, 21B) is structured so that it covers the neck portion 14*e* of the mouth portion 14*k* of the liquid storage portion 14 formed by direct blow molding, the housing 1107 solidly welded to the mouth portion 14*k*, and the layerable members 20 and 1103 solidly welded to the housing 1107.

This bottom cover 21 has a snap-type fastening portions 1701, 1702, 1703, 1704*a*, and 1704*b*. The snap-type fastening portions 1701, 1702, 1704*a*, and 1704*b* engage with the neck portion 14*e* (back side of flange 14*d*) of the mouth portion 14*k* in a manner to grasp the neck portion 14*e* from four sides, as shown in FIG. 7, whereas the remaining snap-type fastening portion 1703 engages with the catch portion 14*p* of the bottom portion 14*b*.

Also referring to FIGS. 19–27, the snap-type fastening portions 1701, 1702, 1704*a*, and 1704*b* of the snap-type fastening mechanism of the bottom cover 21 (21A, 21B), which engage with the neck portion 14*e* of the mouth portion 14*k*, are attached to the four different points Of the bottom cover 21, one for one. However, they may be attached to three different points of the bottom cover 21. In some cases, they may be attached to two different points of the bottom cover 21. Further, the bottom cover 21 may be structured so that at least two snap-type fastening portions are positioned in a manner to sandwich the storage medium holder case 1502, and so that the bottom cover 21 is held to the bottom portion 14*b* by the same snap-type engaging portions.

Structuring the bottom cover 21 (21A, 21B) and snap-type fastening portions as described above makes it possible for the shock resulting from a fall of the liquid container 11 to be absorbed by the snap-type fastening portions to reduce the damages to the welding seams in the adjacencies of the mouth portion 14*k* (first shock absorption).

Moreover, in the case of this structural arrangement, not only does the bottom cover 21 have a pair of recesses, into which the overhang portion 14*h* of the flange 14*d*, which extends in the widthwise direction (direction Y) of the liquid storage portion 14, fits to prevent the bottom cover 21 from becoming dislodged from the liquid storage portion 14 in the lengthwise direction (direction X) and widthwise direction (direction Y) of the liquid storage portion 14, but also, a gap is provided between each overhang portion 14*h* and the wall of the corresponding recess so that the aforementioned shock is absorbed by the coordination of the recess and overhang portion 14*h* (second shock absorption).

More specifically, referring to FIGS. 28 and 29, the interior (internal surface) of the bottom cover 21 is provided with a pair of recesses, the surface of which engages with the surface (peripheral surface of mouth portion 14*k*) of the overhang portion 14*h* of the flange 14*d* of the mouth portion 14*k* extending in the widthwise direction.

Further, the liquid container 11 (bottom cover 21 in drawings) is provided with a pair of container ID portions 22 and 23, which mechanically identify the type of a container or the type of the liquid in a container, and which also prevent mounting errors. The bottom cover 21 contains, in addition to the above described connective portion, the storage medium 18, which is electrical, magnetic, optical, or of a combination of these properties, and which is capable of storing information regarding the amount, type, etc., of the ink in the liquid storage portion 14.

The bottom cover 21 is structured so that it can be snap fastened to the liquid storage portion 14. Therefore, not only can it be simply attached to the liquid storage portion 14 without requiring a special tool during one of the manufacturing processes, but also it can be easily removed to selectively remove the storage medium 18 after the expiration of the service life of the liquid container 11.

As the liquid container 11 is subjected to an excessive shock, the layerable members attached in layers to the end surface of the flange 14*d* of the mouth portion 14*k* sometimes become dislodged from each other. In order to prevent this problem, the layerable members are desired to be given recesses or projections so that their recesses or projections interlock with those of the adjacent layerable members.

Extending the tubular portion 45 of the housing 1107 so that the tubular portion 45 supports the mouth portion 14*k* by the internal wall of the mouth portion 14*k* is particularly effective for the purpose of preventing the neck portion 14*e* of the mouth portion 14*k* from inwardly deforming, and/or the housing 1107 from becoming dislodged. This tubular portion 45 may be structured so that it doubles as the structure for detecting that the amount of the liquid remaining in the liquid storage portion 14 is very small. In terms of reinforcement, the tubular portion 45 as the member for supporting the neck portion 14*e* by the internal surface of the neck portion 14*e* when the liquid container 11 is subjected to a shock (first embodiment shown in FIGS. 6, 7, and 9, and second embodiment shown in FIG. 10) is more effective when it is closer to the center of the short edge of the liquid storage portion 14 than when it is closer to the corner at which the internal edges of liquid storage portion 14 intersect. Therefore, it is desired that the liquid drawing portion of the connective portion attached to the mouth portion 14*k* is positioned closer to the short edge (lengthwise end) of the bottom wall 14*b* and the air introducing portion of the connective portion is positioned closer to the center of the bottom wall 14*b*.

Referring to FIG. 3, the liquid container 11 (11A, 11B), which is made up of the above described structural components, etc., and is used as an ink container for an ink jet recording apparatus, for example, has a sealed liquid chamber 13 for storing one ink 12 (specific in terms of chromaticity, tone, saturation, composition, etc.). FIGS.

3(*b*), 3(*c*), and 3(*d*) schematically show the three sets of ID portions 22 and 23 differentiated in specification for preventing the mix-up among two or more liquid containers different in the ink stored therein. The liquid container 11 is mounted into the station base 31 (FIG. 5) of an ink jet recording apparatus, in such a manner that its liquid chamber 13 is positioned on the top side of the liquid container 11.

Referring to FIGS. 1 and 2, the liquid container 11 is approximately in the form of a flat rectangular parallelepiped, and has two pairs of opposing walls 14*f* and 14*g*. The walls 14*f* are the largest walls of the liquid container 11, are connected to each other by the walls 14*g*. The first and second container ID portions 22 and 23 are in the adjacencies of the bottom portion 14*b* and perpendicularly project outward from the bottom ends of the pair of connective walls 14*g*, one for one. The connective walls 14*g* extend from the bottom portion 14*b* to the top portion 14*a*, like the largest walls 14*f*. All the projections making up the container ID portions 22 and 23 are slightly above the bottom wall 14*b* of the liquid storage portion 14; the ID portions are slightly displaced from the bottom wall 14*b* toward the top portion 14*a*. The information identified by these mechanical information identifying portions is a duplication of a part of the information stored in the electrical identification storage portions, and is limited to the information regarding ink type (color, etc.).

Further, the liquid container 11 has ribs 24, grooves 25 (recess), or the like, which make up a non-slip area to be grasped by hand when the liquid container 11 is mounted into or removed from an ink jet recording apparatus, and which are parts of the largest walls 14*f* and connective walls 14*g*, being close to the top wall 14*a*. In the case of this embodiment, the nonslip surfaces are created by forming grooves in the external surfaces of the largest walls 14*f*, and also, forming ribs on the external surfaces of the connective walls 14*g*. However, the structural arrangement for providing the nonslip surfaces does not need to be limited to the above described one; the selection and positioning of the above described ribs and grooves are optional.

FIGS. 30–36 are drawings for sequentially describing the steps of the process for putting the liquid drawing connective needle (hollow needle) and ambient air introducing connective needle (hollow needle), through the two holes of the bottom portion 11*e* (bottom portion of bottom cover 21) of the liquid container 11, and the connective holes filled with elastic substances of the mouth portion 14*k*. Next, referring to FIGS. 30–36, the process for putting the liquid drawing connective needle and ambient air introducing connective needle through the bottom portion lie and mouth portion 14*k* of the liquid container 11 will be described.

Figure 30:
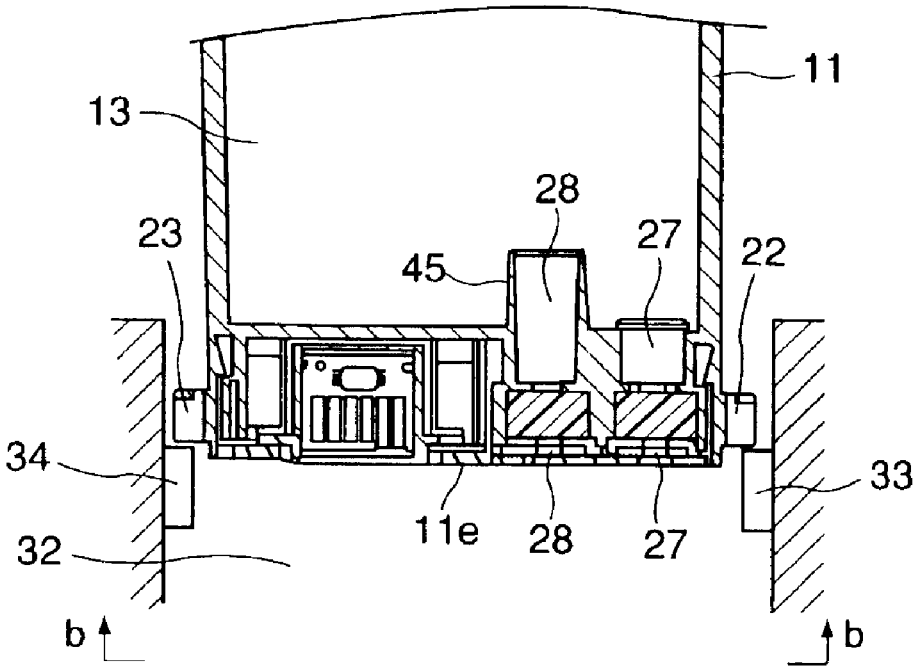
FIG. 30(*a*) is a schematic vertical sectional view of a liquid container in accordance with the present invention, during the initial stage of the process in which the liquid container is inserted into a slot of the station base, starting from the bottom portion, and FIG. 30(*b*) is the bottom portion of the same liquid container as seen from Line b—b in FIG. 30(*a*).
Figure 30:
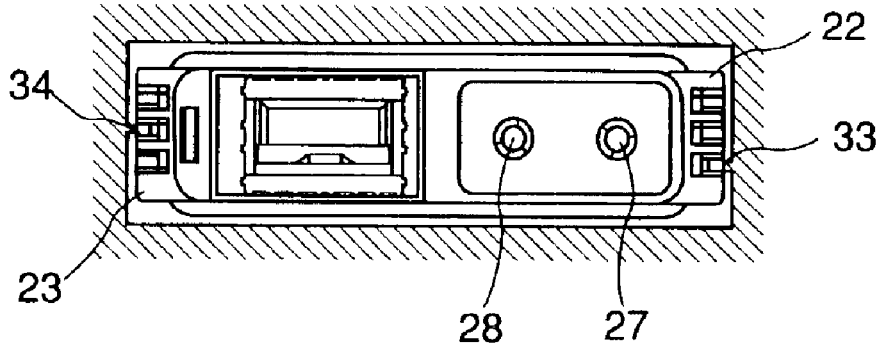
Figure 31:
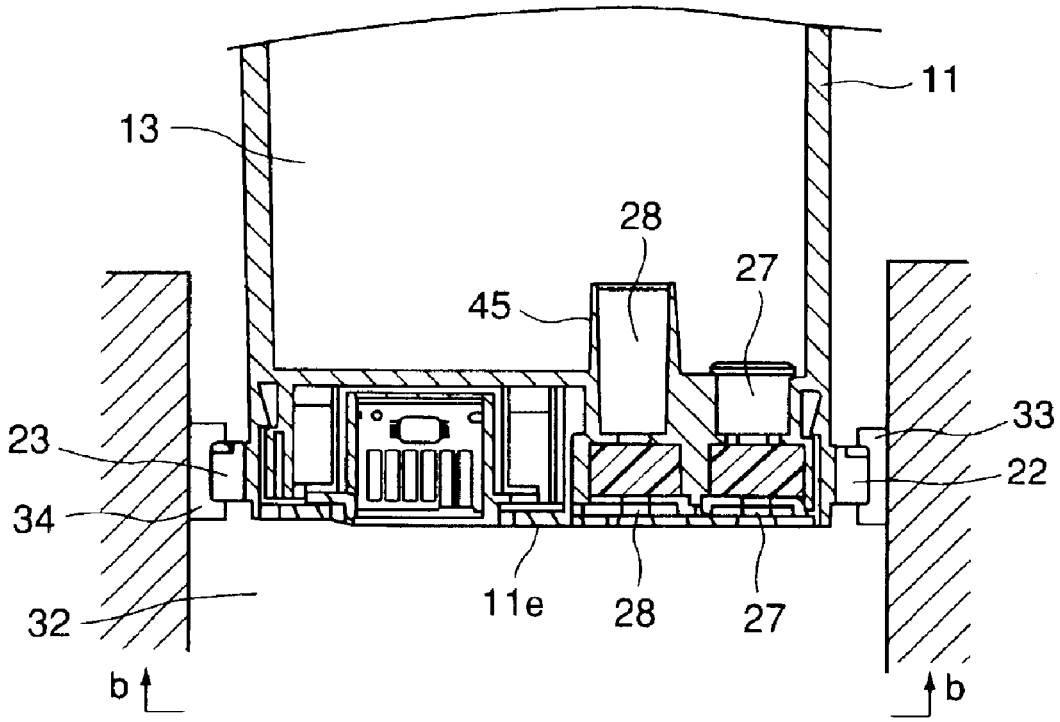
FIG. 31(*a*) is a schematic vertical sectional view of the liquid container shown in FIG. 30, while the container ID portions of the liquid container are about to pass by the container ID portions on the main assembly side during the further insertion of the liquid container from the position shown in FIG. 30, and FIG. 31(*b*) is a bottom view of the same liquid container as seen from Line b—b in FIG. 31(*a*).
Figure 31:
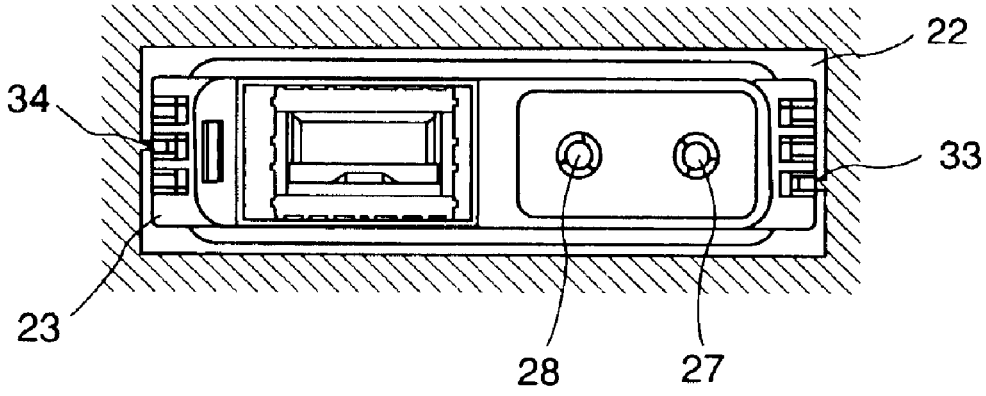
Figure 32:
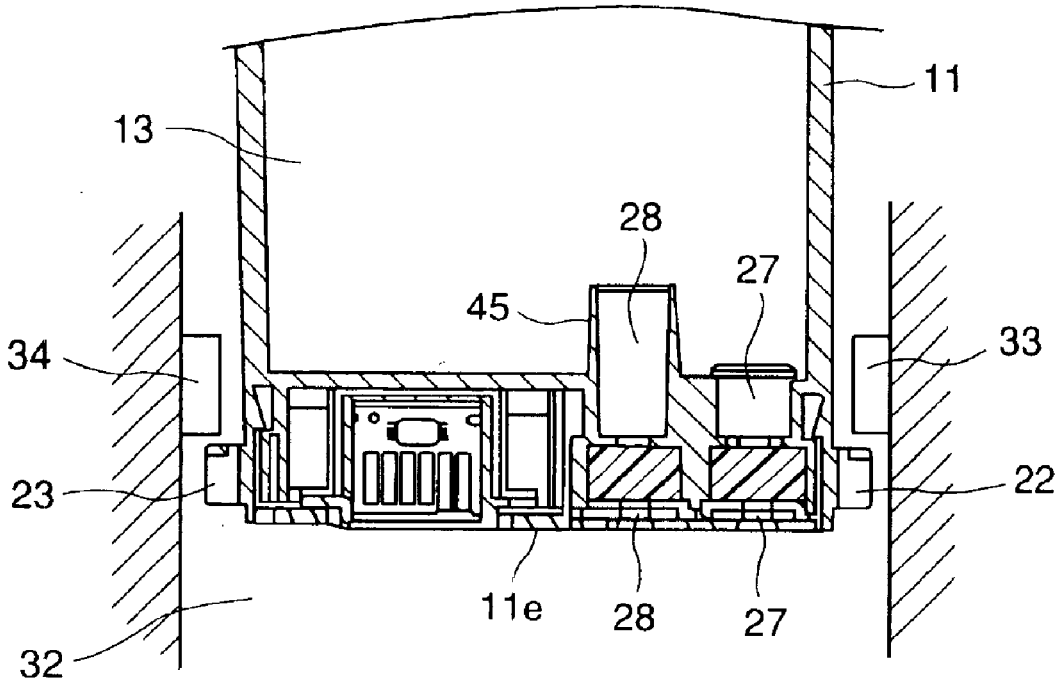
FIG. 32(*a*) is a schematic vertical sectional view of the liquid container shown in FIG. 30, after the passing of the container ID portions of the liquid container by the container ID portions on the main assembly side during the further insertion of the liquid container from the position shown in FIG. 31, and FIG. 32(*b*) is a bottom view of the same liquid container as seen from Line b—b in FIG. 32(*a*).
Figure 32:
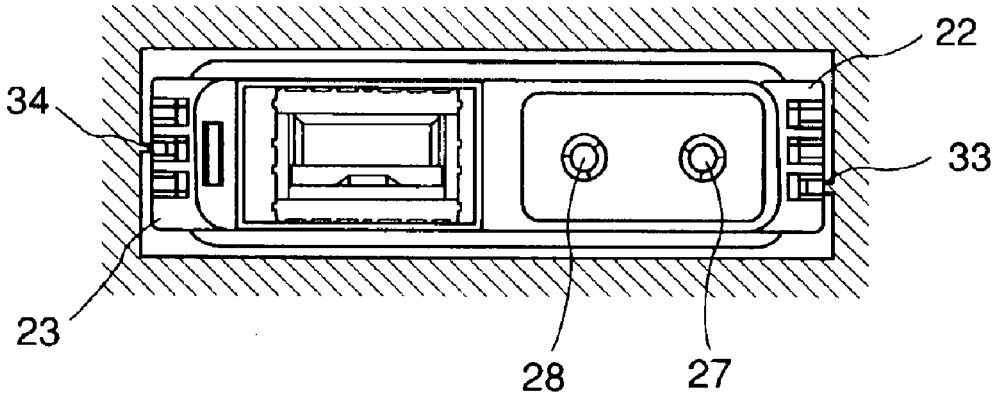

Referring to FIG. 30, the liquid container 11 is inserted into one of the slots 32 of the station base 31 (FIG. 5) from the bottom side (bottom portion lie side). The liquid drawing connective needle 38 (hollow needle) and ambient air introducing connective needle 39 (hollow needle) project from the bottom surface of the internal space of the slot 32. The station base 31 has two or more slots 32 which are capable of accepting one liquid container 11, and the openings of which face virtually straight upward. Thus, two or more liquid containers 11 different in the color of the ink therein (or one of other aspects of ink therein) can be mounted in the station base 31.

The liquid drawing connective needle 38 and ambient air introducing connective needle 39 are practically identical in length and shape, and are tapered at the end in a manner to form a sharp tip so that they can penetrate the two elastic members (for example, rubber plugs) on the inward side of the bottom portion 11*e* of the liquid container 11, being positioned at approximately the same levels. The connective needles 38 and 39 are hollow, and are closed at their tips. They have holes 38*a* and 39*a*, respectively, which are slightly below the tapered portion, that is, the top portion of the taper-less portion (FIGS. 33, 34, 35, and 36). The liquid drawing connective needle 38 and ambient air introducing connective needle 39 are solidly fixed to the bottom surface of the slot 32 so that their tips reach approximately the same heights; therefore, the heights of the holes 38*a* and 39*a* are approximately the same.

First, the liquid container 11 is inserted into the slot 32. As the liquid container 11 begins to be inserted into the slot 32, the first and second container ID portions 22 and 23 of the liquid container 11 (bottom cover 21) located at the short edges, one for one, of the leading end of the liquid container 11 reach the first and second container 11 portions 33 and 34 (container ID portions on main assembly side). Thus, only when the slot 32, into which the liquid container 11 is being inserted, is the correct slot (only when container ID portions on container side match container ID portions on main assembly side), the first and second container ID portions 22 and 23 of the liquid container 11 are allowed to pass the first and second container ID portions 33 and 34, respectively, within the slot 32. In other words, the liquid container 11 can be mounted into the station base 31 of an apparatus such as an ink jet recording apparatus, only when the container ID portions of the liquid container 11 match the ID portions on the main assembly side in the slot 32 into which the liquid container 11 is mounted.

The first and second ID portions 22 and 23 ID of the liquid container 11 are differentiated in the mechanical identification information (ID) (structure and measurement) to make a liquid container 11 of one type uninterchangeable with a liquid container of another type (to make it impossible to mount a liquid container of one type into a slot for a liquid container of another type). Moreover, the container ID portions of the liquid container 11 are structured so that when only one apparatus (ink jet recording apparatus or the like) is involved, each container ID portion alone, that is, the first container ID portion 22 alone or second container ID portion 23 alone, is sufficient to make a liquid container 11 of one type uninterchangeable with a liquid container 11 of another type. This is for preventing the following problem. That is, even when a liquid container is inserted into the wrong slot, a user sometimes mistakenly perceives that one of the container ID portions has passed the container ID portion on the main assembly side. If this happens, the user may think that the liquid container is in the right slot and can be further inserted, and might apply more pressure to push the liquid container farther into the slot, which might result in damage to the main assembly of an apparatus such as a recording apparatus.

FIGS. 3(*b*), 3(*c*), and 3(*d*) show the different structures of the above described container ID portions located at both ends. In FIG. 3, a referential sign "o" shows the location of the notch. Also for the same reason as the above described one, the container ID portions of the liquid container 11 are structured so that even when two or more apparatuses (ink jet recording apparatuses or the like), and two or more liquid containers identical in shape and ink color, are involved, each container ID portion alone, that is, the first container ID portion 22 alone or second container ID portion 23 alone, is sufficient to make a liquid container 11 of one type uninterchangeable with a liquid container 11 of another type.

Figure 33:
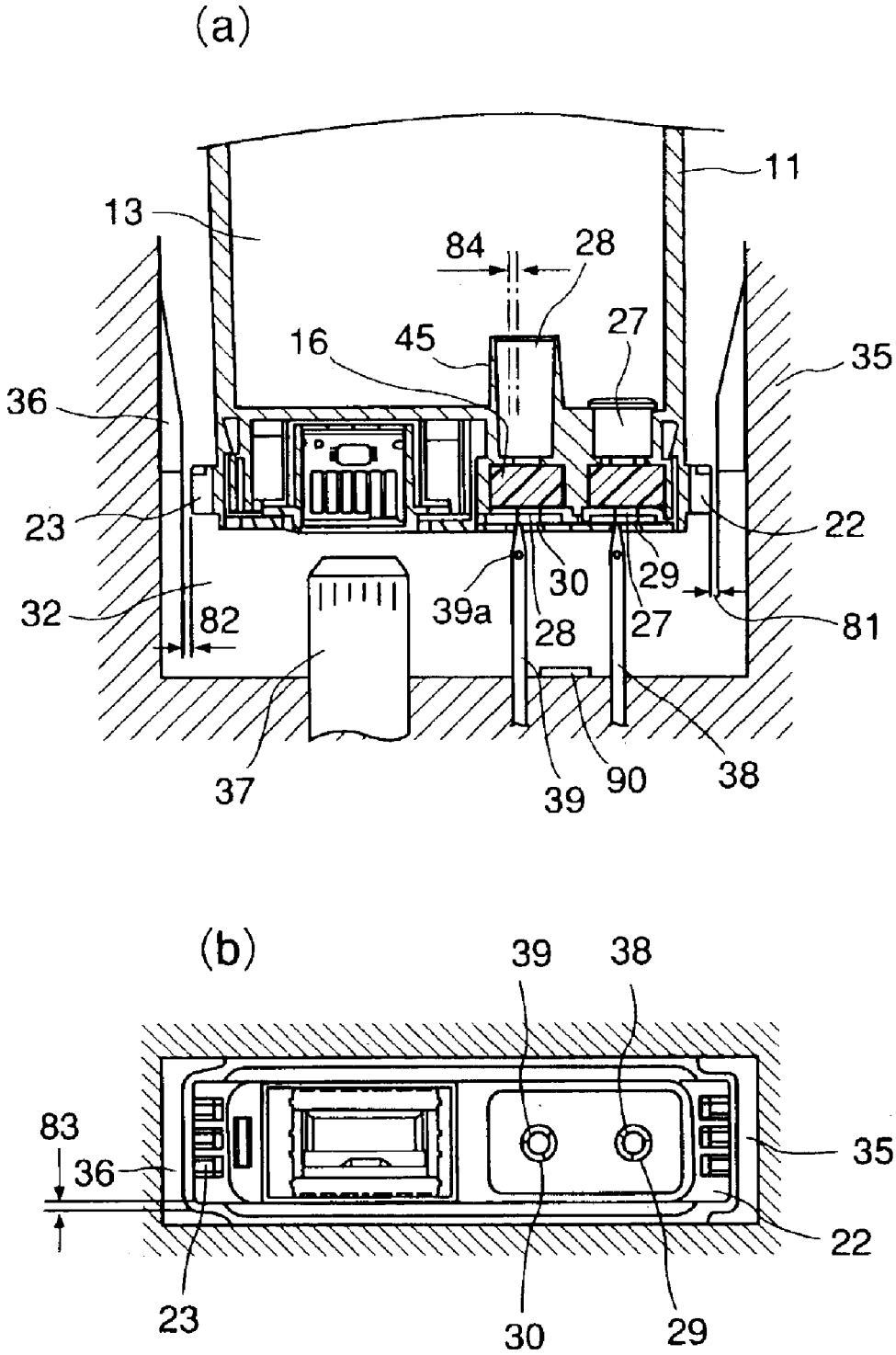
FIG. 33(*a*) is a schematic vertical sectional view of the liquid container shown in FIG. 30, when the tips of the connective needles projecting from the bottom surface of the internal space of the slot are about to enter the corresponding connective holes after the passing of the container ID portions by the positioning portions in the slot, during the further insertion of the liquid container from the position shown in FIG. 32, and FIG. 33(*b*) is a bottom view of the same liquid container as seen from Line b—b in FIG. 33(*a*).

As the liquid container 11 is inserted closer to the internal bottom surface of the slot 32, the first and second container ID portions 22 and 23 of the liquid container 11 are accurately positioned by the first and second positioning portions 35 and 36 on the internal surface of the slot 32, as shown in FIG. 33. Therefore, the liquid container 11 can be further inserted into the slot 32 without becoming horizontally (direction X and direction Y) dislodged. For example, clearances 81 and 82 in terms of the direction X and clearance 83 in terms of the direction Y, shown in FIG. 33(*a*), are regulated as measurement tolerance.

Next, referring to FIG. 33(*b*), as the edges of the first and second guiding portions 29 and 30 of the bottom wall of the liquid container 11 reach the tips of the connective needles 38 and 39, respectively, the liquid drawing connective needle 38 and ambient air introducing connective needle 39 solidly fixed to the bottom wall of the slot 32 come into contact with the first guiding portion 29 of the first connective hole 27 of the bottom wall of the liquid container It, and the second guiding portion 30 of the second connective hole 28 of the bottom wall of the liquid container 11, respectively.

Thereafter, before the elastic members (16*a*, 16*b*) reach the connective needles 38 and 39, the container ID portions 22 and 23 become disengaged from the positioning portions 35 and 36, respectively; the positioning portions 35 and 36 stop regulating the position of the liquid container 11. In other words, from this point on, the position of the liquid container 11 in terms of the directions X and Y is regulated with reference to the connective needles 38 and 39.

Figure 34:
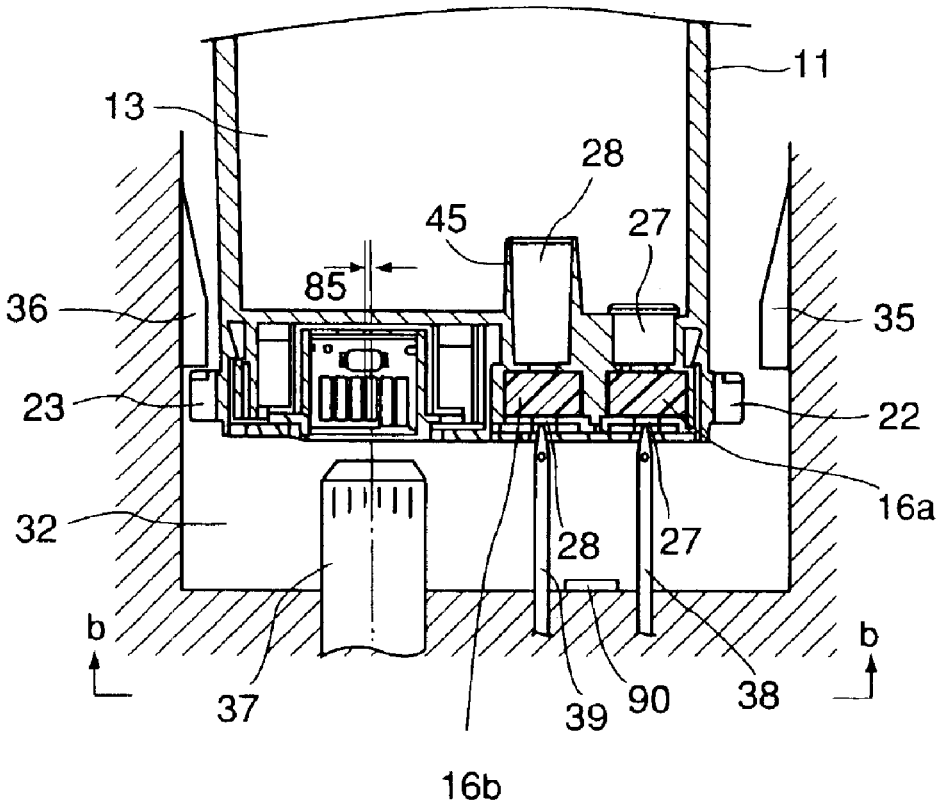
FIG. 34(*a*) is a schematic vertical sectional view of the liquid container shown in FIG. 30, when the connective needles projecting from the bottom surface of the internal space of the slot have just begun to penetrate the corresponding elastic members as sealing members, during the further insertion of the liquid container from the position shown in FIG. 33, and FIG. 34(*b*) is a bottom view of the same liquid container as seen from Line b—b in FIG. 34(*a*).
Figure 34:
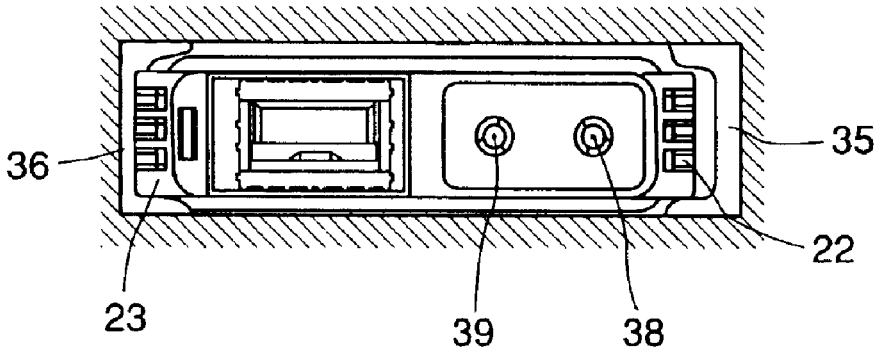

Thus, after becoming disengaged from the guiding means in the slot 32, the liquid container 11 moves so that its connective holes 27 and 28 are guided to the connective needles 38 and 39 on the main assembly side of an apparatus (for example, liquid container 11 moves so that a distance 84, in FIG. 33(*a*), that is, the amount of the displacement of the connective needle 39 from the center of the guiding portion 30, becomes zero). Then, the connective needles 38 and 39 begin to penetrate the elastic members 16*a* and 16*b* in the connective holes 27 and 28, at virtually the same time, as shown in FIG. 34. Freeing the liquid container 11 from the positional regulation placed by the slot 32 before the liquid container 11 reaches the bottom of the slot, as described above, prevents the two connective needles 38 and 39 from being damaged by the liquid container 11; one of the liquid container mounting errors is eliminated.

Figure 35:
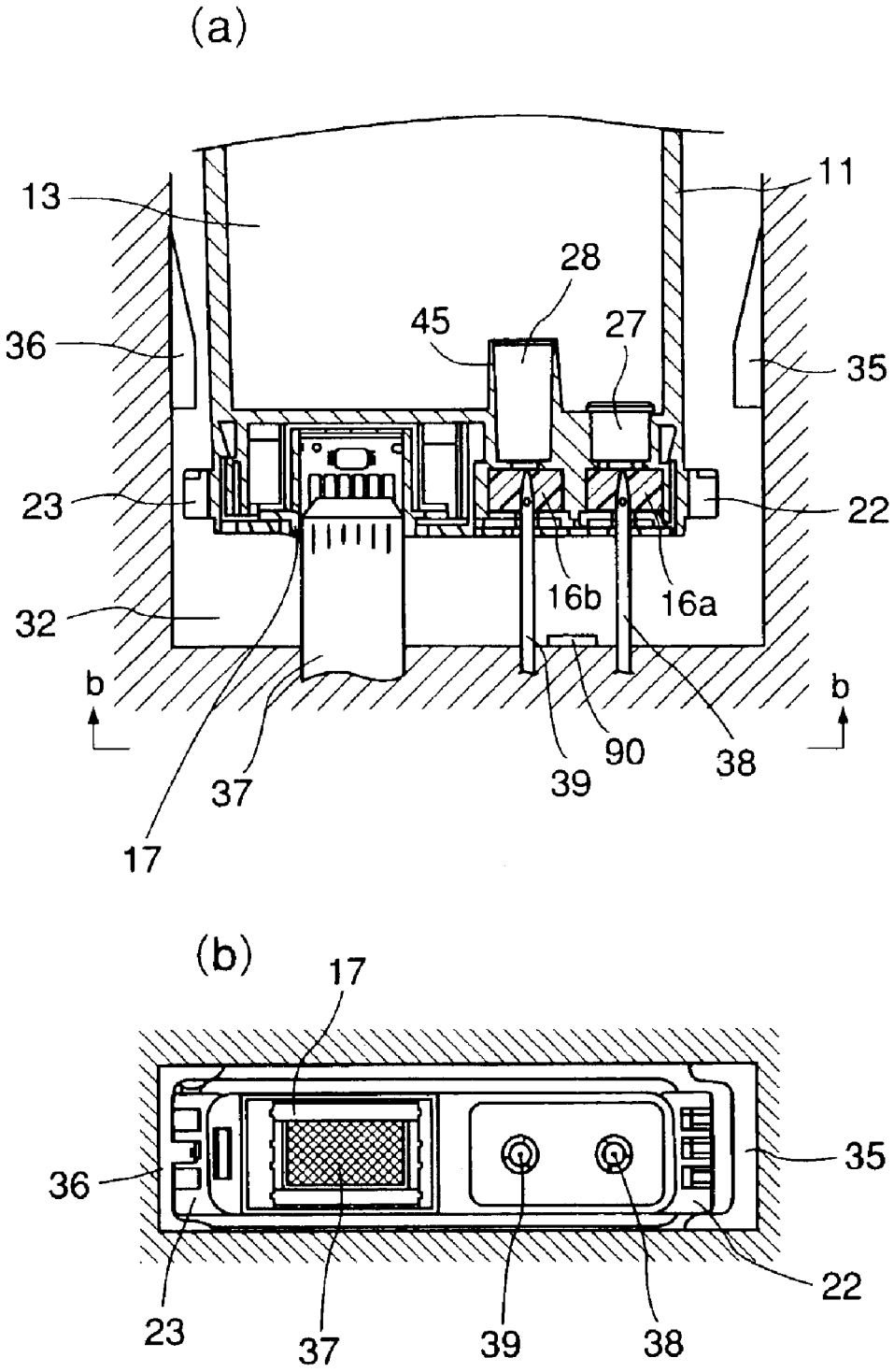
FIG. 35(*a*) is a schematic vertical sectional view of the liquid container shown in FIG. 30, when the connective needles projecting from the bottom surface of the internal space of the slot have penetrated through the corresponding elastic members as sealing members, and the electrical connector (for transmitting electrical signals) on the internal surface of the bottom wall of the slot is about to enter the storage medium hole of the liquid container, during the further insertion of the liquid container from the position shown in FIG. 34, and FIG. 35(*b*) is a bottom view of the same liquid container as seen from Line b—b in FIG. 35(*a*).

Next, referring to FIG. 35, while the connective needles 38 and 39 penetrate the elastic members 16*a* and 16*b*, the tip of an electrical signal transmission connector 37 solidly fixed to the bottom surface of the slot 32 begins to enter the storage means holder 17 of the liquid container 11. The storage means holder 17 is loosely attached to the liquid container 11 to afford the storage means holder 17 some movement relative to the liquid container 11. Therefore, even if the storage means holder 17 is not in alignment with the electrical signal transmission connector 37 (even if there is a distance 85 between the axial lines of the storage means holder 17 and electrical signal transmission connector 37, as shown in FIG. 34), the storage means holder 17 moves while being guided by the tapered (chamfered) portion of the leading end of the electrical signal transmission connector 37. Therefore, it is assured that the electrical signal transmission connector 37 easily enters the storage means holder 17; it is smoothly connected without hanging up or causing an operator to perceive any anomaly.

Figure 36:
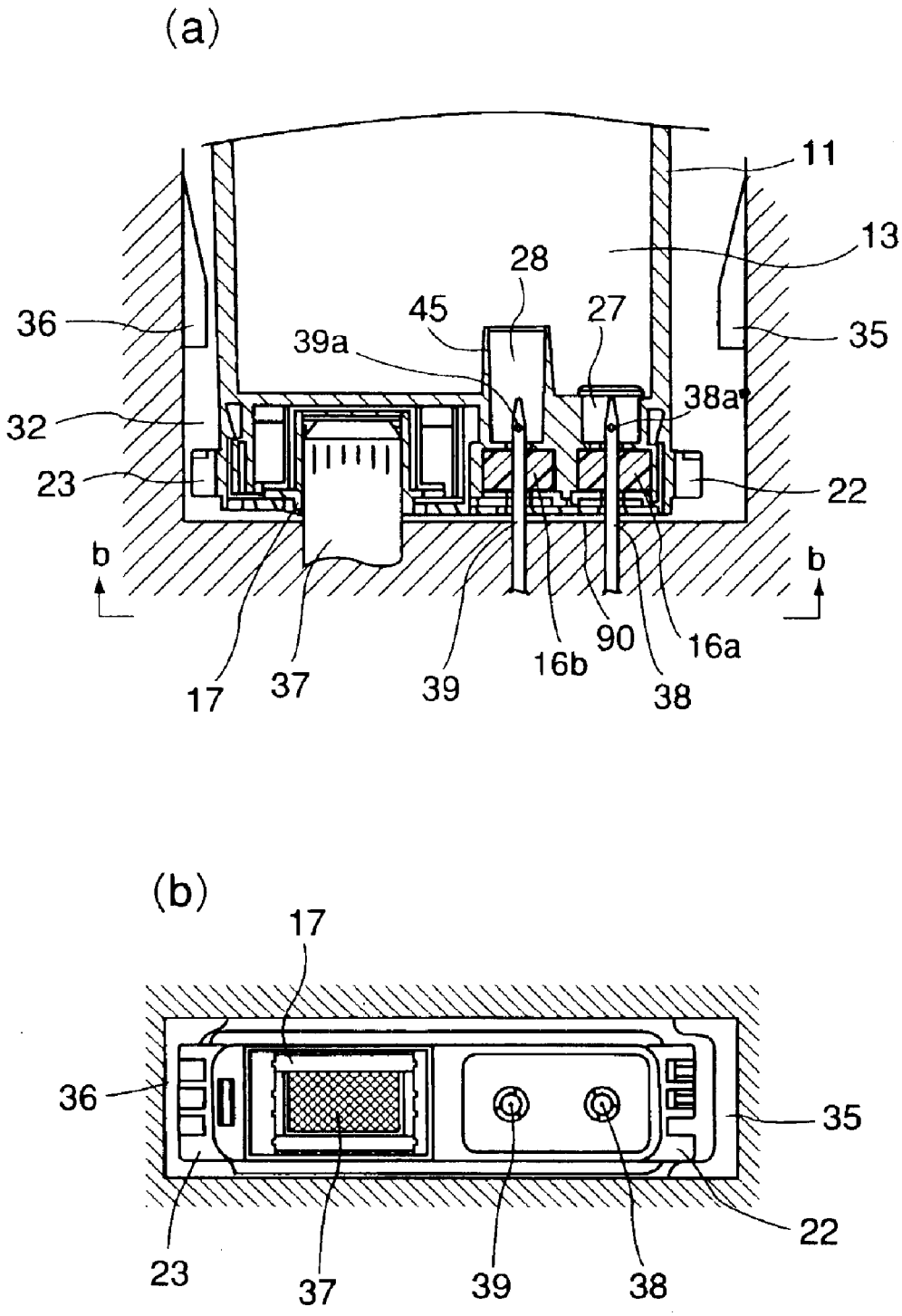
FIG. 36(*a*) is a schematic vertical sectional view of the liquid container shown in FIG. 30, after the completion of the insertion of the liquid container into the slot of the station base and the completion of the electrical connection between the storage medium and liquid container, and FIG. 36(*b*) is the bottom view of the same liquid container as seen from Line b—b in FIG. 36(*a*).

Thereafter, the electrical signal transmission connector 37 completely enters the storage means holder 17, and the liquid drawing connective needle 38 and ambient air introducing connective needle 39 finish penetrating through the first and second elastic members 16*a* and 16*b* virtually at the same time, as shown in FIG. 36. Then, the bottom surface 11*e* of the liquid container 11 (bottom cover 21) comes into contact with a container catching portion 90, which is on the bottom surface of the slot 32 of the station base 31 and accurately positions the liquid container 11 in terms of the direction Z. This concludes the mounting of the liquid container 11. As a result, the liquid chamber 13 in the liquid container 11 becomes connected to a device (for example, recording head of ink jet recording apparatus) which uses the liquid in the liquid chamber 13, and also, to the ambient air, through the connective needles 38 and 39 (through holes 38*a* and 39*a*, and hollows of needles 38 and 39), respectively.

Further, for the purpose of ensuring the positional relationship between the liquid container 11 and connective needles 38 and 39, it is desired that the station base 31 is provided with a lever for pressing down the liquid container 11 by the top surface 14*a* and keeping the liquid container 11 pressured downward; the liquid container catching portion 90 for accurately positioning the liquid container 11 in terms of the direction Z is placed between the connective needles 38 and 39; and the point of action of the lever is directly above the liquid container catching portion 90 (coincides with vertical line 2003).

In the case of the embodiment shown in FIGS. 4, 7, and 8, the housing 1107 solidly fixed to the mouth portion 14*k* of the liquid storage portion 14 by ultrasonic welding or the like has the tubular portion 45, which projects inward of the liquid chamber 13 of the liquid storage portion 14 by a predetermined length. This tubular portion 45 may be formed by molding it as an integral part of the mouth portion 14*k* of the liquid storage portion 14, as shown in FIGS. 30–36. Next, this tubular portion 45 will be described.

It was described that this tubular portion 45 is effective to prevent the deformation of the neck portion 14*e* of the mouth portion 14*k* and the displacement of the housing 1107, which occurs as the mouth portion 14*k* of the liquid container 11 is subjected to a strong impact. However, the tubular portion 45 has other functions in addition to the above described function, and is also effective in terms of those functions. Next, these aspects of the tubular portion 45 will be described.

Referring to FIGS. 4, 7, and 30–36, the tubular portion 45 extends into the liquid chamber 13 (vertically upward), entirely surrounding the opening of the second connective hole 28 for the ambient air introduction. Referring to FIG. 36, after the mounting of the liquid container 11 into a predetermined slot 32, the ambient air introducing connective needle 39 extends through the second connective hole 28, and the hole of the needle 39 located close to the tip of the needle 39 is below the end (top end) of the tubular portion 45.

Figure 37:
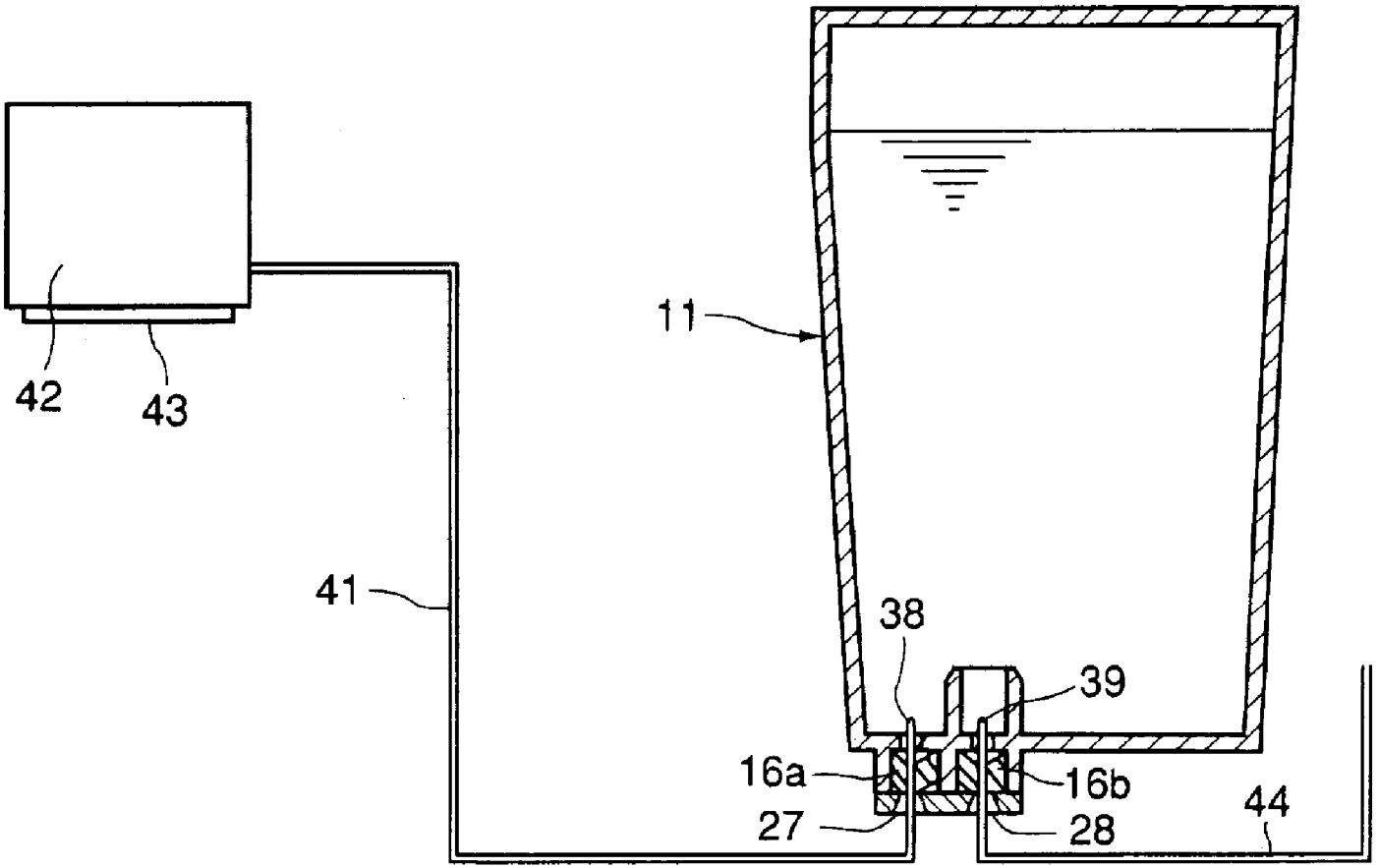
FIG. 37 is a schematic drawing for depicting an example of the structure of a liquid (ink) supply system for supplying to the ink jet recording head of an ink jet recording apparatus employing a liquid container in accordance with the present invention.
Figure 38:
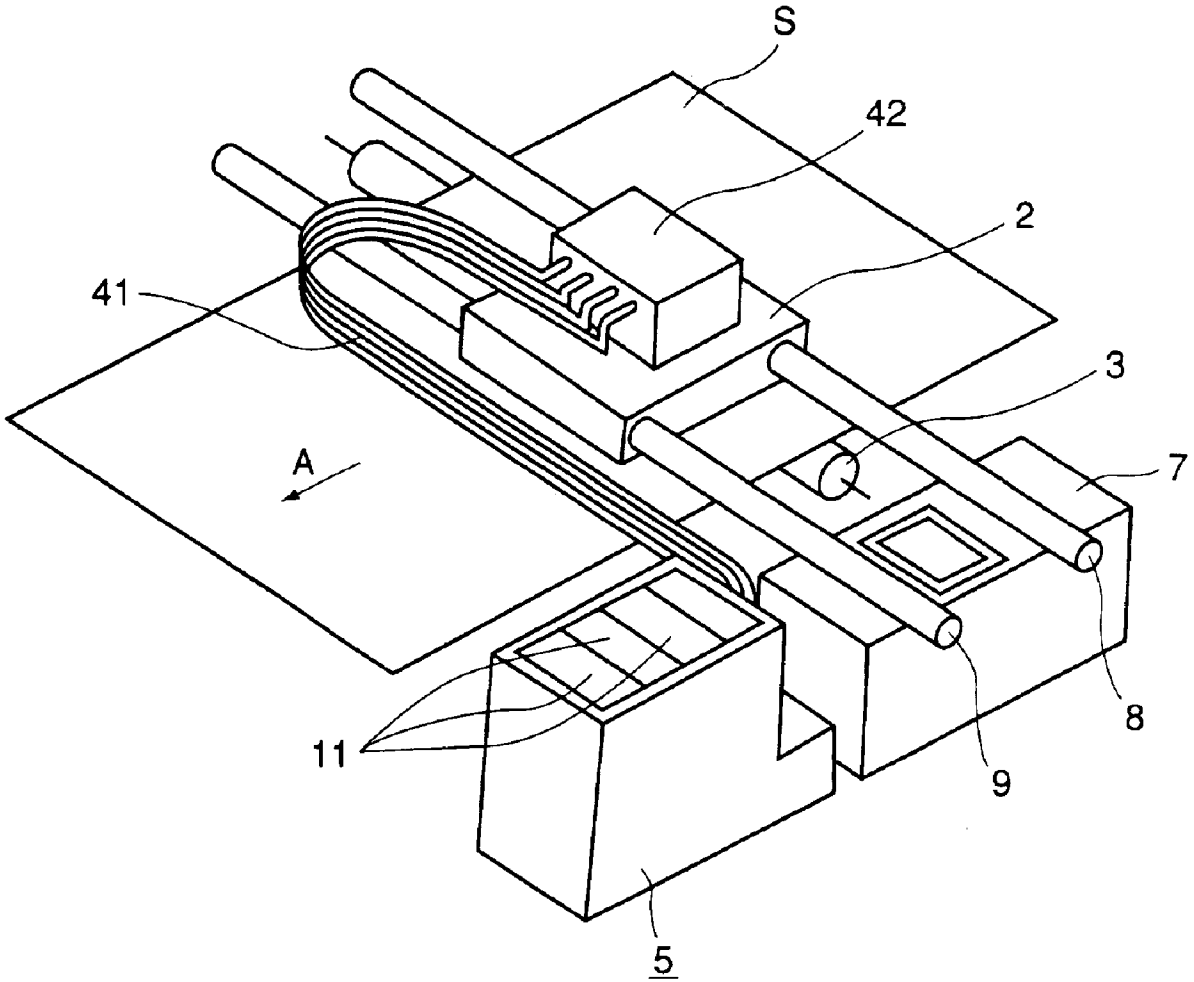
FIG. 38 is a schematic perspective view of a preferable example of an ink jet recording apparatus with which the liquid supply system shown in FIG. 37 is compatible.

FIG. 37 is a drawing which depicts an example of the structure of the system for supplying liquid (ink) to the ink jet recording head of an ink jet recording apparatus employing the liquid container 11 in accordance with the present invention, and FIG. 38 is a schematic perspective view of a preferable example of an ink jet recording apparatus employing the liquid supply system shown in FIG. 37.

Referring to FIGS. 36 and 37, when a liquid (ink) supply system is structured as is the one shown in FIG. 37, the hole 39*a* at the tip portion of the ambient air introducing connective needle 39 is below the liquid ejection surface 43 (surface comprising ink ejection orifices) of the ink jet recording head 43. In FIG. 37, a referential numeral 44 designates an ambient air introduction tube connected to the ambient air introducing connective needle 39, and a referential numeral 41 designates a liquid supply tube connecting the liquid drawing connective needle 38 and ink jet recording head 42.

As the ambient air is introduced through the hole 39*a* of the ambient air introducing connective needle 39, the destruction and formation of meniscus is repeated across the hole 39*a* by the liquid (ink). As a result, the air sometimes forms bubbles in succession in the liquid. These bubbles must be swiftly introduced into the liquid chamber 13 of the liquid storage portion 14, without being allowed to stagnate in the tubular portion 45. Thus, a sufficient amount of clearance is provided between the external surface of the ambient air introducing connective needle 39 and the internal surface of the tubular portion 45. The side wall of the tubular portion 45 plays the role of a bubble blocking wall for the first connective hole 27 (liquid drawing connective hole) which is adjacent to the tubular portion 45, preventing thereby the bubbles within the second connective hole 28 from migrating to the adjacencies of the connective hole 27, because there is a possibility that once the bubbles reach the adjacencies of the first connective hole 27, they will be introduced into the ink jet recording head 42, etc., through the first connective hole 27.

The top edges of the tubular portion 45 are chamfered, for the following reason. That is, as the liquid level falls close to, or below, the top end of the tubular portion 45, the body of the ink within the tubular portion 45 and the body of the ink outside the tubular portion 45 must be quickly separated. With the provision of this structural arrangement, whether or not the amount of the ink remaining in the liquid container 11 is more than the threshold value can be determined with the utilization of the conductivity of the liquid (ink) provided by the ionic components in the liquid, that is, based on whether or not electric current flows between the connective needles 38 and 39 formed of electrically conductive substance.

More specifically, the liquid container 11 can be designed so that when the liquid level within the liquid container 11 is high enough for the liquid (ink) within the liquid container 11 to cover the top end of the tubular portion 45, and therefore, allow electric current to flow between the connective needle 39 within the tubular portion 45 and the connective needle 38 outside the tubular portion 45, no less than 10% of the initial amount of the ink in the liquid chamber 13 still remains, whereas at the point, at which electric current stops flowing between the two connective needles 38 and 39, and thereafter, no more than 10% of the initial amount of the ink remains. Further, providing the housing 1107 with the tubular portion 45 is also effective to prevent the housing 1107 from being attached in reverse.

The tubular portion 45 also plays the role of guiding the ambient air deep into the liquid chamber 13 of the liquid storage portion 14. Therefore, not only is the liquid smoothly drawn out through the liquid drawing connective portion (liquid drawing connective needle 38), but also the liquid (ink) 12 can be used in its entirety.

Normally, the tubular portion 45 remains immersed in the body of the liquid 12. However, as the liquid level within the liquid chamber 13 falls below the top end of the tubular portion 45, the electrical resistance between the ambient air introducing connective needle 39 and liquid drawing connective needle 38 drastically changes. Therefore, the near-end condition, that is, the condition that the liquid container is almost out of the liquid, can be detected by reading the electrical resistance between the two connective needles 38 and 39.

In principle, the liquid within the tubular portion 45 is not drawn out and remains therein. In other words, the space within the tubular portion 45, which contains the connective needles 39, is always full of electrically conductive liquid. Thus, in order to detect that the liquid level outside the tubular portion 45 has just fallen below the top end of the tubular portion 45, it is mandatory that the body of the liquid within the tubular portion 45 and the body of the ink outside the tubular portion 45 become cleanly separated in the adjacencies of the lip of the top end of the tubular portion 45.

However, the near-end condition sometimes fails to be detected even though the ink level has dropped below the top end of the tubular portion 45, for the following reason. That is, if a liquid container containing liquid is kept in storage, or is left unused, for a long period of time, certain ingredients of the liquid within the liquid container adhere to the peripheral surface of the top end of the tubular portion 45, although the severity of the adhesion varies depending on ink properties. These ingredients adhering to the top end of the tubular portion 45 allow electric current to flow between the two bodies of the liquid, making it impossible to detect the nearly empty condition of the liquid chamber 13. In order to prevent this problem, measures must be taken for more cleanly separating the two bodies of the liquid by the lip of the top end of the tubular portion 45. Therefore, the top edges of the tubular portion 45 are chamfered, or are given surface treatment to make the lip of the top end of the tubular portion 45 liquid repellent.

Next, referring to FIG. 38, an ink jet recording apparatus equipped with a preferable liquid supply system for using a liquid container structured as described above will be described.

The ink jet recording apparatus shown in FIG. 38 has an ink jet recording head 42 as a recording means, which is removably mounted on a carriage 2, which is supported, and reciprocally guided, by a pair of guide rails 8 and 9. Characters, signs, images, etc., are formed on a recording sheet S as recording medium by adhering to the recording sheet S, the ink ejected from specific ejection orifices of the recording head, while reciprocally moving the recording head in synchronism with the conveyance (secondary scanning) of the recording sheet S in the direction indicated by an arrow mark A. In other words, the ink jet recording apparatus shown in FIG. 38 is a serial type ink jet recording apparatus.

As for the recording medium (recording sheet), sheet-like medium, for example, ordinary paper, special purpose paper, OHP film, etc., are used. In recent years, fabric, nonwoven fabric, metallic sheet, etc., have come to be used in addition to the preceding media.

Referring again to FIG. 38, the ink jet recording head 42 as a recording means is on the carriage 2, on which the ink jet recording head 42 is removably mountable, and which is made to reciprocally slide on the pair of guide rails 8 and 9, by an unshown driving means such as a motor, while being guided by the rails 8 and 9. The recording sheet S is conveyed by a conveyance roller 3, in the direction intersectional to the moving direction of the carriage 2 (for example, direction indicated by arrow mark A, which is perpendicular to the moving direction of carriage 2), in parallel to the ink ejecting surface 43 of the ink jet recording head 42 while being kept a predetermined distance away from the ink ejection surface 43. The conveyance roller 3 is driven by an unshown driving force source (motor or the like).

The ink ejecting surface 43 of the ink jet recording head 42 has a number of orifices from which ink is ejected, and which are aligned in two or more columns different in ink color. An ink supply unit 5 for supplying ink to the ink jet recording head 42 comprises the station base 31, shown in FIG. 5, which is capable of holding two or more ink containers (liquid containers) 11 removably mountable in the station base 31. These liquid containers 11 are independent from each other, and the number of the liquid containers 11 corresponds to the number of inks, which are ejected from the ink jet recording head 42, and which are different in color. The ink supply unit 5 and ink jet recording head 42 are connected by two or more ink supply tubes (liquid supply tubes) 41, the number of which corresponds to the number of the inks different in color. Thus, as the ink containers 11 as main containers are mounted into the ink supply unit 5, it becomes possible for the inks in the main containers 11, different in color, to be independently supplied to the corresponding columns of orifices of the ink jet recording head 42.

In other words, an ink jet recording apparatus in accordance with the present invention, which records images on the recording sheet S as recording medium by ejecting ink onto the recording sheet S from the ink jet recording head 42 as a recording means, is structured so that it has an ink container mounting portion, on which one or more of the liquid containers 11 structured as described above, and uses the mounted liquid containers 11 as recording ink supply sources.

The ink jet recording head 42 as a recording means is such an ink jet recording means that uses thermal energy to eject ink. Thus, it comprises electrothermal transducers for generating thermal energy. The recording means (recording head) 42 uses the thermal energy generated by the electrothermal transducers to cause the ink to boil in the film-boiling fashion, generating bubbles in the ink, and uses the pressure changes caused by the growth and contraction of the bubbles, to eject ink from the orifices to record (print) characters, signs, images, etc.

Figure 39:
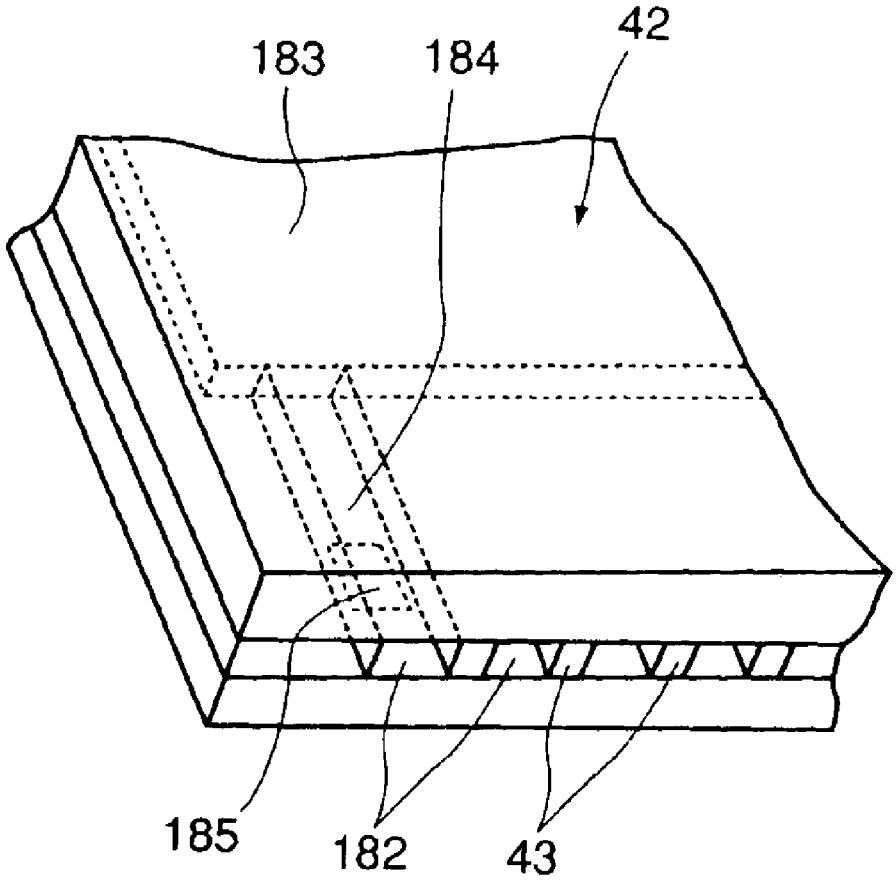
FIG. 39 is a schematic perspective view of the ink ejecting portion of the ink jet recording head shown in FIG. 37 or 38, for showing the structure thereof.

FIG. 39 is a schematic perspective view of the ink ejecting portion of the ink jet recording head 42, for showing the structure thereof. The ink ejecting surface (surface with ink ejection orifices) 43 of the ink jet recording head 42 faces the recording medium such as recording paper, holding a predetermined gap (for example, approximately 0.2–2.0 mm) from recording medium such as recording paper. It has a number of ejection orifices 182 arranged at a predetermined pitch. The ink jet recording head 42 as a recording means also comprises a common liquid chamber 83, liquid paths 184, and electrothermal transducers 185. The liquid paths 184 connect the common liquid chamber 183 to the liquid paths 184, one for one. The electrothermal transducers are for generating the energy for ink ejection. Each electrothermal transducer is disposed within a liquid path, along its wall. The recording head 42 is mounted on the carriage 2 so that the ejection orifices 182 align in the direction intersectional to the primary scanning direction (direction in which recording head 42 and carriage 2 are moved). The electrothermal transducers 185 are selectively driven (power is supplied thereto) by the corresponding image signals or ejection signals to cause the ink within the corresponding liquid paths 184 to boil in the film-boiling fashion so that the ink is ejected from the corresponding ejection orifices 182 by the pressure generated as the ink boils.

The ink jet recording apparatus has a recovery unit 7, which is disposed so that it opposes the ink ejecting surface of the ink jet recording head 42, within the range in which the ink jet recording head 42 is reciprocally moved, while being in the non-recording range, that is, the range outside the path of the recording sheet S. The recovery unit 7 comprises: a capping mechanism for capping the ink ejecting surface of the ink jet recording head 42; a suctioning mechanism for forcefully suctioning the ink from the ink jet recording head 42, with the ink ejecting surface capped; a cleaning mechanism comprising a blade, etc., for wiping away the contaminants on the ink ejecting surface; and the like. Normally, the operation for suctioning ink from the recording head 42 is carried out by the recovery unit 7 prior to the beginning of a recording operation.

The solvent of ink is evaporative. Thus, the ink in the ink supply tube 41 sometimes increases in density and viscosity as the solvent therein evaporates, if the ink jet recording apparatus is left unattended for a long period of time. When there is the possibility that the ink tube contains such ink that has increased in density and viscosity for the above described reason or the like, the ink can be suctioned out through the recording head 42 by the suctioning mechanism of the recovery unit 7, to replace the old ink in the ink supply tube 41 and head 42 with a fresh supply of ink. With this procedure, only the fresh supply of ink, the density and viscosity of which has been stabilized by the stirring caused by the suction, is used for recording, making it possible to reliably produce high quality images.

The ink used for an ink jet recording apparatus contains pigments, microscopic resin particles for improving the fixation of ink to the recording sheet S, or the like. These ingredients sometimes settle at the bottom of a liquid container if the ink in the liquid container is not used for a long period of time. Thus, an ink jet recording apparatus employing a liquid container (ink container) based on the prior art sometimes recorded low quality images (inclusive of characters, etc.) as it was used after being left unused for a long period of time. In comparison, an ink jet recording apparatus employing a liquid container in accordance with the present invention eliminates the problems traceable to the sedimentation and nonuniform distribution of the aforementioned pigments, microscopic resin particles, etc., eliminating therefore the time and labor required of a user to remove a liquid container and shake it to evenly redistribute the sediments. In other words, the employment of a liquid container in accordance with the present invention makes it possible to always use such ink that is stable in terms of the density of the pigments and microscopic resin particles, making therefore it possible to form high quality images (inclusive of characters, etc.).

According to the above described embodiments, the liquid container 11 comprises: the liquid storage portion 14 which is approximately in the form of a flat rectangular parallelepiped, and is formed of a synthetic resin; mouth portion **14*k*, which is a part of the bottom portion 14*b* of the liquid storage portion 14; and the connective portion attached to the mouth portion 14*k* to connect the inside and outside of the liquid storage portion 14. The mouth portion 14*k* is on the bottom wall 14*b* of the liquid storage portion 14, which is connected to the pair of opposing largest walls 14*f* of the liquid storage portion 14 along their lengthwise edges. The mouth portion 14*k* is offset toward one of the shorter edges (extending in the widthwise direction of the liquid storage portion 14), that is, the edges at lengthwise ends of the bottom walls 14*b*. The opening of the mouth portion 14*k* is elongated in the lengthwise direction of the bottom wall 14*b*. It is wider on the side closer to the center of the bottom wall 14*b* in terms of the lengthwise direction of the bottom wall 14*b* than on the side closer to the aforementioned shorter edge, that is, the edge at one of the lengthwise ends of the bottom wall 14*b***.

Also regarding to the structures of the above described embodiments, the mouth portion 14*k* is the only opening of the liquid storage portion 14. The liquid storage portion 14 is formed of a synthetic resin by blow molding. The mouth portion 14*k* has two connective portions: liquid drawing connective portion and ambient air introducing portion, which are approximately at the center of the bottom wall 14*b* in terms of the widthwise direction of the bottom wall 14*b*, aligning in the lengthwise direction of the bottom wall 14*b*. The liquid drawing connective portion is closer to the shorter edge of the bottom wall 14*b*, that is, the edge at the lengthwise end, than the ambient air introducing portion. The mouth portion 14*k* has the neck portion 14*e* projecting outward from the bottom wall 14*d* of the liquid storage portion 14, and the flange 14*d* projecting from the end of the neck portion 14*e* in the direction perpendicular to the axial direction of the neck portion 14*e*.

Further, the connective portion connecting the inside and outside of the liquid storage portion 14 comprises the layerable members 1107, 20, and 1103, which are solidly attached in layers to the end surface of the mouth portion 14*k*. The layerable member 1107 has the connective hole 27 and 28. The connective portion also comprises the elastic members 16, which are sandwiched by these layerable members, and through which the connective needles 38 and 39 are put. The layerable members 1107, 20, and 1103 are solidly and sequentially fixed in layers by ultrasonic welding. The closer the layerable members to the mouth portion 14*k*, the thinner the layerable members in terms of the direction in which they are attached in layers. The layerable member 1107 fixed to the mouth portion 14*k* has the tubular portion 45, which is for preventing the deformation of the internal surface of the mouth portion 14*k*, and which extends inward of the liquid storage portion 14 from the layerable member 1107.

Further, the connective needles 38 and 39 are hollow needles, and have the openings 38*a* and 39*a*, respectively, which are near the tips of the needles 38 and 39. The liquid container 11 has the bottom cover 21, which is for protecting the connective portion for connecting the inside and outside of the liquid storage portion 14, and which is removably attached to the bottom portion 14*b* of the liquid storage portion 14. The bottom cover 21 has the recesses, into which the flange 14*d* of the mouth portion 14*k* partially fits to prevent the displacement of the bottom cover 21 relative to the liquid storage portion 14. The bottom cover 21 also has the container ID portions 22 and 23 for mechanically identifying a liquid container in terms of container type or the liquid therein, and also, for preventing a liquid container from being mounted into a wrong slot. Moreover, the bottom cover 21 contains the electrical, magnetic, or optical storage medium 18, or the storage medium 18 having the combination of the preceding properties. The storage medium 18 is capable of storing the information regarding the amount, type, etc., of the ink in the liquid storage portion 14.

The liquid container 11 is excellent as an ink container, which is removably mounted into an ink jet recording apparatus which records images on the recording sheet S by ejecting ink onto the recording sheet S as a recording medium from the ink jet recording means as a recording means.

Further, an ink jet recording apparatus compatible with the preceding embodiments of a liquid container in accordance with the present invention has a mounting portion in which the liquid container 11 is mountable.

Further, the ink jet recording head 42 as a recording means is an ink jet recording head having the electrothermal transducers for generating the thermal energy used for ejecting ink. This ink jet recording means 42 uses the film-boiling phenomenon caused in ink by the thermal energy generated by the electrothermal transducers, to eject ink from the ejection orifices 182.

According to the preceding embodiments of the present invention regarding the structures of a liquid container and an ink jet recording apparatus employing a liquid container, not only can the liquid storage portion 14 of the liquid container 11 be formed, as a flat, hollow container proper, which is precise, rigid, and uniform in wall thickness, even by direct blow molding 11, but also, the mouth portion 14*k* having the opening for connecting the inside and outside of the liquid storage portion 14 can be formed, by blow direct blow molding, as such a mouth portion that is precise, and uniform in wall thickness, and is an integral part of the liquid storage portion 14 of the liquid container.

Further, according to the structural designs of the above described embodiments of the liquid container in accordance with the present invention, a simple, flat, hollow container formed by direct blow molding can be used as the liquid storage portion 14, and the mouth portion 14*k* (opening) of the liquid storage portion 14*k*, which has the two connective portions for connecting the inside and outside of the liquid storage portion 14, can be reliably sealed. Further, the liquid container 11 structured as described above can be aligned by two or more, leaving virtually no space between the adjacent two containers. In other words, when the liquid container 11 in accordance with the present invention is employed as an ink container for an ink jet recording apparatus or the like, it can be compactly mounted in the liquid container mounting portion of the apparatus, that is, without the need for expanding the liquid container mounting portion in the direction in which the containers are aligned. Further, the liquid container 11 structured as described above is substantially more resistant to external shocks, being therefore more reliable, than a liquid container based on the prior art.

The characteristics of the liquid container 11 structured as described above are as follows. First, the liquid container 11 can be easily formed to highly precise measurements in terms of shape and wall thickness, even by direct blow molding, which is a low pressure molding method, and which does not require an internal mold. Second, the wall of the mouth portion 14*k* is made uniform in thickness by positioning the mouth portion 14*k* offset, and shaping the mouth portion 14*k* so that its cross section becomes elongated, and so that the mouth portion 14*k* is wider on the side closer to the center of the mouth portion 14*k* than on the side closer to the edge at the lengthwise end of the bottom wall 14*b*.

Third, in consideration of the fact that when the liquid storage portion 14 is formed by blow molding, the corners of the mouth portion 14*k* are likely to turn out to be thinner, an ultrasonic welding means can be used, which is simple, capable of preventing the mouth portion 14*k* from being deformed by the welding load generated as the layerable members 1107 and 20 for retaining the sealing members (elastic members) of the connective portion are attached to the mouth portion 14*k* by ultrasonic welding, and also, capable of minimizing the loss of the welding energy.

The preceding embodiments were described with reference to a case in which the apparatus which employed the liquid containers in accordance with the present invention was an ink jet recording apparatus of a serial type. However, the present invention is also applicable to a line-type ink jet recording apparatus which records images with the use of a line-type ink jet recording head, the dimension of which in terms of the widthwise direction of a recording medium matches a substantial portion, or the entirety of, the width of the recording medium, and the application of the present invention will bring forth the effects similar to those described above.

Further, the application of the present invention is not limited to the liquid container (ink container) for an ink jet recording apparatus, which is mounted in the liquid container mounting portion of the apparatus main assembly; a liquid container to which the present invention is applicable includes, for example, a liquid container, which is directly mounted on a carriage or the like, which is reciprocally moved.

Further, the application of the present invention is not limited to liquid containers removably mountable in such an apparatus as an ink jet recording apparatus; the liquid containers to which the present invention is applicable include liquid containers permanently fixed to the apparatus.

Further, the present invention is preferably applicable to liquid containers, which are to be mounted by two or more in alignment, and which have a flat, rectangular, and parallelepipedic liquid storage portion formable by direct blow molding. Moreover, the application of the present invention is not limited by the type of a liquid container in which a liquid container in accordance with the present invention is mounted. In other words, the present invention encompasses a wide range of liquid containers in terms of the apparatus in which a liquid container is mountable.

As is evident from the above descriptions, according to claim 1 of the present invention, a liquid container comprises: a liquid storage portion, approximately in the form of a flat, rectangular parallelepiped, formed of synthetic resin; and a mouth portion, which is a part of the bottom portion of the liquid storage portion, and to which the connective portion for connecting the inside and outside of the liquid storage portion is attached. The mouth portion projects from the bottom wall of the liquid storage portion, which connects, at its lengthwise edges, to the largest walls of the liquid storage portion, which oppose each other. The mouth portion is offset toward one of the short edges of the bottom wall, that is, the edges at the lengthwise ends of the bottom wall. The configuration of the mouth portion is such that the cross section of the mouth portion is elongated in the lengthwise direction of the bottom wall, and that the mouth portion is wider on the side closer to the center of the bottom wall in terms of the lengthwise direction of the bottom wall than on the side closer to the aforementioned shorter edge of the bottom wall. Therefore, even as the flat, rectangular, parallelepipedic liquid storage portion is formed by direct blow molding, it turns out to be precise, highly rigid, and uniform in wall thickness. Further, the mouth portion, which is the opening for connecting the inside and outside of the liquid storage portion can be integrally formed with the liquid storage portion so that it turns out to be precise and uniform in wall thickness.

The liquid container in accordance with the present invention is structured so that the mouth portion is the only opening of the liquid storage portion; the liquid storage portion can be formed of a synthetic resin by blow molding; the connective portion comprising two portions, that is, the liquid drawing connective portion and ambient air introducing connective portion, is attached to the mouth portion; the two portions of the connective portion are aligned in the lengthwise direction of the bottom wall of the liquid storage portion, approximately at the center line of the bottom wall of the liquid storage portion in term of the widthwise direction of the bottom wall; and the liquid drawing connective portion is positioned closer to one of the shorter edges, that is, the edges at the lengthwise ends, of the bottom walls of the liquid storage portion than the ambient air introducing connective portion. Therefore, the present invention can provide an efficient liquid container, that is, a liquid container which demonstrate the above described effects.

Further, the liquid container in accordance with the present invention is structured so that the mouth portion comprises the neck portion projecting from the bottom surface of the liquid storage portion, and the flange projecting outward from the end of the neck portion in the direction perpendicular to the side wall of the neck portion; and the connective portion for connecting the inside and outside of the liquid storage portion comprises two or more layerable members, which have connective holes, and which are attached in layers to the end surface of the mouth portion, or comprises two or more layerable members, which have connective holes, and which are attached in layers to the end surface of the mouth portion, with the elastic members penetrable by the connective needles being retained among the layerable members. Therefore, the present invention can provide a liquid container which more efficiently provides the above described effects.

Further, the liquid container in accordance with the present invention is structured so that two or more layerable members are sequentially and solidly attached by ultrasonic welding; the closer the layerable members to the mouth portion, the thinner they are; one of the layerable members solidly attached to the mouth portion has the tubular portion extending inward of the liquid storage portion to prevent the internal surface of the mouth portion from deforming; and hollow needles having an opening close to their tips are used as the connective needles. Therefore, the liquid container in accordance with the present invention easily and reliably seals the liquid storage portion, in addition to providing the above described effects.

Moreover, the liquid container in accordance with the present invention is structured so that the bottom cover for protecting the connective portion for connecting the inside and outside of the liquid storage portion can be removably attached to the bottom portion of the liquid storage portion; the internal surface of the bottom cover has the recesses into which the mouth portion fits to prevent the bottom cover from being displaced from the liquid storage portion; the liquid container has the container ID portion for mechanically identifying liquid type or container type, and for preventing erroneous mounting of the liquid container; the electrical, magnetic, or optical storage medium, or storage medium having a combination of electrical, magnetic, and optical properties, for storing the information regarding the amount, type, etc., of the ink within the liquid storage portion is held within the bottom cover; and the liquid container is removably mountable in an ink jet recording apparatus which records images on a recording medium by ejecting ink from a recording means onto the recording medium. Therefore, the liquid container in accordance with the present invention is well protected even from external shocks, in addition to providing the above described effects.

While the invention has been described with reference to the structures disclosed herein, it is not confined to the details set forth, and this application is intended to cover such modifications or changes as may come within the purposes of the improvements or the scope of the following claims.

What is claimed is:

1. A liquid container having a generally flat rectangular parallelepiped shape, comprising:

opposite major sides;

an elongated bottom side connecting said opposite major sides;

a port, formed adjacent a longitudinal end portion of said bottom side, for fluid communication between an inside and an outside of said liquid container, said port being elongated in a longitudinal direction of said bottom side and having a width which is larger adjacent a longitudinally central portion of said bottom side than adjacent the longitudinal end portion, wherein said port is produced by blow molding of a synthetic resin material.

2. A liquid container according to claim 1, wherein said port is only one port for communication between the inside and outside.

3. A liquid container according to claim 1, wherein said port includes a connecting portion for air venting and a connecting portion for supplying liquid out of said container.

4. A liquid container according to claim 3, wherein said connecting portions are arranged in a longitudinal line substantially at a widthwise center of said bottom side.

5. A liquid container according to claim 3, wherein said liquid supply connecting portion is disposed adjacent said one end portion and adjacent a widthwise end of said bottom side.

6. A liquid container according to claim 1, wherein said port is provided with a neck portion projecting from said bottom side toward the outside and a flange extending from said neck portion in substantially parallel with said bottom side.

7. A liquid container according to claim 1, wherein said port is formed by laminated structure.

8. A liquid container according to claim 7, wherein said laminated structure is welded at said port.

9. A liquid container according to claim 8, wherein said laminated structure includes laminated materials having thicknesses which gradually decrease.

10. A liquid container according to claim 7, further comprising a cylindrical member extended into said container to retain a shape of said port.

11. A liquid container according to claim 1, wherein said laminated structure supports an elastic member to be pierced by a connection needle.

12. A liquid container according to claim 11, wherein said needle is a hollow needle.

13. A liquid container according to claim 1, further comprising a bottom cover for covering said port.

14. A liquid container according to claim 13, wherein said bottom cover is provided with a recess for engagement with a member for constituting said port.

15. A liquid container according to claim 13, wherein said identifying portion includes a storing member for storing a kind and/or a remaining amount of the liquid in said container by electric, magnetic or optical or memory by combination thereof.

16. A liquid container according to claim 1, wherein said bottom cover is provided with an identifying portion for preventing erroneous connection.

17. A liquid container according to claim 1, wherein said container is disconnectably connected with an ink jet recording apparatus for effecting recording on a recording material by ejection of the liquid.

18. A liquid container according to claim 17, wherein said liquid container contains the liquid to be ejected.

19. A liquid container having a generally flat rectangular parallelepiped shape, comprising:

opposite major sides;

an elongated bottom side connecting said opposite major sides;

a port, formed adjacent a longitudinal end portion of said bottom side, for fluid communication between an inside and an outside of said liquid container, said port being elongated in a longitudinal direction of said bottom side and having a width which is larger adjacent a longitudinally central portion of said bottom side than adjacent the longitudinal end portion, wherein said container is disconnectably connected with an ink jet recording apparatus for effecting recording on a recording material by ejection of the liquid.

20. A liquid container according to claim 19, wherein said liquid container contains the liquid to be ejected.

* * * * *

UNITED STATES PATENT AND TRADEMARK OFFICE

CERTIFICATE OF CORRECTION

PATENT NO. : 6,945,642 B2
APPLICATION NO. : 10/348983
DATED : September 20, 2005
INVENTOR(S) : Hajime Yamamoto et al.

It is certified that error appears in the above-identified patent and that said Letters Patent is hereby corrected as shown below:

ON THE TITLE PAGE

Item (56) References Cited, the following reference should be added:
--6,540,132 4/2003 Lowry, et al 229/117.12--.

COLUMN 1

Line 51, “through” should read --though--.

COLUMN 2

Line 54, “hag” should read --has--.

COLUMN 3

Line 26, “its” should read --it--.

COLUMN 5

Line 59, “the” should be deleted.

COLUMN 6

Line 25, “a” should read --an--;
Line 36, “a” should read --an--; and
Line 66, “a” should read --an--.

COLUMN 13

Line 12, “eliminates” should read --eliminate--; and
Line 61, “increases” should read --increase--.

COLUMN 21

Line 47, “Of” should read --of--.

COLUMN 31

Line 1, “to” should be deleted.

UNITED STATES PATENT AND TRADEMARK OFFICE

CERTIFICATE OF CORRECTION

PATENT NO. : 6,945,642 B2
APPLICATION NO. : 10/348983
DATED : September 20, 2005
INVENTOR(S) : Hajime Yamamoto et al.

It is certified that error appears in the above-identified patent and that said Letters Patent is hereby corrected as shown below:

COLUMN 36

Line 14, "or optical or memory" should read --or optical memory or--.

Signed and Sealed this

Ninth Day of January, 2007

JON W. DUDAS
*Director of the United States Patent and Trademark Office*